US007316477B2

(12) United States Patent
Yoda

(10) Patent No.: US 7,316,477 B2
(45) Date of Patent: Jan. 8, 2008

(54) INK JET PRINTER

(75) Inventor: Kaneo Yoda, Okaya (JP)

(73) Assignee: Seiko Epson Corporation (JP)

( * ) Notice: Subject to any disclaimer, the term of this patent is extended or adjusted under 35 U.S.C. 154(b) by 130 days.

(21) Appl. No.: 11/043,909

(22) Filed: Jan. 26, 2005

(65) Prior Publication Data

US 2005/0206708 A1 Sep. 22, 2005

(30) Foreign Application Priority Data

| | | |
|---|---|---|
| Feb. 16, 2004 | (JP) | 2004-037996 |
| Feb. 16, 2004 | (JP) | 2004-037997 |
| Feb. 16, 2004 | (JP) | 2004-037998 |
| Feb. 16, 2004 | (JP) | 2004-037999 |
| Feb. 17, 2004 | (JP) | 2004-040151 |
| Mar. 26, 2004 | (JP) | 2004-092358 |

(51) Int. Cl.
*B41J 13/08* (2006.01)

(52) U.S. Cl. ..... 347/104; 347/35; 271/198; 271/275

(58) Field of Classification Search ..... None
See application file for complete search history.

(56) References Cited

U.S. PATENT DOCUMENTS

| | | | | |
|---|---|---|---|---|
| 2,585,834 | A * | 2/1952 | Pocock | 38/143 |
| 4,447,817 | A * | 5/1984 | Naramore | 347/104 |
| 4,697,944 | A * | 10/1987 | Peebles et al. | 400/635 |
| 5,674,345 | A * | 10/1997 | Nash | 156/264 |
| 6,588,954 | B2 * | 7/2003 | Verhoest et al. | 400/635 |
| 2005/0046667 | A1 | 3/2005 | Ando et al. | |
| 2005/0063753 | A1 | 3/2005 | Morita et al. | |

FOREIGN PATENT DOCUMENTS

| | | |
|---|---|---|
| JP | 08-132700 | 5/1996 |
| JP | 10-202922 | 8/1998 |
| JP | 11-115274 | 4/1999 |
| JP | 2001-113690 | 4/2001 |
| JP | 2002-103638 | 4/2002 |
| JP | 2002-120386 | 4/2002 |
| JP | 2002-356026 | 12/2002 |

OTHER PUBLICATIONS

Communication from Japanese Patent Office regarding related application.
Communication from Japanese Patent Office regarding related application, date unknown.

* cited by examiner

*Primary Examiner*—Jill E. Culler
(74) *Attorney, Agent, or Firm*—Harness, Dickey & Pierce, P.L.C.

(57) ABSTRACT

An ink jet printer for discharging ink drips to a printing medium mounted on a conveying belt and conveyed from a plurality of nozzles, in which the printing quality is improved and the printing speed is raised. A printing medium conveying section has first and second conveying portions connected in the conveying direction of the printing medium and a plurality of conveying belts are arranged by mutually keeping a predetermined interval, in which the conveying belts of the first and second conveying portions are set so that an other-hand conveying belt is located between one-hand conveying belts, and a printing head is constituted of a first head set to a position facing the gap between the conveying belts of the first conveying portion and a second head set to a position facing the gap between the conveying belts of the second conveying portion.

18 Claims, 52 Drawing Sheets

INK JET PRINTER

BACKGROUND OF THE INVENTION

1. Field of the Invention

The present invention relates to an ink jet printer for completing printing of data in a printing medium by moving the printing medium without moving a printing head.

2. Description of the Related Art

In recent years, an ink jet printer (hereafter referred to as line-head-type ink jet printer) is practically used which has a line-type printing head (hereafter referred to as line head) in which many nozzles are arranged over the width or more of a printing medium from a request for increase in the printing speed of an ink jet printer for discharging ink from a nozzle so as to print data in a printing medium.

In the case of this line-head-type ink jet printer, the face of a printing medium on which data will be printed is continuously or intermittently conveyed by facing a face on which the nozzle of a line head is formed. Moreover, the line head selectively discharges ink in accordance with the information to be printed out of many arranged nozzles toward the face of the conveyed printing medium on which data will be printed. That is, the line-head-type ink jet printer completes a data printing in a printing medium only by moving a printing medium in one direction without moving a printing head.

In the case of the line-head-type printer, a configuration is known in which data is printed in a printing medium conveyed by being adsorbed by a conveying belt which is applied between a pair of rollers as disclosed in JP10-202922A.

Moreover, in the case of the printing head of an ink-jet-type printer not applied only to the line type, the solvent of ink is evaporated from a nozzle from which ink drips are discharged which results in the rising of the viscosity of the ink in the nozzle. In the worst case, the ink is solidified or foreign matter enters the nozzle and the nozzle is clogged, and the performance for discharging ink drips from the nozzle may be deteriorated. Therefore, the ink jet printer performs clogging prevention discharge by discharging ink drips independently of printing to prevent clogging before the discharge performance is deteriorated due to the rising of the ink viscosity in the nozzle or the clogging of the nozzle, and is constituted so that preferable printing quality is maintained.

In the case of the above line-head-type ink jet printer, as disclosed in JP2001-113690A, a technique is known which, even if continuously printing data in many printing media, avoids that the clogging prevention discharge lengthens the time up to completion of printing by forming a plurality of holes in a conveying belt applied between a pair of conveying rollers to convey a printing medium and by discharging ink drips through the holes.

Moreover, in the case of the printing head of an ink jet printer not applied only to the line type, the solvent of ink is evaporated from a nozzle for discharging ink drips and the ink in the nozzle is solidified foreign matter gets into the nozzle to clog it, thereby, the performance for discharging ink drips may be deteriorated. Therefore, the ink jet printer is constituted by having a protective cap for covering the nozzle face to protect the nozzle face, preventing the solvent from vaporizing foreign matter from entering the nozzle, and for preventing from clogging of the nozzle so that preferable printing quality is maintained.

For the above line-head-type ink jet printer, a technique is conventionally known which evacuates a cap to the side of a conveying belt, moves a printing head set on the conveying belt upward forming a gap between the printing head and the conveying belt, and inserts the cap into the gap from the direction orthogonal to the conveying direction of the conveying belt as disclosed in JP2002-120386A.

Moreover, in the case of the printing head of an ink jet printer, the solvent of ink is evaporated from the nozzle for discharging ink drips and the ink in the nozzle is solidified or foreign matter enters the nozzle and thus the nozzle is clogged and thereby, the performance for discharging ink drips from the nozzle may be deteriorated. Therefore, the ink jet printer has a discharge performance recovery apparatus for recovering the deteriorated discharge performance and is constituted so that preferable printing quality is maintained.

For the above line-head-type ink jet printer, a technique is known which rotates a line head to a no-printing area which is an area in which a nozzle does not face a printing medium on a plane parallel with the printing medium to recover the discharge performance of the line head as disclosed in JP2002-103638A.

Moreover, in the case of the above line-head-type ink jet printer, a configuration is known which conveys a printing medium by mounting the printing medium on a conveying belt applied between a pair of conveying rollers as disclosed in JP8-132700A. Furthermore, a configuration is known in which a spur is applied between printing heads in the conveying direction of the printing medium to prevent from floating the printing medium being conveyed from a conveying belt.

However, in the case of the configuration disclosed in JP10-202922A, the conveying speed of a printing medium is fluctuated due to the telescopic motion of a conveying belt or the interval between a printing head and the printing medium becomes unstable because the conveying belt vibrates between conveying rollers and thereby, the landing position of ink drips on the printing medium maybe shifted from a predetermined position. The landing position shift of ink drips due to these phenomena more remarkably occurs as the conveying interval by the conveying belt increases. That is, there is an unsolved problem that it is difficult to lengthen the conveying interval by a conveying belt while maintaining a preferable printing quality.

The present invention is made to solve the above problem and its first object is to provide an ink jet printer capable of lengthening the conveying interval by a conveying belt without spoiling the printing quality, further improving the printing quality, and increasing in the printing speed.

In the case of the configuration disclosed in JP10-202922A, many nozzles for discharging ink drips are arranged over the A4 minor dimension in the sheet width direction. Moreover, a conveying belt has a width longer than a nozzle string which is constituted of many arranged nozzles and is so set as to face the nozzles in order to cover the nozzle string.

Therefore, when applying non-marginal printing to an A4-size printing sheet, ink outgoing from the printing area of the printing sheet contaminates a conveying belt. Moreover, there is an unsolved problem that it is difficult to apply non-marginal printing to a printing sheet having a size smaller than size A4 or a different shape.

The present invention is made to solve the above problem and its second object is to provide an ink jet printer making it possible to apply non-marginal printing to the printing medium having various dimensions and shapes without contaminating a conveying belt with ink.

In the case of the prior art disclosed in JP2001-113690A, it is necessary to form holes on a conveying belt for conveying a printing medium. When applying a predetermined tensile load to the conveying belt on which holes are formed, a tensile stress and strain are increased in portions nearby the holes compared to other portions. That is, the tensile stress and strain are ununiformly generated on the entire perimeter of the conveying belt because of the holes which are formed upon.

This is not preferable for an ink jet printer for printing data in a printing medium by conveying the printing medium through a conveying belt in the point that it is difficult to improve the printing quality. That is, in the case of conveying by the conveying belt, the conveying speed of the printing medium is fluctuated due to the telescopic motion of the conveying belt or due to the conveying belt vibrates between conveying rollers and thereby, the interval between a printing head and the printing medium becomes unstable and the landing position of ink drips on the printing medium is shifted from a predetermined position.

That is, in the case of the prior art disclosed in the above JP2001-113690A, by forming holes on a conveying belt, there are unsolved problems that fluctuation of the conveying speed and vibration of the conveying belt are encouraged which makes it difficult to improve the printing quality.

The present invention is made to solve the above problems and its third object is to provide an ink jet printer for restraining the fluctuation of the conveying speed of a printing medium and for making it possible to realize clogging prevention discharge without deteriorating the printing quality and printing speed.

Moreover, in the case of the prior art disclosed in the above JP2002-120386A, a configuration is used in which a printing head is moved upward and a cap is moved under the printing head from the side. Therefore, it is difficult to decrease the time until a protective cap is set to a printing head and the time until the protective cap is removed from the printing head and evacuated. Moreover, a mechanism for moving the printing head and the protective cap is necessary. Therefore, there are unsolved problems that it is difficult to maintain a high reliability of a mechanism portion and to decrease the number of components.

The present invention is made to solve the above problems and its fourth object is to provide an ink jet printer having a simple configuration and capable of decreasing the time required for setting or removing a protective cap to or from a printing head and of securing a high reliability.

Moreover, in the case of the prior art disclosed in the above JP2002-103638A, it is limited to increase the rotational speed without damaging a line head, thus it is difficult to decrease the time required for recovering the discharge performance, and a mechanism and control for rotation become complex. Furthermore, because a discharge performance recovery apparatus must be set in a non-printing area, there are unsolved problems that downsizing is difficult and the like.

The present invention is made to solve the above problem and its fifth object is to provide an ink jet printer for decreasing the time to be required for recovering the discharge performance, and for being easily downsized.

Moreover, in the case of the prior art disclosed in the above JP8-132700A, a spur to restrain a printing medium to be lifted while transporting is set between printing heads in the conveying direction of a printing medium. Therefore, the lift is restrained by the spur for a printing medium having a high rigidity such as label paper and it is possible to preferably keep the interval between the printing head and the printing medium. However, a sufficient effect cannot be obtained for a warp produced as ink infiltrates into a printing medium which has a low rigidity such as a printing sheet.

That is, as shown in FIGS. 52A to 52D which are the illustrations for explaining a problem of the prior art, in the case of a printing sheet P, when the ink IK discharged from a printing head HDA infiltrates into a printing face PP, the balance between the printing face PP and a conveying face PH which is an opposite face to the printing face PP is broken at a portion where the ink IK infiltrates and a warp is produced (FIG. 52B).

When the printing sheet P mounted on a conveying belt V is conveyed and reaches a spur portion, the warp of the printing sheet P is corrected by a spur SP as shown in FIG. 52C.

When the printing sheet P passes through the spur portion and reaches the printing head HDB, a warp is produced again on the printing sheet P because there is not an object for correcting the warp as shown in FIG. 52D. That is, though the warp of the printing sheet P is temporarily corrected at the spur portion, the warp is produced again after passing through the spur portion and an unsolved problem remains that it is difficult to properly keep the interval between the printing head and the printing sheep P.

The present invention is made to solve the above problem and its sixth object is to provide an ink jet printer capable of restraining the lift of a printing medium and properly keeping the interval between the printing medium and a printing head.

SUMMARY OF THE INVENTION

A first invention is an ink jet printer comprising a printing medium conveying section for mounting a printing medium on a conveying belt and conveying the printing medium and a printing head which is set to face a printing face of the printing medium which is an opposite face to the conveying face of the printing medium which is conveyed by the printing medium conveying section and a plurality of nozzles are arranged to discharge ink drips in the direction intersecting with the conveying direction of the printing medium, in which the printing medium conveying section has a first conveying portion and a second conveying portion which are connected in the conveying direction of the printing medium and in which a plurality of conveying belts are set by mutually keeping a predetermined interval, and conveying belts of the first and second conveying portions are arranged so that an other-hand conveying belt is located between one-hand conveying belts.

In the case of the first invention, the conveying interval of the printing medium in the printing medium conveying section is constituted of the first conveying portion and the second conveying portion. Therefore, it is possible to constitute conveying belts of the first and second conveying portions so that each peripheral length is short compared to the case of constituting the same conveying interval by one conveying portion.

That is, as a result of comparing a conveying belt having a long peripheral length with conveying belts of the first and second conveying portions by applying the same tension to them, the elongations of the first and second conveying portions respectively having a short peripheral length become smaller. Therefore, it is possible to decrease the elongation of a conveying belt which is produced due to rotation of a driving shaft and decrease the fluctuation of the conveying speed of a printing medium due to the expansion and contraction of a conveying belt and a shift of the landing position of an ink drip to the printing medium due to the vibration of the conveying belt.

Moreover, a second invention is an ink jet printer comprising a printing medium conveying section for mounting a printing medium on a conveying belt and conveying the printing medium and a printing head which is set to face a printing face of the printing medium which is an opposite face to the conveying face of the printing medium which is conveyed by the printing medium conveying section and a plurality of nozzles are arranged to discharge ink drips in the direction intersecting with the conveying direction of the printing medium, in which the printing medium conveying section has a first conveying portion and a second conveying portion which are connected in the conveying direction of the printing medium and in which a plurality of conveying belts are set by mutually keeping a predetermined interval, and the conveying belts of the first and second conveying portions are arranged so that an other-hand conveying belt is located between one-hand conveying belts, and the printing head is constituted of a first head set which is positioned to face the gap between the conveying belts of the first conveying portion and a second head set which is positioned to face the gap between the conveying belts of the second conveying portion.

According to the second invention, when a printing medium is not present on a conveying belt, it is possible to avoid discharged ink drips from attaching onto the conveying belt even if a printing head performs clogging prevention discharge for discharging ink drips independently of printing. Moreover, it is not necessary to change positions of a printing head when the printing head performs printing and clogging prevention discharge, also it is possible to complete the clogging prevention discharge in a short time.

Furthermore, in the case of a third invention, the conveying belts of the first conveying portion and the second conveying portion are applied between a driving shaft and a driven shaft set in parallel with the driving shaft in the first invention.

In the case of a fourth invention, the conveying belts of the first conveying portion and the second conveying portion are applied between a driving shaft and a driven shaft set in parallel with the driving shaft in the second invention.

In the case of a fifth invention, the conveying belts of the first conveying portion and the second conveying portion are applied between a common driving shaft set between the first and second conveying portions and first driven shaft and second driven shaft set in parallel with the common driving shaft in the first invention.

Moreover, in the case of a sixth invention, the conveying belts of the first conveying portion and second conveying portion are applied between a common driving shaft set between the first and second conveying portions and first driven shaft and second driven shaft set in parallel with the common driving shaft in the second invention.

In the case of the fifth and sixth inventions, because the conveying belt of the first conveying portion and the conveying belt of the second conveying portion are rotated at the same speed by the common driving shaft, the printing medium is conveyed at the same speed on the first conveying portion and the second conveying portion.

Moreover, it is possible to constitute the peripheral length of each of the conveying belts of the first and second conveying portions short compared to the case of constituting the peripheral length of the same transport distance from the first driven shaft up to the second driven shaft by one conveying belt. That is, as a result of comparing a conveying belt having a long peripheral length with conveying belts of the first and second conveying portions by applying the same tension, elongations of the first and second conveying portions respectively having a short peripheral length become small. Therefore, it is possible to decrease the elongation of a conveying belt produced due to rotation of a driving shaft.

Moreover, in the case of a seventh invention, the first and second conveying portions are respectively constituted of the same number of the conveying belts in the first invention.

In the case of an eighth invention, the first and second conveying portions are respectively constituted of the same number of the conveying belts in the second invention.

In the case of ninth invention, the first and second conveying portions are respectively constituted of the same number of the conveying belts in the third invention.

In the case of a tenth invention, the first and second conveying portions are respectively constituted of the same number of the conveying belts in the fourth invention.

In the case of an eleventh invention, the first and second conveying portions are respectively constituted of the same number of the conveying belts in the fifth invention.

In the case of a twelfth invention, the first and second conveying portions are respectively constituted of the same number of the conveying belts in the sixth invention.

In the case of each of the seventh to twelfth inventions, it is possible to equalize the number of conveying belts of the first conveying portion with the number of conveying belts of the second conveying portion.

Moreover, in the case of a thirteenth invention, either of the first and second conveying portions is set to the number of conveying belts one more than the number of the other conveying belts of the other conveying portion, and the conveying belt of the first conveying portion and the conveying belt of the second conveying portion are alternately arranged centering around the central conveying belt of a conveying portion having an odd number of the conveying belts among the first and second conveying portions in the first invention.

Furthermore, in the case of a fourteenth invention, either of the first and second conveying portions is set to the number of conveying belts one more than the number of the other conveying belts of the other conveying portion, and the conveying belt of the first conveying portion and the conveying belt of the second conveying portion are alternately arranged centering around the central conveying belt of a conveying portion having an odd number of conveying belts among the first and second conveying portions in the second invention.

In the case of a fifteenth invention, either of the first and second conveying portions is set to the number of conveying belts one more than the number of the other conveying belts of the other conveying portion, and the conveying belt of the first conveying portion and the conveying belt of the second conveying portion are alternately arranged centering around the central conveying belt of a conveying portion having an odd number of the conveying belts among the first and second conveying portions in the fourth invention.

In the case of a sixteenth invention, either of the first and second conveying portions is set to the number of conveying belts one more than the number of the other conveying belts of the other conveying portion, and the conveying belt of the first conveying portion and the conveying belt of the second conveying portion are alternately arranged centering around the central conveying belt of a conveying portion having an odd number of the conveying belts among the first and second conveying portions in the fourth invention.

In the case of a seventeenth invention, either of the first and second conveying portions is set to the number of conveying belts one more than the number of the other conveying belts of the other conveying portion, and the conveying belt of the first conveying portion and the conveying belt of the second conveying portion are alternately arranged centering around the central conveying belt of a conveying portion having an odd number of the conveying belts in the fifth invention.

In the case of an eighteenth invention, either of the first and second conveying portions is set to the number of conveying belts one more than the number of the other conveying belts of the other conveying portion, and the conveying belt of the first conveying portion and the conveying belt of the second conveying portion are alternately arranged centering around the central conveying belt of a conveying portion having an odd number of the conveying belts among the first and second conveying portions in the sixth invention.

In the case of each of the thirteenth to eighteenth inventions, it is possible to set the number of conveying belts of either of the first and second conveying portions to an odd number of conveying belts and the number of the other conveying belts to an even number of conveying belts.

In the case of a nineteenth invention, the distance between conveying belts of the first and second conveying portions is set longer than each of the width of the printing areas by the first and second heads.

According to the nineteenth invention, the ink drip discharged from each of the first and second heads when a printing medium is not present on a conveying belt can securely pass between conveying belts and it is possible to restrain ink from attaching to the conveying belt.

Moreover, in the case of a twentieth invention, the total printing area which is made by connecting the printing areas of the first and second heads is set to a length for covering the width of the printing medium conveyed by the printing medium conveying section in the direction orthogonal to the conveying direction of the printing medium in the nineteenth invention.

According to the twentieth invention, the total printing area of a printing head can cover the width of the printing medium without the fact that a printing head faces a conveying belt. Therefore, even if a printing head discharges ink drips from the total printing area and performs non-marginal printing for performing printing over the whole of a printing face without leaving a margin which is an unprinted portion in the printing medium, it is possible to avoid the ink drips discharged to the outside of the printing face from attaching onto a conveying belt.

In the case of a twenty-first invention, the total printing area which is made by connecting the printing areas in the first and second heads is set to a value smaller than the width of the printing medium conveyed by the printing medium conveying section in the direction orthogonal to the conveying direction of the medium and a third head is set on which a printing area protruding from the side margin orthogonal to the conveying direction of the printing medium is formed by extending the total printing area to the outside of the conveying belt at the outermost side of either of the first and second conveying portions.

According to the twenty-first invention, it is possible to extend the total printing area by the first and second heads. Therefore, it is possible to perform non-marginal printing for performing printing over the whole of a printing face without leaving a margin which is an unprinted portion on the printing medium by discharging ink drips from the whole of the total printing area on which the printing heads are extended.

In the case of a twenty-second invention, an equal number of conveying belts are applied to the first and second conveying portions and the third head is set to the position at the outside of the conveying belt at the outermost side of the first conveying portion and facing the conveying belt at the outermost side of the second conveying portion and the position at the outside of the conveying belt at the outermost side of the second conveying portion and facing the conveying belt at the outermost side of the first conveying portion in the twenty-first invention.

In the case of a twenty-third invention, the number of conveying belts of either of the first and second conveying portions is set one less than the number of conveying belts of other conveying portion and the third head is set to outsides of the conveying belts at both sides serving as outermost sides of the conveying portion which has the number of conveying belts one less than the other conveying portion in the twenty-first invention.

In the case of a twenty-fourth invention, a printing-medium lift control section for controlling the lift of the printing medium from the conveying belt is set to at least either one of the first and second heads.

According to the twenty-fourth invention, it is possible to properly keep the interval between a printing medium and a printing head because the lift of the printing medium is controlled under the printing head.

In the case of a twenty-fifth invention, the printing-medium lift control section is a roller constituted so as to be rotatable in the twenty-fourth invention.

In the case of the twenty-fifth invention, the lift of a printing medium is controlled by the peripheral face of a rotatable roller.

According to the above mentioned, because the roller is constituted so as to be rotatable, it does not resist or interrupt conveying of a printing medium.

In the case of a twenty-sixth invention, the roller has a plurality of protrusions radially extending on the peripheral face of the roller in the twenty-fifth invention.

According to the twenty-sixth invention, it is possible to bring not the whole periphery of the roller but a protrusion portion having a small area into contact with the printing face of a printing medium and thereby, to decrease the number of damages on the printing face whose printing is completed.

In the case of a twenty-seventh invention, when the side faces of the heads in which they are faced with each other between the heads moving in parallel in the direction orthogonal to the conveying direction, the roller is set in the trajectory drawn by the side faces of the heads in the top view in the twenty-fourth invention.

In the case of a twenty-eighth invention, the contact point between the roller and the printing medium is set so as to be located on the line mutually connecting nozzles of the heads between the heads in the top view in the twenty-fourth invention.

According to the twenty-eighth invention, the roller can control the lift of the printing medium under the nozzles of the printing heads and properly keep the interval between the nozzle of the printing head and the printing face of the printing medium.

In the case of a twenty-ninth invention, the interval between the roller and the conveying belt is set to the distance at which the roller presses the printing medium against the conveying belts when the printing medium is present between the roller and the conveying belts in the twenty-fourth invention.

According to the twenty-ninth invention, it is possible to properly keep the interval between the printing face of the printing medium and the printing heads independently of the thickness of the printing medium because the printing medium is pressed against the conveying belts by the roller.

In the case of thirtieth invention, the interval between the roller and the conveying belt is set to the distance at which the roller contacts with the printing face of the printing medium when the printing medium is present between the roller and the conveying belt and is lifted at a predetermined value from the conveying belt in the twenty-fourth invention.

According to the thirtieth invention, the peripheral face of the roller contacts with the printing medium only when the printing medium is lifted from the conveying belt by a predetermined value, but it does not contact with the printing medium when the lift of the printing medium is less than the predetermined value.

According to the above mentioned, when the lift of the printing medium is less than the predetermined value, it is possible to avid the printing face of completed printing from damaging.

In the case of a thirty-first invention, a head protective section for protecting the nozzles formed on the first and second heads by covering them at the position of between the conveying belts is set to sandwich the conveying route of the printing medium by facing the first and second heads in the second invention.

According to the thirty-first invention, the head protective section is set by avoiding the conveying belt but sandwiching the conveying route by facing to the printing heads.

According to the above mentioned, it is possible to keep the head protective section below the conveying face of the printing medium and an ink jet printer can be downsized. Moreover, when data is printed in the printing medium, transport of the printing medium is not interrupted and the printing heads are quickly protected because the head protective section faces the first and second heads.

In the case of a thirty-second invention, a gap is formed between the conveying belt of the first conveying portion and the conveying belt of the second conveying portion and the width of the head protective section is set to a width for covering all the nozzles of the first and second heads in the thirty-first invention.

According to the thirty-second invention, the head protective section can cover all the nozzles of the first and second heads.

In the case of a thirty-third invention, the head protective section is constituted so as to be movable between a sheltering position where the front end of the section shelters below the conveying route of the printing medium and a head protective position rising from the sheltering position at the time of head protection and contacting with the printing head in the thirty-first invention.

According to the thirty-third invention, the head protective section is sheltered to the sheltering position when data is printed in the printing medium and it does not interrupt to transport the printing medium. When printing is not performed, it is possible to protect the printing heads by slightly rising.

In the case of a thirty-fourth invention, a discharge performance recovery section is set to face a printing head for sucking ink from the nozzle to recover the ink discharge performance is set to the position between conveying belts facing the first and second heads by sandwiching the conveying route of the printing medium in the second invention.

According to the thirty-fourth invention, the discharge performance recovery section is set to avoid conveying belts, to sandwich the conveying route of the printing medium, and to face the printing heads.

According to the above mentioned, it is possible to keep the discharge performance recovery section below the conveying face of the printing medium and the ink jet printer can be downsized. Moreover, when data is printed in the printing medium, conveying of the printing medium is not interrupted and moreover, the discharge performance recovery section faces the first and second heads. Therefore, it is possible to quickly perform the discharge performance recovery process.

In the case of a thirty-fifth invention, a gap is formed between the conveying belt of the first conveying portion and the conveying belt of the second conveying portion and the width of the discharge performance recovery section is set to a width for covering all the nozzles of the first and second conveying heads in the thirty-fourth invention.

According to the thirty-fifth invention, the discharge performance recovery section can cover all the nozzles of the first and second heads.

In the case of a thirty-sixth invention, the discharge performance recovery section has a head protective function for covering and protecting the nozzles formed on the first and second heads in the thirty-fourth invention.

According to the thirty-sixth invention, because the discharge performance recovery section has the head protective function, it is unnecessary to separately set the discharge performance recovery section and the head protective section and thereby, it is possible to downsize an ink jet printer.

A thirty-seventh invention is an ink jet printer having printing medium conveying section for conveying a printing medium by mounting the medium on a conveying belt and a printing head set by facing a printing face serving as a face opposite to the conveying face of the printing medium to be conveyed by the printing medium conveying section and forming a printing area by arranging a plurality of nozzles for discharging ink drips in the direction intersecting with the conveying direction of the printing medium, in which the printing medium conveying section has at least one conveying portion in which a plurality of the conveying belts are applied between a driving shaft and a driven shaft in parallel with each other by keeping a predetermined interval between the conveying belts, the printing head has a configuration in which the nozzles are arranged on the whole area in the direction intersecting with the conveying direction on the printing face of the printing medium, discharge performance recovery section for attracting ink from the nozzles facing the conveying belts is set to the position between the conveying belts of the conveying portion to sandwich the conveying route of the printing medium with the printing heads and facing to this printing heads, and a relative movement section for relatively moving the relative position between the printing head and the discharge performance recovery section so that the non-facing nozzle which is not facing the discharge performance recovery section faces the discharge performance recovery section.

According to the thirty-seventh invention, the discharge performance recovery section is set to avoid conveying belts, to sandwich the conveying route of the printing medium, and to face the printing head. Moreover, the printing head has a facing nozzle which is facing a gap between conveying belts and non-facing nozzle which is not facing the discharge performance recovery section, in which the relative position to the discharge performance recovery section of the printing head is moved by the relatively moving section until the non-facing nozzle faces the discharge performance recovery section in recovering the discharge performance of the non-facing nozzle.

According to the above mentioned, ink is attracted from not only the facing nozzle of the printing head but also the non-facing nozzle and it is possible to recover the discharge performance. Moreover, it is possible to keep the discharge performance recovery section under the conveying face of a printing medium and minimize the necessary number of discharge performance recovery sections and an ink jet printer can be downsized.

In the case of a thirty-eighth invention, the relative movement section is the head movement section for moving the printing head in the thirty-seventh invention.

According to the thirty-eighth invention, it is possible to move the printing head and make the non-facing nozzle which is not facing the discharge performance recovery section to face the discharge performance recovery section.

In the case of a thirty-ninth invention, the relatively moving section is a discharge performance recovery moving section for moving the discharge performance recovery section in the thirty-seventh invention.

According to the thirty-ninth invention, it is possible to move the discharge performance recovery section and make the non-facing nozzle which is not facing the discharge performance recovery section to face the discharge performance recovery section.

In the case of a fortieth invention, the distance between the conveying belts is set longer than the width of the conveying belt and the width of the discharge performance recovery section is constituted so as to cover a nozzle at the boundary portion between the facing nozzle and the non-facing nozzle and the non-facing nozzle when the non-facing nozzle faces the discharge performance recovery section in the thirty-seventh invention.

According to the fortieth invention, the discharge performance recovery section can redundantly attract ink from the nozzle at the boundary portion between the facing nozzle and the non-facing nozzle.

According to the above mentioned, it is possible to securely attract ink supplied from all nozzles of a printing head and recover discharge performance.

In the case of a forty-first invention, the discharge performance recovery section is constituted so as to be movable between the sheltering position in which the front end of the discharge performance recovery section shelters to below of the conveying route of the printing medium and the discharge performance recovery position by rising from the sheltering position and contacting with the printing head when the discharge performance is recovered in any one of the thirty-fourth to fortieth inventions.

According to the forty-first invention, the discharge performance recovery section does not interrupt conveying of a printing medium because it shelters to the sheltering position while data is printed in a printing medium but the section makes it possible to recover the discharge performance of a printing head by slightly rising when data is not printed in the printing medium.

DETAILED DESCRIPTION OF THE PREFERRED EMBODIMENTS

The first embodiment of the present invention is described below by referring to the accompanying drawings.

Figure 1:
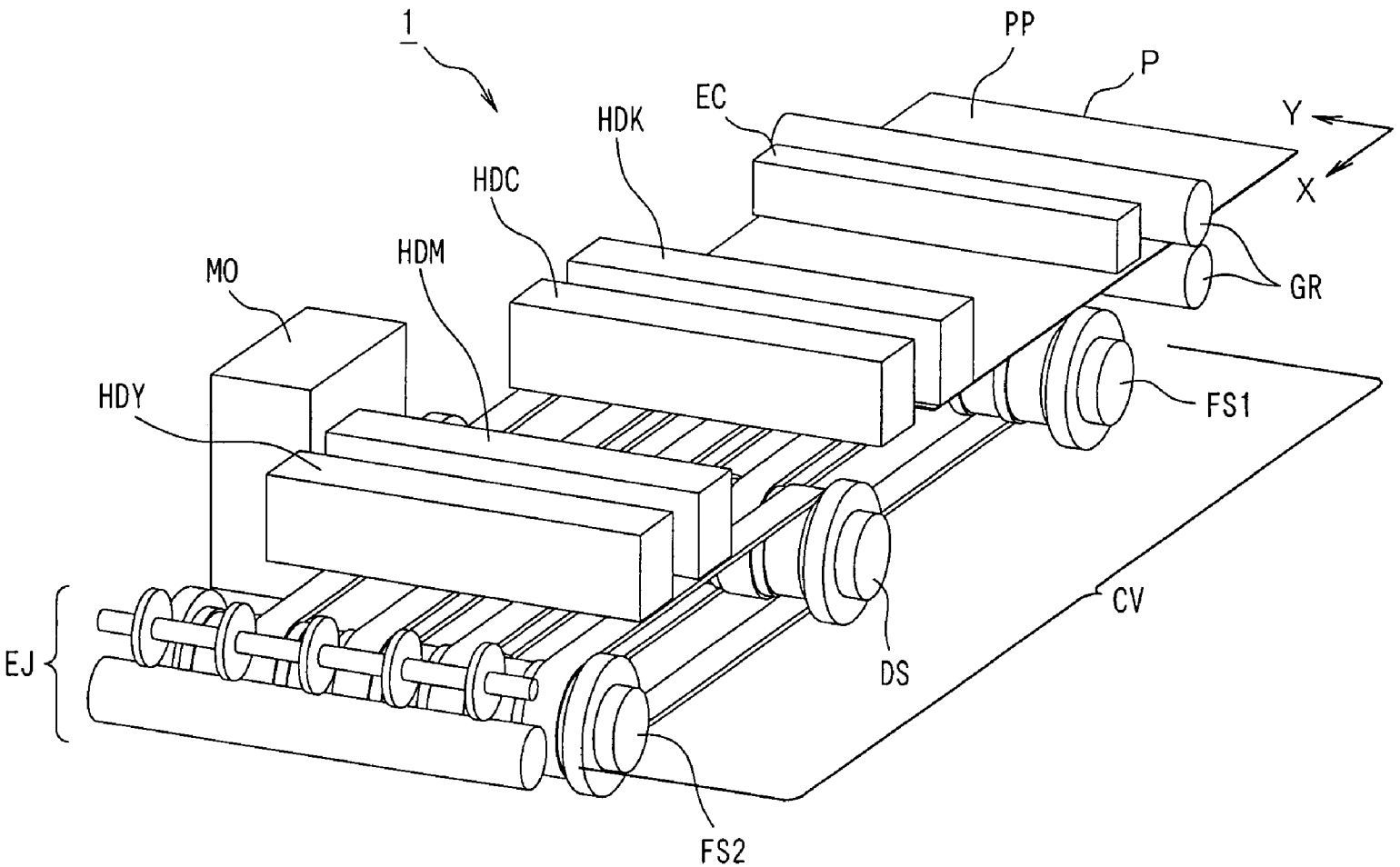
FIG. 1 is an outline view showing a main configuration of an ink jet printer of a first embodiment.

As shown in FIG. 1, the ink jet printer 1 of the first embodiment has a gate roller GR, an static electricity supply portion EC, sheet conveying portion CV, yellow, magenta, cyan, and black printing heads HDY, HDM, HDC, and HDK for discharging various colors of ink drips of yellow, magenta, cyan, and black, and sheet ejecting portion EJ.

Details of the above configurations are described below.

Figure 2:
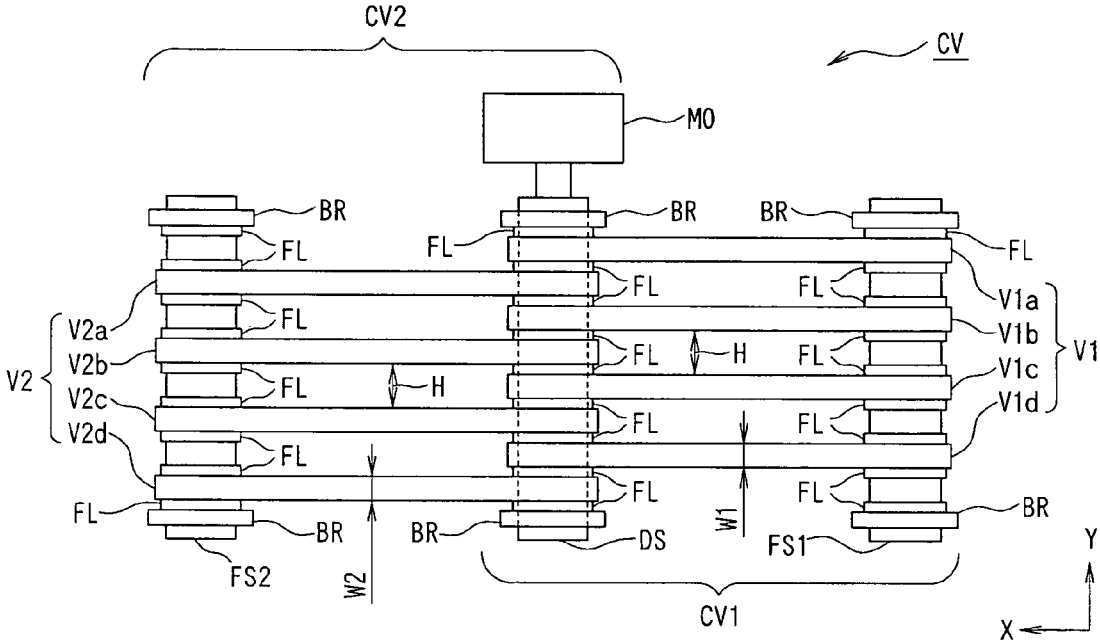
FIG. 2 is s top view of a sheet conveying portion of the first embodiment.

As shown in FIG. 2 which is a top view, the sheet conveying portion CV has a driving shaft DS to which motive power is transferred from a conveying-portion driving motor M0, first and second driven shafts FS1 and FS2 parallel with the driving shaft DS and located at mutually opposite sides at both sides of the driving shaft DS, a first conveying belt V1 applied to the driving shaft DS and the first driven shaft FS1, a second conveying belt V2 applied to the driving shaft DS and the second driven shaft FS2, and a bearing BR for holding the driving shaft DS, the first and second driven shafts FS1 and FS2 to a not-illustrated housing so as to be rotatable.

Moreover, though not illustrated, the first and second driven shafts FS1 and FS2 are provided with the equal force in mutually opposite directions at both sides of the driving shaft DS in order to apply a tension so that the first and second conveying belts V1 and V2 which are applied to the driving shaft DS are not loosened.

The first and second conveying belts V1 and V2 are respectively constituted of four conveying belts V1*a* to V1*d* and V2*a* to V2*d*. Moreover, the conveying belts V1*a* to V1*d* and V2*a* to V2*d* are alternately adjacently arranged in Y direction which is the direction orthogonal to X direction which is the conveying direction of the printing sheet P on the driving shaft DS.

In this case, the conveying belts V1*a* to V1*d* are separated from the conveying belts V2*a* to V2*d* by a flange FL set on the driving shaft DS and first and second driven shafts FS1 and FS2. That is, the conveying belts V1*a* to V1*d* and V2*a* to V2*d* are applied to be controlled in axis-directional movement on the driving shaft DS and first and second driven shafts FS1 and FS2 so that they do not contact with each other. Moreover, the width W1 of the conveying belts V1*a* to V1*d* and the width W2 of the conveying belts V2*a* to V2*d* are set to an equal width. Furthermore, the conveying belt widths W1 and W2 and the belt interval H are set so as to meet the relation of H>W1, W2. The height of the flange portion FL is smaller than the thickness of the conveying belts V1*a* to V1*d* and V2*a* to V2*d* so as not to prevent the conveyance of the printing sheet P.

Furthermore, the driving shaft DS, first driven shaft FS1, and first conveying belt V1 constitute a first conveying portion CV1 and the driving shaft DS, second driven shaft FS2, and second conveying belt V2 constitute a conveying portion CV2.

Then, when the driving motor M0 starts, the motive power supplied from the rotating shaft of the conveying-portion driving motor M0 is transferred to the driving shaft DS and the driving shaft DS is rotated. When the driving shaft DS is rotated, motive power is transferred to the first and second conveying belts V1 and V2 and the first conveying belt V1 and second conveying belt V2 are rotated at an equal speed. The printing sheet P is mounted on peripheries of the first and second conveying belts V1 and V2 and conveyed from the first driven shaft FS1 to the second driven shaft FS2.

The yellow, magenta, cyan, and black printing heads HDY, HDM, HDC, and HDK are line heads respectively having a printing area equal to a sheet width. As shown in FIG. 1, the heads are arranged on the sheet conveying portion CV by facing nozzles for discharging ink drips toward the sides of the first and second conveying belts V1 and V2. Moreover, as shown in FIG. 3, the cyan and black printing heads HDC and HDK are set between the first driven shaft FS1 and the driving shaft DS and the yellow and magenta printing heads HDY and HDM are set between the driving shaft DS and the second driven shaft FS2.

At this point, the arrangement of nozzles set to the color heads HDY, HDM, HDC, and HDK is described.

Figure 3:
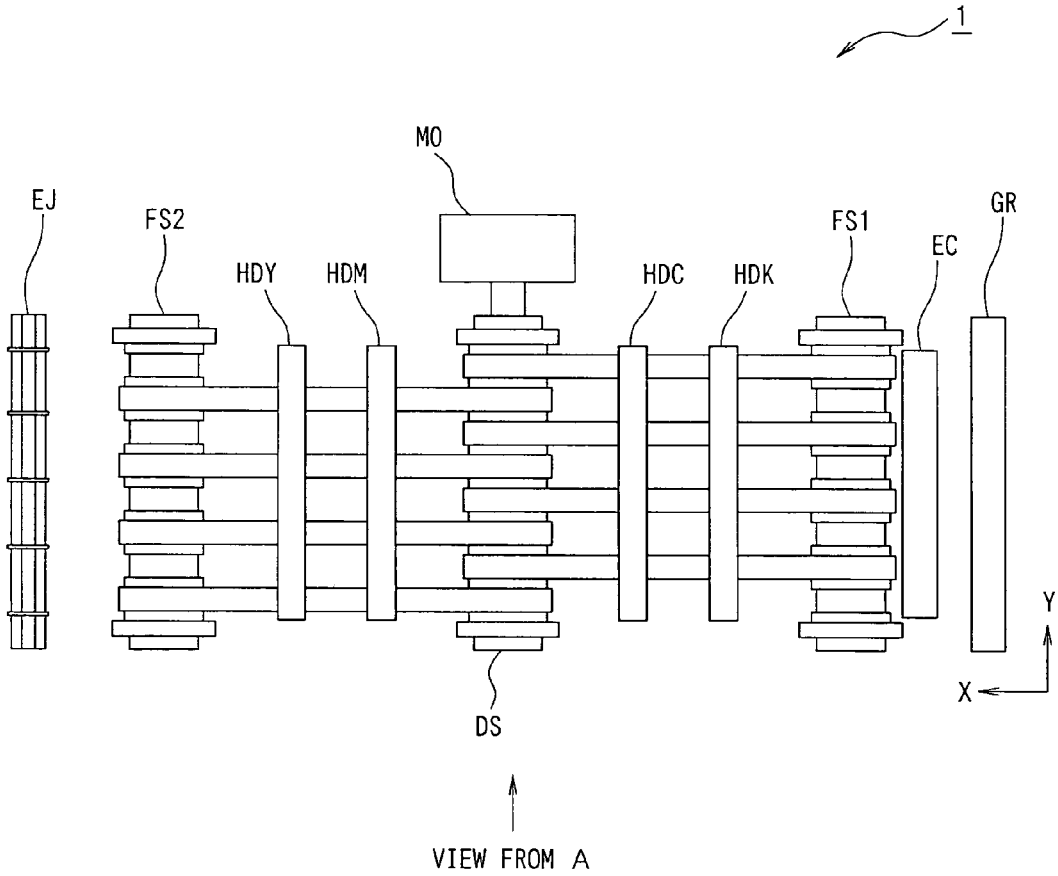
FIG. 3 is a top view showing a main configuration of the ink jet printer of the first embodiment.
Figure 4A:
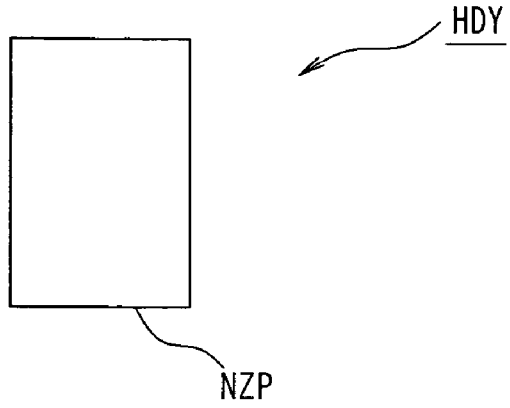
FIGS. 4A and 4B are illustrations showing the appearance of a printing head of the first embodiment.
Figure 4B:
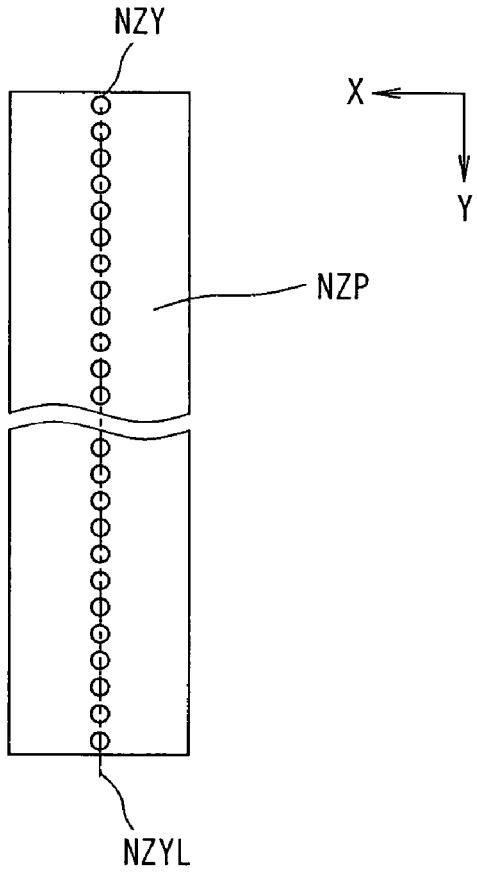

FIGS. 4A and 4B are illustrations showing the appearance of the yellow printing head HDY, in which FIG. 4A is a front view viewed from A in FIG. 3 and FIG. 4B is a bottom view. In FIGS. 4A and 4B, a nozzle is shown by exaggerating the size of the nozzle so that the nozzle can be easily seen.

As shown in FIG. 4B, in the case of the yellow printing head HDY, yellow nozzles NZY for discharging yellow ink are arranged on the nozzle face NZP over the length equal to the sheet width on the same line in Y direction. The arranged yellow nozzles NZY constitute one nozzle string NZYL.

Descriptions of the magenta printing head HDM, cyan printing head HDC, and black printing head HDK are omitted because they have the same configuration of the yellow printing head HDY. As each of these color printing heads HDY, HDM, HDC, and HDK, it is possible to use a printing head for discharging ink drips by applying pressure to ink by a piezoelectric element or heating element.

At this point, relation of the control of main portions of the above-mentioned ink jet printer 1 is described below.

Figure 5:
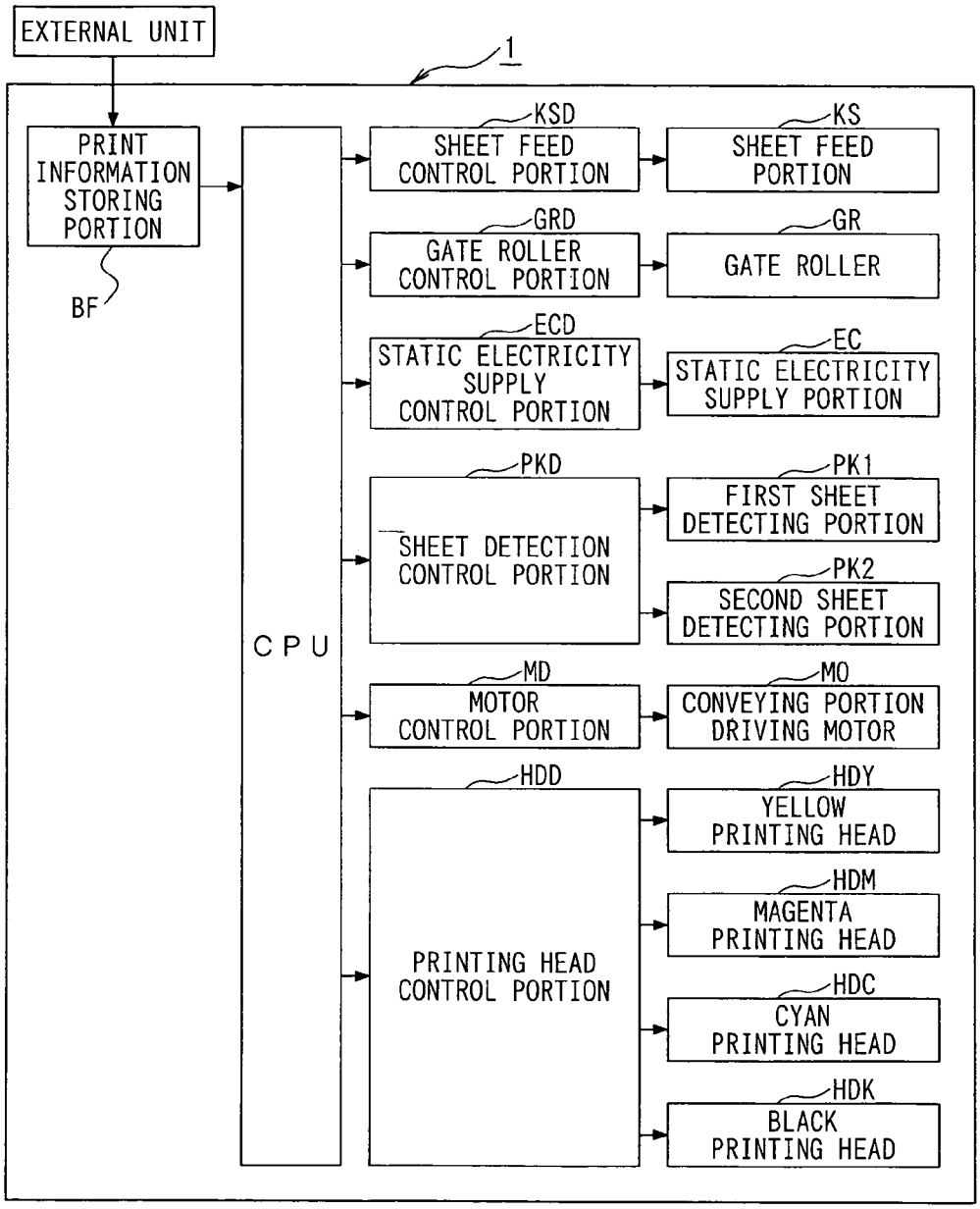
FIG. 5 is a block diagram showing relation of control of a main portion of the ink jet printer of the first embodiment.

As shown in FIG. 5 which is a block diagram, the ink jet printer 1 is further provided, in addition to the main components described above, with a sheet feeding portion KS for feeding the printing sheet P to the gate roller GR, first and second sheet detecting portions PK1 and PK2 for respectively detecting the printing sheet P on the first and second conveying portions CV1 and CV2. The first and second sheet detecting portions PK1 and PK2 respectively detect the printing sheet P in order to measure the timing of printing by the color printing head HDY, HDM, HDC, or HDK and they are set between the first driven shaft FS1 and the black printing head HDK and between the driving shaft DS and the magenta printing head HDM and respectively constituted of a sensor such as a photointerrupter.

Moreover, the ink jet printer 1 is provided with a sheet feed control portion KSD for controlling a sheet feeding portion KS, a gate roller control portion GRD for controlling the gate roller GR, static-electricity supply control portion ECD for controlling a static-electricity supply portion EC, sheet detection control portion PKD for controlling the first and second sheet detecting portions PK1 and PK2, motor control portion MD for controlling the conveying portion driving motor M0, printing head control portion HDD for controlling color printing heads HDY, HDM, HDC, and HDK, a print information storing portion BF for storing print information supplied from an external unit, and CPU for supplying an instruction for operation to the control portions GRD, ECD, PKD, MD, and HDD based on the print information.

Then, the printing operation of the ink jet printer 1 is described below.

The ink jet printer 1 shown in FIG. 1 starts the printing operation when receiving print information and an instruction for printing which are supplied from an external unit.

When the printing operation is started, the printing sheet P is fed to the gate roller GR one by one from a not-illustrated sheet cassette which holds a plurality of printing sheets P.

For the printing sheet P which is fed to the gate roller GR, a tilt in X direction and a displacement in Y direction are corrected by the gate roller GR and sent to the sheet conveying portion CV.

The printing sheet P is electrified by the static-electricity supply portion EC while it is sent from the gate roller GR to the sheet conveying portion CV.

The printing sheet P electrified and having an attraction to the conveying belts is attracted to the periphery of the first conveying belt V1 on the first conveying portion CV1 on which the first conveying belt V1 is rotated counterclockwise on FIG. 1 when the driving shaft DS is rotated by the conveying-portion driving motor M0, conveyed by the motive power from the conveying-portion driving motor M0, and led under the black printing head HDK.

Before the printing sheet P reaches the portion under the black printing head HDK, the first sheet detecting portion PK1 detects the printing sheet P and sends a first sheet detection signal showing that the printing sheet P is detected to the CPU.

The CPU measures timings for starting printing of black and cyan colors and sequentially sends black-color and cyan-color printing instructions to the printing head control portion HDD in accordance with the first sheet detection signal supplied from the first sheet detecting portion PK1.

The printing head control portion HDD first controls the black printing head HDK in accordance with a black-color printing instruction, selectively discharges ink drips from the black nozzle NZK to the printing face PP of the printing sheet P continuously moved under the nozzle face NZP by the first conveying belt CV 1 in accordance with print information to print the black color.

Then, the cyan printing head HDC is controlled by the printing head control portion HDD in accordance with the cyan-color printing instruction supplied from the CPU in parallel with the control of the black printing head HDK, and the cyan color is printed.

The printing sheet P on which black and cyan colors are printed is sequentially supplied from the first conveying belt V1 to the second conveying belt V2 on the driving shaft DS and led to the position under the magenta printing head HDM by the second conveying portion CV2.

Before the printing sheet P reaches the position under the magenta printing head HDM, the second sheet detecting portion PK2 detects the printing sheet P and sends a second sheet detection signal showing that the printing sheet P is detected to the CPU.

The CPU sequentially sends printing instructions of magenta and yellow colors to the printing head control portion HDD in accordance with the second sheet detection signal supplied from the second sheet detecting portion PK2.

The printing head control portion HDD controls the magenta printing head HDM and yellow printing head HDY in parallel to print the magenta color and yellow color.

When the printing of the colors is completed, printing to one printing sheet P is completed and the printing sheet P is ejected to the outside of the ink jet printer 1 by the sheet ejecting portion EJ.

At this point, when printing of all print informations is completed, the printing operation is completed but when unprinted print information is left, a new printing sheet P is fed to the gate roller GR and the printing operation is continued until printing of all print information is competed.

Printing process for printing data in the printing sheet Pin the ink jet printer 1 of the first embodiment is described below. The printing process is divided into printing of black color by the black printing head HDK, printing of cyan color by the cyan printing head HDC, printing of magenta color by the magenta printing head HDM, and printing of yellow color by the yellow printing head HDY and the printing heads are individually controlled. Therefore, a flow is described below for each color printing process.

Figure 6:
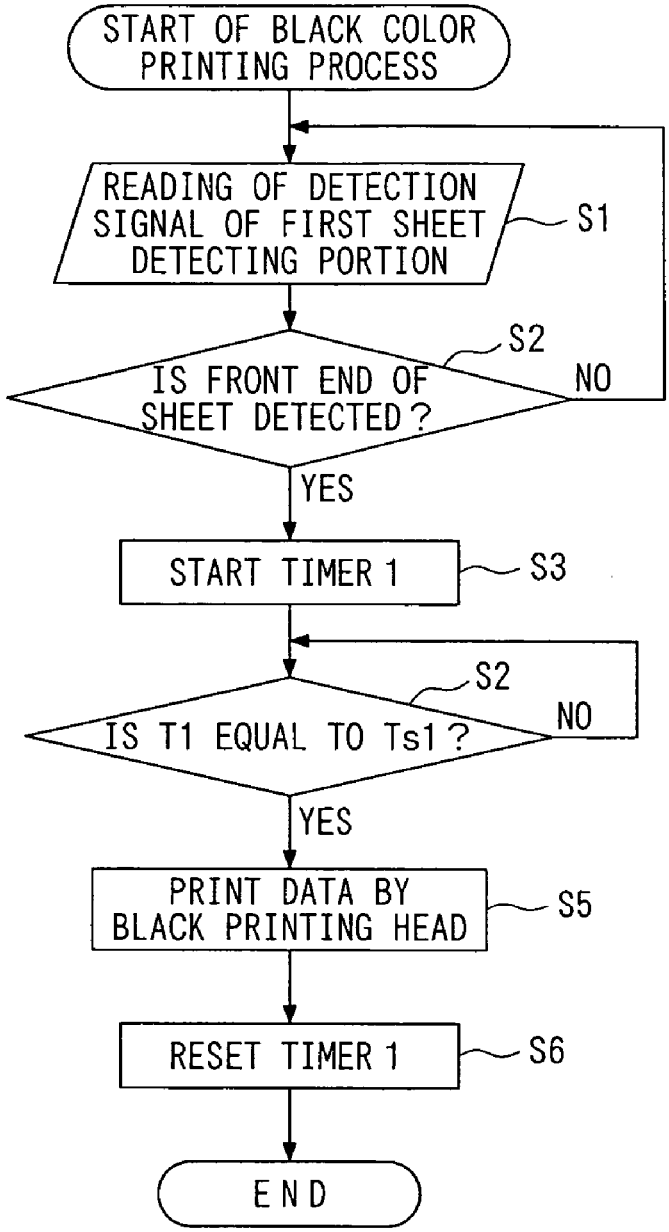
FIG. 6 is an illustration showing a flow of the printing process of the ink jet printer of the first embodiment.

When the ink jet printer 1 of the first embodiment receives a print information and a printing instruction supplied from an external unit and feeds the printing sheet P to the gate roller GR, it starts the printing of back color shown in FIG. 6.

First, in step S1, a sheet detection signal is read by the first sheet detecting portion PK1 to start step S2.

Then, in step S2, it is determined whether the first sheet detecting portion PK1 detects the front end of the printing sheet P in accordance with the sheet detection signal supplied from the first sheet detecting portion PK1. When it is determined that the front end is detected, step S3 is started but when it is determined that the front end is not detected, step S1 is started to read the sheet detection signal.

Then, in step S3, a timer for measuring a time T1 since detecting the front end of the printing sheet P is started to start step S4.

Then, in step S4, it is determined whether a time T1 measured by a timer coincides with the predetermined time Ts1. When it is determined that the time T1 coincides with the time Ts1, step S5 is started but when it is determined that the time T1 does not coincide with the time Ts1, step S4 is repeated until the time T1 coincides with the time Ts1.

Then, in step S5, printing is performed by the black printing head HDK to start step S6.

Then, in step S6, the timer is reset to complete the process.

In FIG. 6, cyan-color printing process is the same as black-color printing process except that a timer 2 is used as the timer 1 in steps S3 and S6, the black printing head HDK in step S5 is used as the cyan printing head HDC, and it is determined in step S4 whether the measured time T2 by the timer 2 coincides with a predetermined time Ts2. Therefore, descriptions of drawings and contents of processes are omitted.

Moreover, in FIG. 6, magenta-color and yellow-color printing processes are the same as black-color and cyan-color printing processes except that the first sheet detecting portion PK1 in step S1 is used as the second sheet detecting portion PK2 and the timer 1, measured time T1, and predetermined time Ts1 are used as timers 3 and 4, measured times T3 and T4, predetermined times Ts3 and Ts4. Therefore, detailed descriptions are omitted.

In FIG. 1, the printing sheet P corresponds to the printing medium.

According to the first embodiment, because the first and second conveying belts V1 and V2 are rotated at the same speed by the common driving shaft DS, the printing medium is conveyed at the same speed on the first conveying belt V1 and the second conveying belt V2.

Moreover, the first and second conveying belts V1 and V2 can be constituted so that each peripheral length is short compared to the case of constituting the same conveying distance from the first driven shaft FS1 to the second driven shaft FS2 by one conveying belt. That is, as a result of comparing the first and second conveying belts V1 and V2 with conveying belts having a peripheral length larger than that of the belts V1 and V2 by applying the same tension to them, the elongation of the first and second conveying belts V1 and V2 having a smaller peripheral length becomes small. Therefore, it is possible to decrease the elongation of a conveying belt produced due to the rotation of the driving shaft DS.

Furthermore, when the same tension is applied, as a result of comparing deflection values of conveying belts between shafts on which the conveying belts are applied, the first and second conveying belts V1 and V2 having a small distance between the shafts have a deflection value smaller than that of the conveying belts having a larger peripheral length. That is, it is possible to decrease the tension applied to the conveying belts to restrain the deflection value. Therefore, for the driving shaft DS and first and second driven shafts FS1 and FS2, the deflection of a shaft due to the force received from the first and second conveying belts V1 and V2 is decreased.

Moreover, because the number of first conveying belts V1 is equal to the number of second conveying belts V2, when applying a tension to the first and second conveying belts V1 and V2 by applying an equal force to the first and second driven shafts FS1 and FS2 in the opposite direction at both sides of the driving shaft DS, tensions of the first and second conveying belts V1 and V2 cancel the force applied to the driving shaft DS and it is possible to decrease the deflection of the driving shaft DS.

According to the above mentioned, it is possible to restrain the fluctuation of the conveying speed of a printing medium due to the telescopic motion of a conveying belt, vibration of a conveying belt between a driving shaft and a driven shaft, and deflections of the driving shaft and driven shaft due to the tension of the conveying belt, further improve a printing quality, and increase the conveying interval of the printing medium without deteriorating the printing quality.

Figure 7:
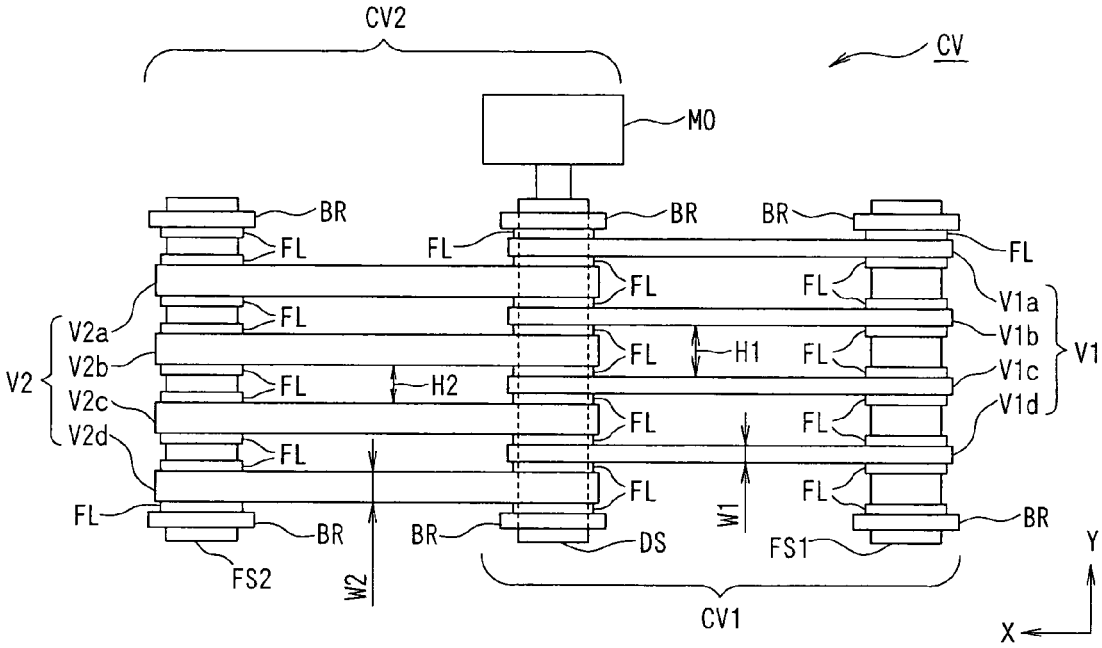
FIG. 7 is a top view sowing another sheet conveying portion of the first embodiment.

In the case of the first embodiment, the width W1 of the conveying belts V1*a* to V1*d* is made equal to the width W2 of the conveying belts V2*a* to v2*d* in the first and second conveying belts V1 and V2 and the relation between the conveying belt widths W1 and W2 and the belt interval H becomes H>W1, W2. However, it is also possible to make either of the widths W1 and W2 larger than the other of them. That is, as shown in FIG. 7, by constituting the sheet conveying portion CV so that W2 is larger than W1, it is possible to make the belt interval H2 in the second conveying portion CV2 smaller than the above described H.

Figure 8:
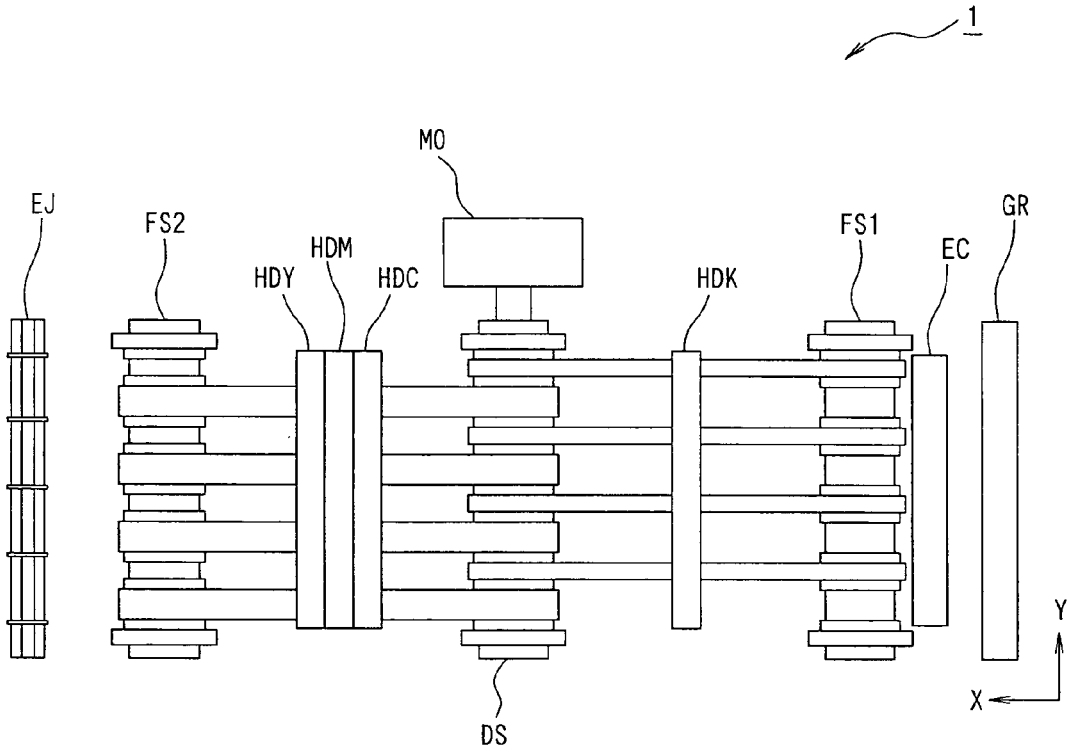
FIG. 8 is a top view showing still another ink jet printer of the first embodiment.
Figure 9:
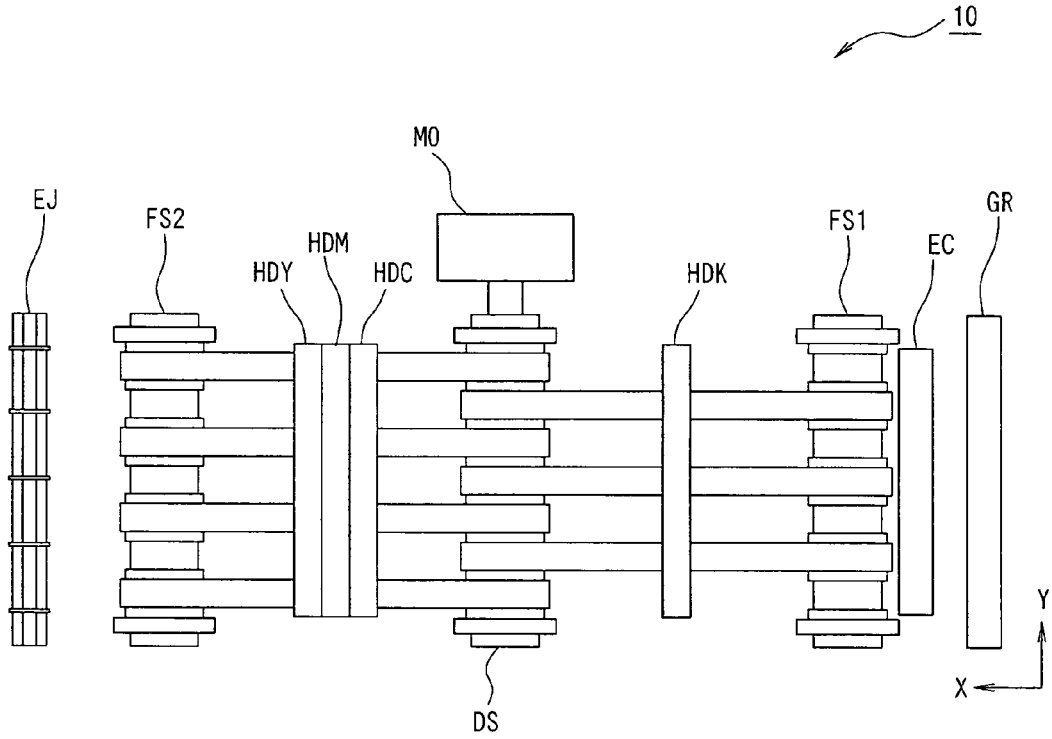
FIG. 9 is a top view showing still another ink jet printer of the first embodiment.

Moreover, as shown in FIG. 8, in the case of the ink jet printer 1 having the sheet conveying portion CV, yellow, magenta, and cyan printing heads HDY, HDM, and HDC among the color printing heads HDY, HDM, HDC, and HDK are arranged on the second conveying portion CV2. Furthermore, the black printing head HDK is set on the first conveying portion CV1.

According to the above configuration, in printing of colors for which a higher printing quality is required than printing of black color frequently used to print characters for preparation of a document, it is possible to improve the flatness of the printing sheet P under the color printing heads HDY, HDM, and HDC and further improve a printing quality.

In the case of the first embodiment, the printing sheet P is described as a printing medium. However, it is also possible to apply the first embodiment to a printing medium other than paper. For example, the first embodiment can be applied to resin or metal as a material, circle or different shape as a shape, and moreover objects having various properties such as objects having high and low flexibilities.

Moreover, the first and second conveying belts V1 and V2 are respectively constituted of four conveying belts V1*a* to V1*d* and V2*a* to V2*d*. However, it is also possible to respectively constitute V1 and V2 by one conveying belt. It is preferable that V1 and V2 are respectively constituted of a plurality of conveying belts in order to convey the printing face PP of the printing sheet P as flatly and stably as possible and in order to obtain a preferable printing result.

Furthermore, the first and second conveying belts V1 and V2 are directly applied to the driving shaft DS and the first and second driven shafts FS1 and FS2. However, it is also possible to use the first and second conveying belts V1 and V2 as timing belts, set a timing belt pulley on the driving shaft DS and the first and second driven shafts FS1 and FS2, and transfer motive power to the first and second conveying belts V1 and V2 through the timing belt pulleys.

Furthermore, in the case of this embodiment, the first and second conveying belts V1 and V2 are respectively constituted of four conveying belts V1*a* to V1*d* and V2*a* to V2*d*. However, as shown in FIG. 10, it is also possible to constitute the first conveying belt V1 by three conveying belts V1*a* to V1*c* and the second conveying belt V2 by four conveying belts V2*a* to V2*d*.

In this case, the first conveying belt V1 and the second conveying belt V2 are alternately arranged on the driving shaft DS centering around the conveying belt V1*b* which is present at the center of an odd number of conveying belts V1*a* to V1*c*.

Figure 10:
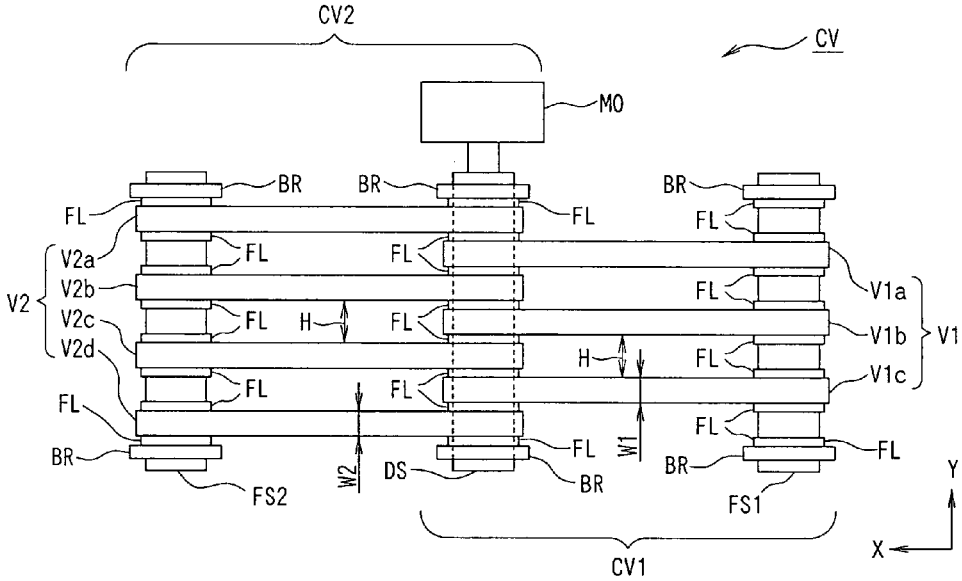
FIG. 10 is a top view showing still another sheet conveying portion of the first embodiment.

In the case of the ink jet printer 10 provided with the sheet conveying portion CV having the configuration shown in FIG. 10, the color printing heads HDY, HDM, and HDC are set on the second conveying portion CV2 having four conveying belts V2*a* to V2*d* and the black printing head HDK is set on the first conveying portion CV1 because it is possible to improve the flatness of the printing sheet P in color printing.

According to the above mentioned, when applying a tension to the first and second conveying belts V1 and V2 by providing equal forces to the first and second driven shafts FS1 and FS2 in mutually opposite directions at both sides of the driving shaft DS, the tensions of the first and second conveying belts V1 and V2 cancel the force applied to the driving shaft DS and it is possible to restrain the force couple and further restrain the deflection of the driving shaft DS because the direction for connecting the working point of the resultant force of the tension of the first conveying belt V1 with the working point of the resultant force of the second conveying belt V2 coincides with the direction of the resultant force on the driving shaft DS.

The number of conveying belts is not restricted to three for first conveying belts V1 and four for second conveying belts V2. It is possible to set the number of conveying belts so that either of the number of first conveying belt V1 and the number of conveying belt V2 becomes more than the other by one.

The second embodiment of the present invention is described below by referring to the accompanying drawings.

Figure 11:
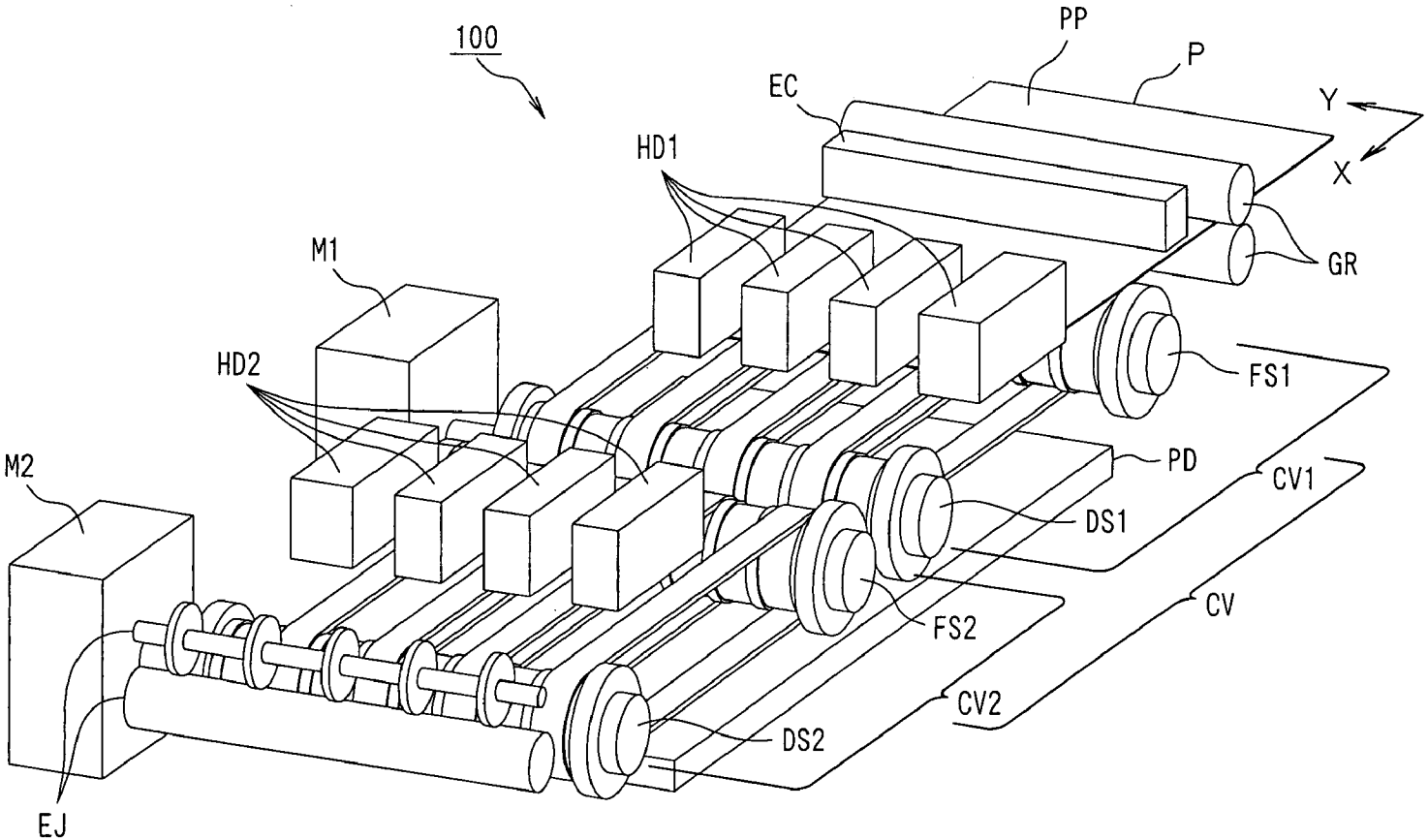
FIG. 11 is an outline view showing a main configuration of an ink jet printer of a second embodiment.

As shown in FIG. 11, the ink jet printer 100 of the second embodiment has the same configuration as the first embodiment except that a sheet conveying portion CV is constituted by including a first conveying portion CV1, and a second conveying portion CV2 to be driven independently from the first conveying portion CV1, a printing head is constituted of a first printing head group HD1 set on the first conveying portion CV1 and a second printing head group HD2 set on the second conveying portion CV2, and an ink absorbing portion PD is set under the sheet conveying portion CV.

Therefore, a portion corresponding to that of the first embodiment is provided with the same symbol and its description is omitted.

Figure 12:
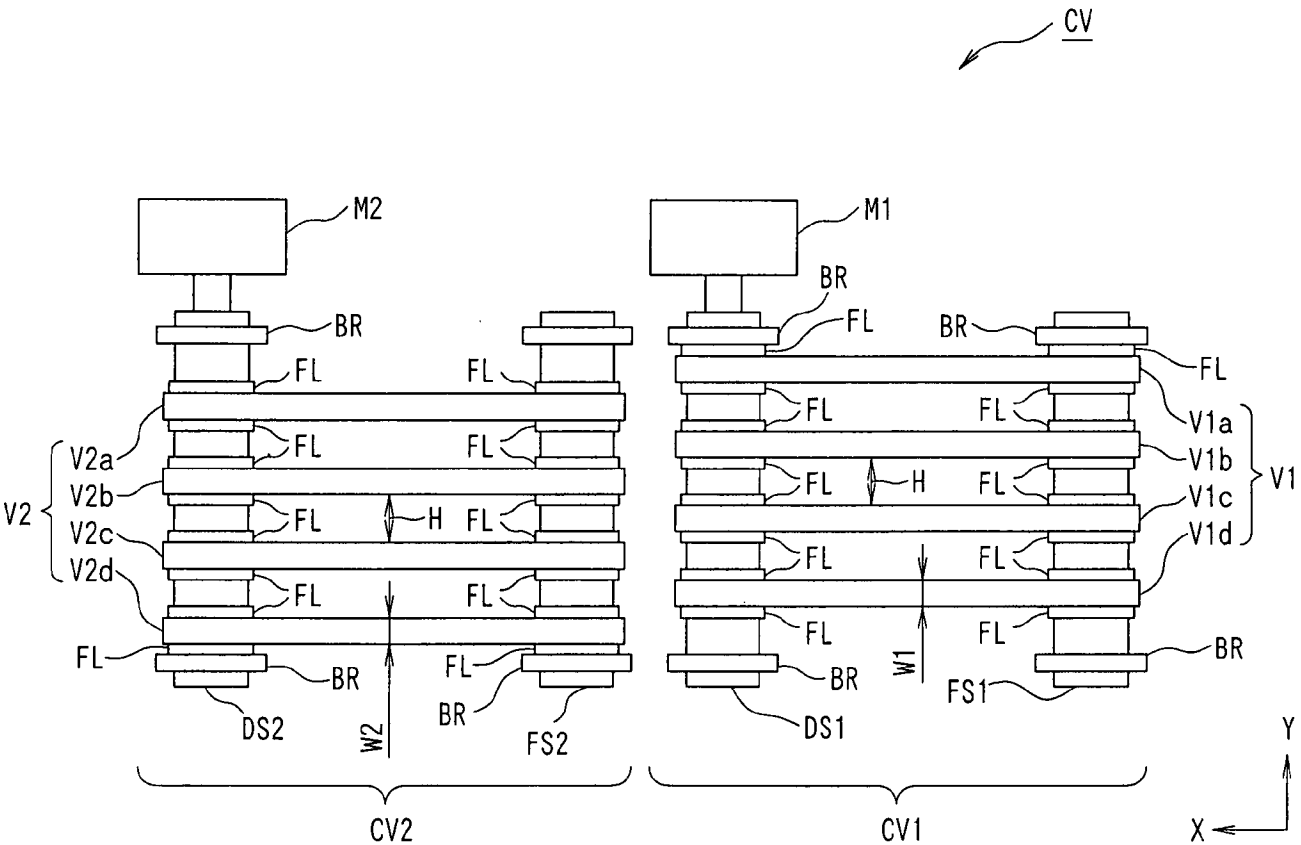
FIG. 12 is a top view of a sheet conveying portion of the second embodiment.

As shown in FIG. 12 which is a top view, for the sheet conveying portion CV, the second conveying portion CV2 has a second driving shaft DS2 and a second conveying portion driving motor M2 and is constituted independently from the first conveying portion CV1. In the case of this embodiment, the driving shaft and conveying portion driving motor of the first conveying portion CV1 are referred to as a first driving shaft DS1 and a first conveying portion driving motor M1 so as to differentiate from the driving shaft and conveying portion driving motor in the second conveying portion CV2.

Moreover, though not illustrated, a force is applied to the upstream direction of first and second driven shafts FS1 and FS2 in order to apply a tension so that the first and second conveying belts V1 and V2 applied between the first and second driving shafts DS1 and DS2 are not loosened.

The first and second conveying belts V1 and V2 are respectively constituted of four conveying belts V1*a* to V1*d* and V2*a* to V2*d*. Moreover, the conveying belts V1*a* to V1*d* and V2*a* to V2*d* are alternately arranged in Y direction orthogonal to X direction so that they are not overlapped in X direction which is the conveying direction of a printing sheet P. Furthermore, in the case of the first and second conveying portions CV1 and CV2, a conveying face which is a face opposite side to the printing face PP of the printing sheet P becomes the same plane on the first conveying belt V1 and the second conveying belt V2.

For the sheet conveying portion CV having the above configuration, when the first conveying portion driving motor M1 is started, the motive power is transferred to the first driving shaft DS1 from the rotating shaft of the first conveying portion driving motor M1 and the first driving shaft DS1 is rotated. When the first driving shaft DS1 is rotated, motive power is transferred to the first conveying belt V1 and the printing sheet P is mounted on the peripheral face of the first conveying belt V1 and conveyed from the first driven shaft FS1 up to the first driving shaft DS1.

The printing sheet P conveyed up to the first driving shaft DS1 is sent onto the outer periphery of the second conveying belt V2 rotated by the motive power of the second conveying portion driving motor M2 driven synchronously with the first conveying portion driving motor M1 and conveyed from the second driven shaft FS2 up to the driving shaft DS2.

Figure 13:
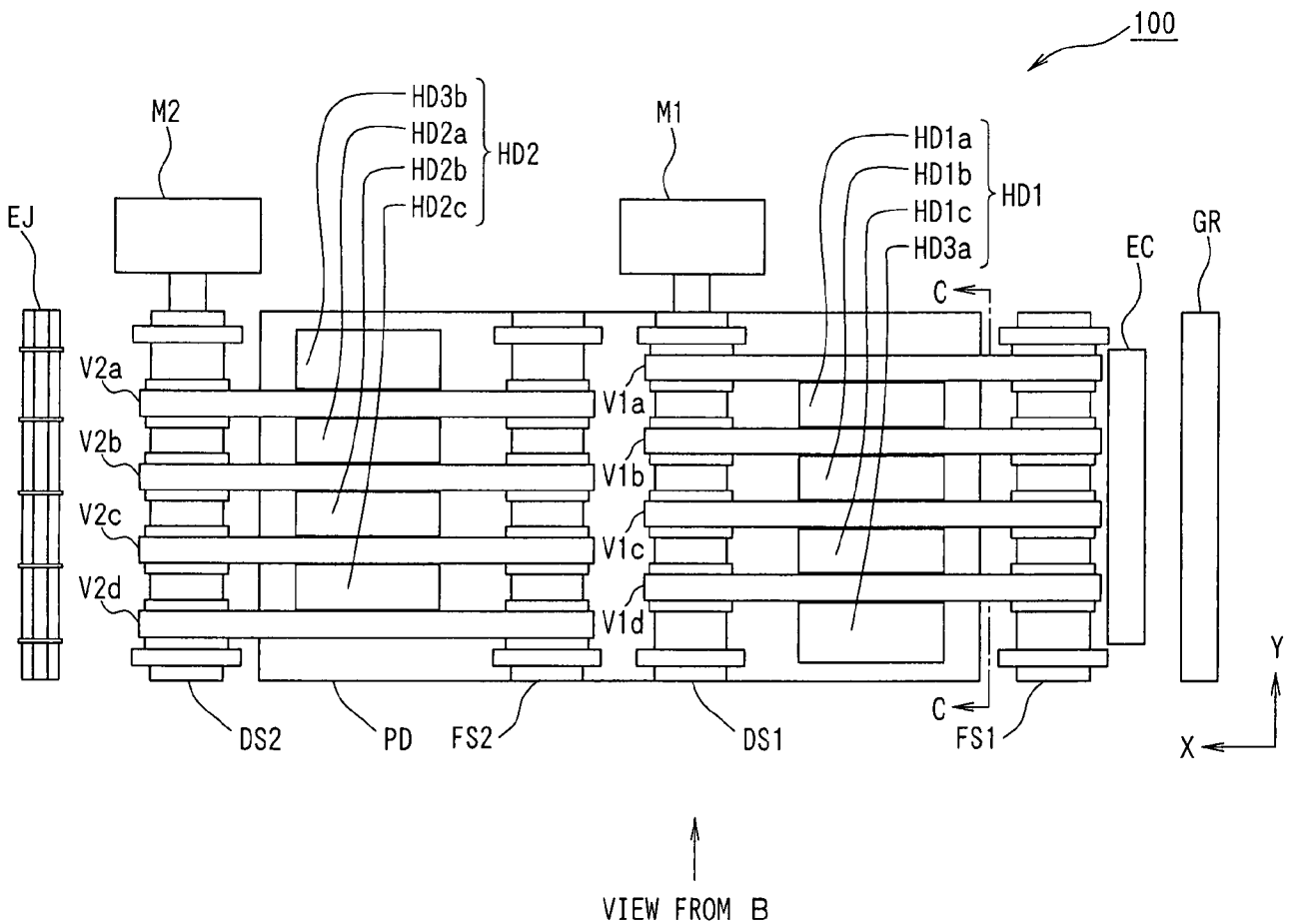
FIG. 13 is a top view showing a main configuration of the ink jet printer of the second embodiment.

As shown in FIG. 13 which is a top view of the ink jet printer 100, first and second printing heads HD1 and HD2 are respectively constituted of printing heads HD1*a* to HD1*c* and HD3*a* and HD2*a* to HD2*c*, and HD3*b* provided on the first and second conveying section CV1 and CV2, respectively. Moreover, the printing heads HD1*a* to HD1*c* in the first printing head group HD1 are arranged at a position facing the gap between the conveying belts V1*a* to V1*d* between the first driven shaft FS1 and the first driving shaft DS1. The printing head HD3*a* is set adjacently to the printing head HD1*c* at both sides of the conveying belt V1*d*. Moreover, the printing heads HD2*a* to HD2*c* in the second printing head group HD2 are arranged to a position facing the gap between the conveying belts V2*a* to V2*d* between the second driven shaft FS2 and the second driving shaft DS2. The printing head HD3*b* is set adjacently to the printing head HD2*a* at both sides of the conveying belt V2*a*.

At this point, arrangement of nozzles set to the printing heads HD1*a* to HD1*c*, HD2*a* to HD2*c*, and HD3*a* and HD3*b* is described.

Figure 14A:
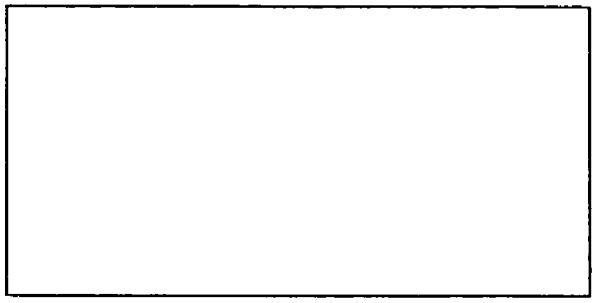
FIGS. 14A and 14B are illustrations showing the appearance of a printing head of the second embodiment.
Figure 14B:
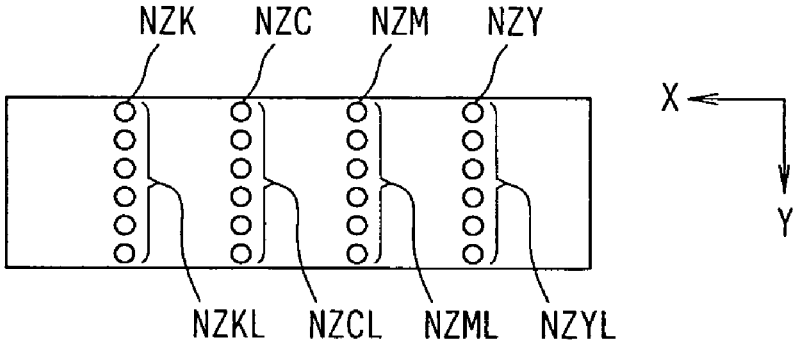

FIGS. 14A and 14B are illustrations showing the appearance of the printing head HD1*a*, in which FIG. 14A is a front view viewed from B in FIG. 13 and FIG. 14B is a bottom view. In FIGS. 14A and 14B, nozzles are shown by exaggerating the size of each nozzle and decreasing the number of nozzles so that the nozzles are easily understood.

As shown in FIG. 14B, the printing heads HD1*a* to HD1*c*, HD2*a* to HD2*c*, and HD3*a* and HD3*b* are provided with a yellow nozzle NZY for discharging yellow color ink, magenta nozzle NZM for discharging magenta color ink, a cyan nozzle NZC for discharging cyan color ink, and black nozzle NZK for discharging black color ink.

The color nozzles NZY, NZM, NZC, and NZK are arranged in X direction which is the conveying direction of the printing sheet P and arranged in Y direction orthogonal to the conveying direction to constitute a yellow nozzle string NZYL, magenta nozzle string NZML, cyan nozzle string NZCL, and black nozzle string NZKL.

That is, by moving the first printing head group HD1 shown in FIG. 13 in X direction in parallel and by arranging the first and second printing head groups HD1 and HD2, yellow nozzle NZY, magenta nozzle NZM, cyan nozzle NZC, and black nozzle NZK of the printing heads HD1*a* to HD1*c*, HD3*a*, and printing heads HD2*a* to HD2*c*, and HD3*b* are arranged over the widths of the first printing head group HD1 and second printing head group HD2 in Y direction to constitute one nozzle string for each color.

For the first and second printing head groups HD1 and HD2, it is possible to use a printing head for discharging ink drips by applying a pressure to ink by a piezoelectric element or heating element.

Figure 16:
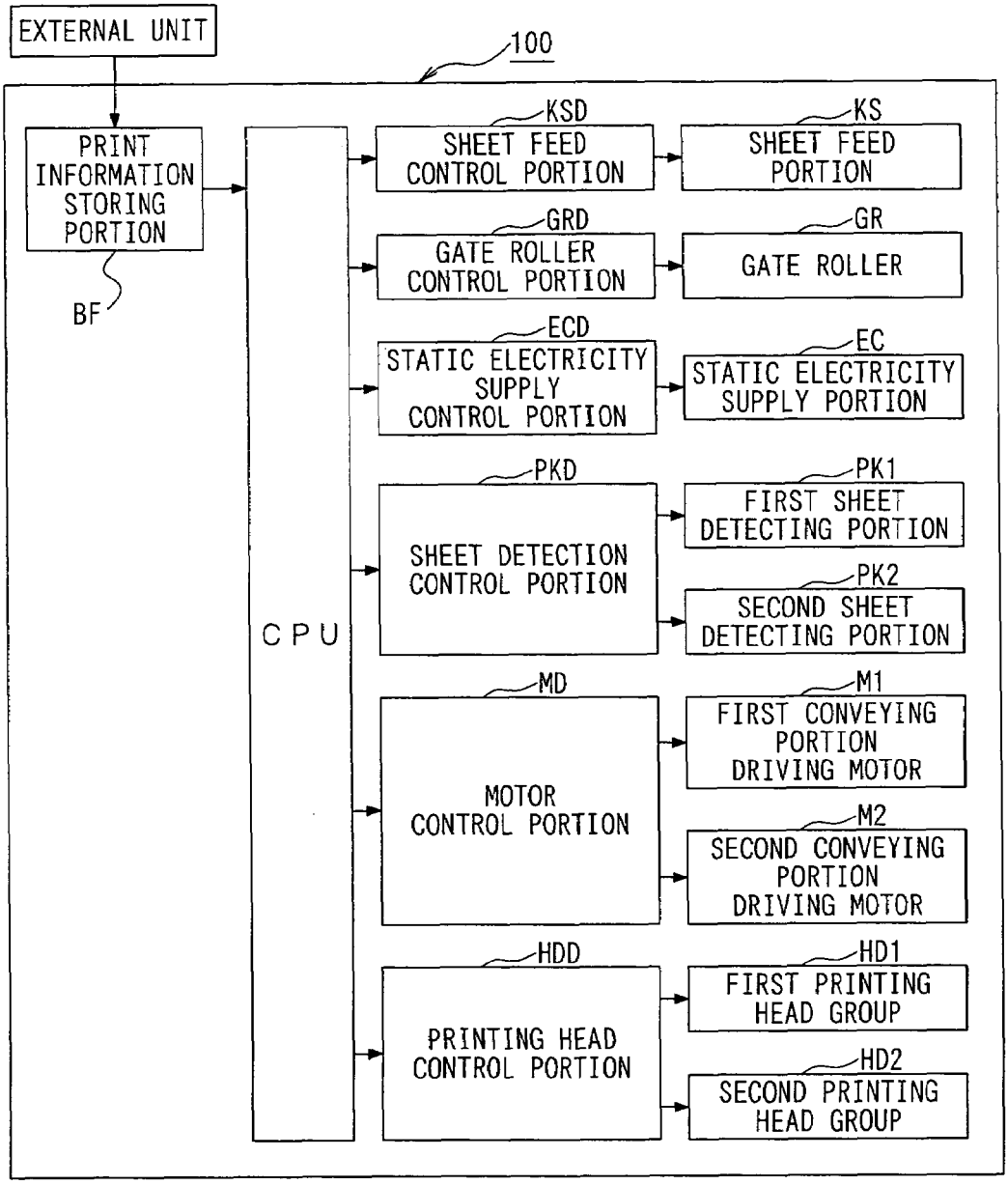
FIG. 16 is a block diagram showing the relation of control of a main portion of the ink jet printer of the second embodiment.

Moreover, the driving of each of the first and second printing head groups HD1 and HD2 is controlled by the printing head control portion HDD as shown in FIG. 16.

Figure 15A:
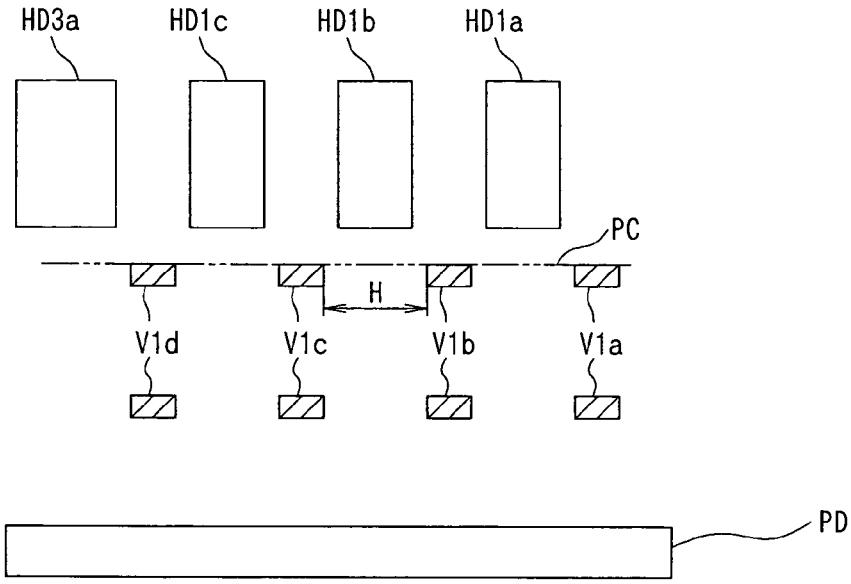
FIGS. 15A and 15B are illustrations schematically showing the C-C cross section in FIG. 13.

As shown in FIG. 15A schematically showing the C-C cross section in FIG. 13, the ink absorbing portion PD is set by facing the printing heads HD1*a* to HD1*c*, HD2*a* to HD2*c*, HD3*a*, and HD3*b* sandwiching of the conveying route PC of the printing sheet P under the conveying belts V1*a* to V1*d* and V2*a* to V2*d*. The ink absorbing portion PD is constituted of a material having a high capacity for absorbing liquid such as felt or sponge and absorbs the ink discharged from the printing heads HD1*a* to HD1*c*, HD2*a* to HD2*c*, HD3*a*, and HD3*b* to the portion out of the area of the printing face PP of the printing sheet P at the time of non-marginal printing to be described later. In. FIG. 15, the downstream side of the first driving shaft DS1 is omitted in order to make the configuration easily understood.

Figure 15B:
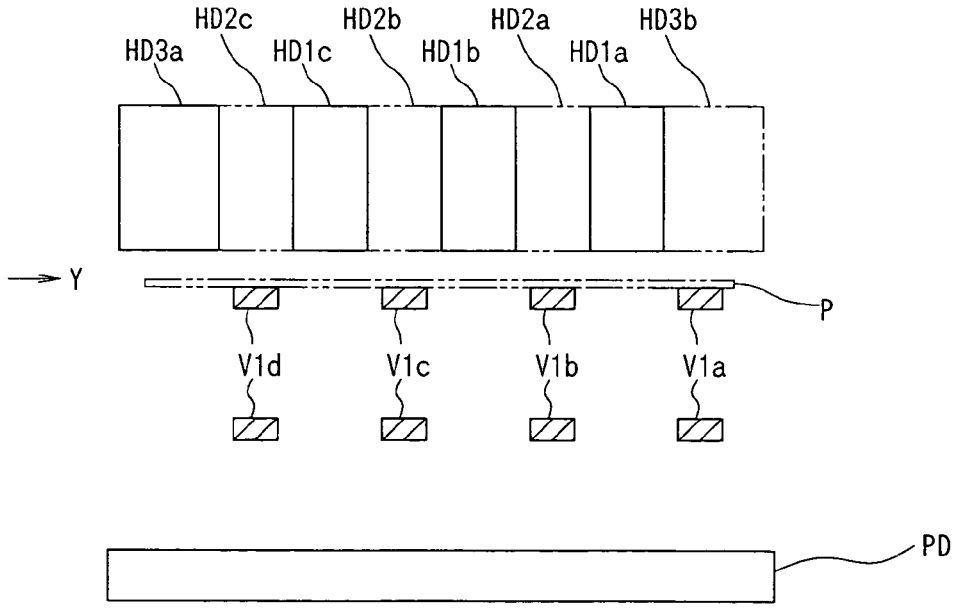

In this case, as shown in FIG. 15B, the printing heads HD3*a* and HD3*b* respectively have a width larger than each of the printing heads HD1*a* to HD1*c* and HD2*a* to HD2*c* facing the gap between conveying belts. Moreover, as shown in FIG. 15B, the printing heads HD1*a* to HD1*c*, HD2*a* to HD2*c*, HD3*a*, and HD3*b* are arranged over a distance larger than the width of the printing sheet P in Y direction by crossing the printing sheet P. That is, the total printing area formed of the printing heads HD1*a* to HD1*c* and HD2*a* to HD2*c* in Y direction is set to a value smaller than the width of the printing sheet P in Y direction and extended by the printing heads HD3*a* and HD3*b*. Moreover, the total printing area extended by the printing heads HD3*a* and HD3*b* is set to a distance larger than the width of the printing sheet P in Y direction so as to cross the printing sheet P.

Furthermore, as shown in FIG. 15A, the belt interval H is set to a value larger than the width of each of the printing heads HD1*a* to HD1*c* and HD2*a* to HD2*c* facing the gap between conveying belts. Therefore, even if ink drips are discharged from the printing heads HD1*a* to HD1*c* and HD2*a* to HD2*c* facing the gap between the conveying belts when the printing sheet P is not present on the conveying route PC, the ink drips securely reach the ink absorbing portion PD without attaching to the conveying belts V1*a* to V1*d* and V2*a* to V2*d*.

When the ink jet printer 100 having the above configuration receives print information and a printing instruction supplied from an external unit, it starts the printing operation and the first conveying portion CV1 leads the printing sheet P to the portion under the first printing head group HD1 as in the case of the first embodiment.

In this case, the CPU measures the timing for start of printing in accordance with a first sheet detection signal output from the first sheet detecting portion PK1, makes the printing head control portion HDD control the first printing head group HD1, makes the color nozzles NZY, NZM, NZC, and NZK discharge ink drips, and executes first printing according to print information.

Moreover, the printing sheet P to which first printing is applied is led to the portion under the second printing head group HD2 by the second conveying portion CV2 and second printing is executed by the second recoding head group HD2 at the timing according to a second sheet detection signal supplied from the second sheet detecting portion PK1 similarly to the case of the first printing.

In the case of this ink jet printer 100, the process of non-marginal printing for performing printing over the whole area of the printing face PP without leaving a margin which is an unprinted portion on the printing sheet P is described below. The non-marginal printing process is performed by individually controlling the first and second printing head groups HD1 and HD2. Therefore, the flow of the non-marginal printing is described by separating the process by the first printing head group HD1 from the process by the second printing head group HD2.

Figure 17:
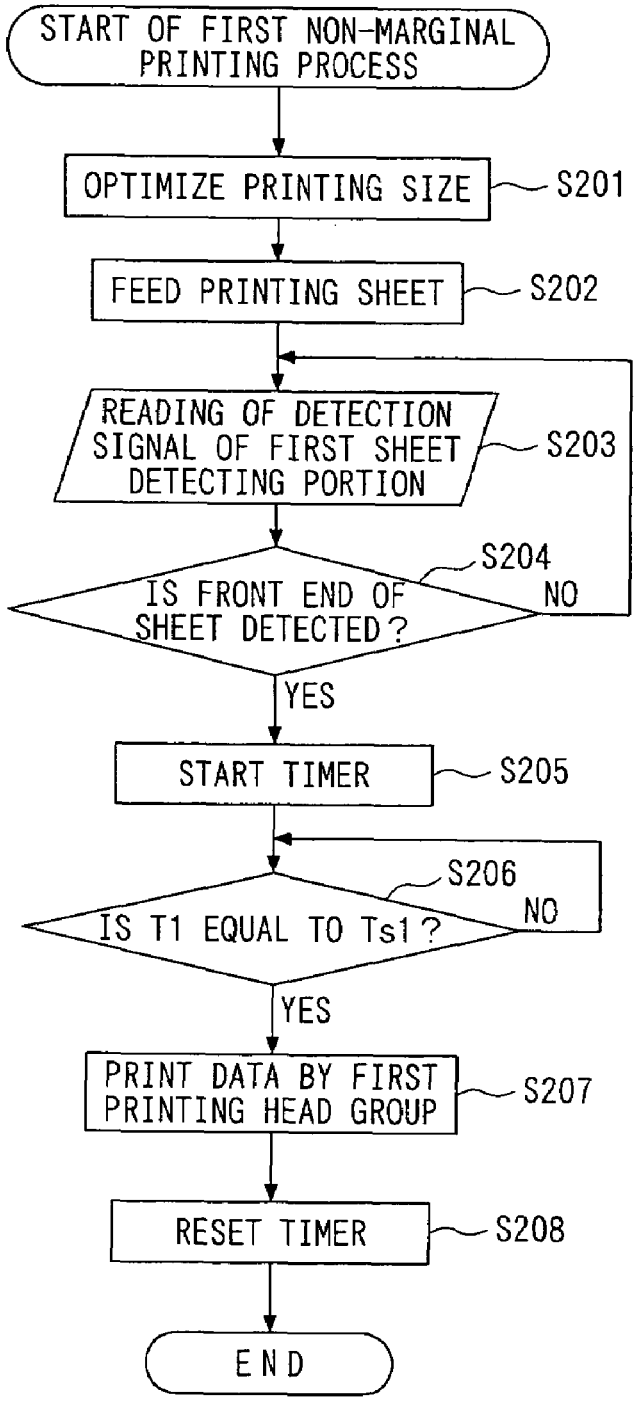
FIG. 17 is an illustration showing a flow of first non-marginal printing process of the second embodiment.

When the ink jet printer 100 of the second embodiment receives a non-marginal printing instruction supplied from an external unit, the CPU starts first non-marginal printing process by the first printing head group HD1 shown in FIG. 17.

For this first non-marginal printing process, first in step S201, the size of an image formed by discharging ink drips from the nozzles NZY, NZM, NZC, and NZK in accordance with print information and non-marginal printing instruction supplied from an external unit optimizes a print size so that a specified size becomes larger than the size of the printing face PP of the printing sheet P to start step S202. At this point, the size of the image is made larger than the size of the printing face PP of the printing sheet P so that the size of the image is printed on the whole area of the printing face PP including the tilt of the image even if the printing sheet P is conveyed by slightly tilting in X direction.

Then, in step S202, the printing sheet P having the specified size is fed to the gate roller GR so that the central portion of the Y-directional width of the printing sheet P is located at almost the central portion of the Y-directional width of the image optimized in step S201 to start step S203.

Then, in step S203, a sheet detection signal is read by the first sheet detecting portion PK1 to start step S204.

Then, in step S204, it is determined whether the first sheet detecting portion PK1 detects the front end of the printing sheet P in accordance with the sheet detection signal supplied from the first sheet detecting portion PK1. When it is determined that PK1 detects the front end, step S205 is started. When it is determined that PK1 does not detect the front end, step S203 is started to read the sheet detection signal.

Then, in step S205, a timer for measuring the time T1 since detecting the front end of the printing sheet P is started to start step S206.

Then, in step S206, it is determined whether the time T1 measured by the timer coincides with the predetermined time Ts1. When it is determined that the time T1 coincides with the time Ts1, step S207 is started. When it is determined that the time T1 does not coincide with the time Ts1, step S206 is repeated until the time T1 coincides with the time Ts1.

Then, in step S207, the printing head control portion HDD controls the first printing head group HD1 in accordance with the print size optimized in step S201 and performs first printing by selectively discharging ink drips from the nozzles NZY, NZM, NZC, and NZK to start step S208.

Then, in step S208, the timer is reset to complete the process.

Figure 18:
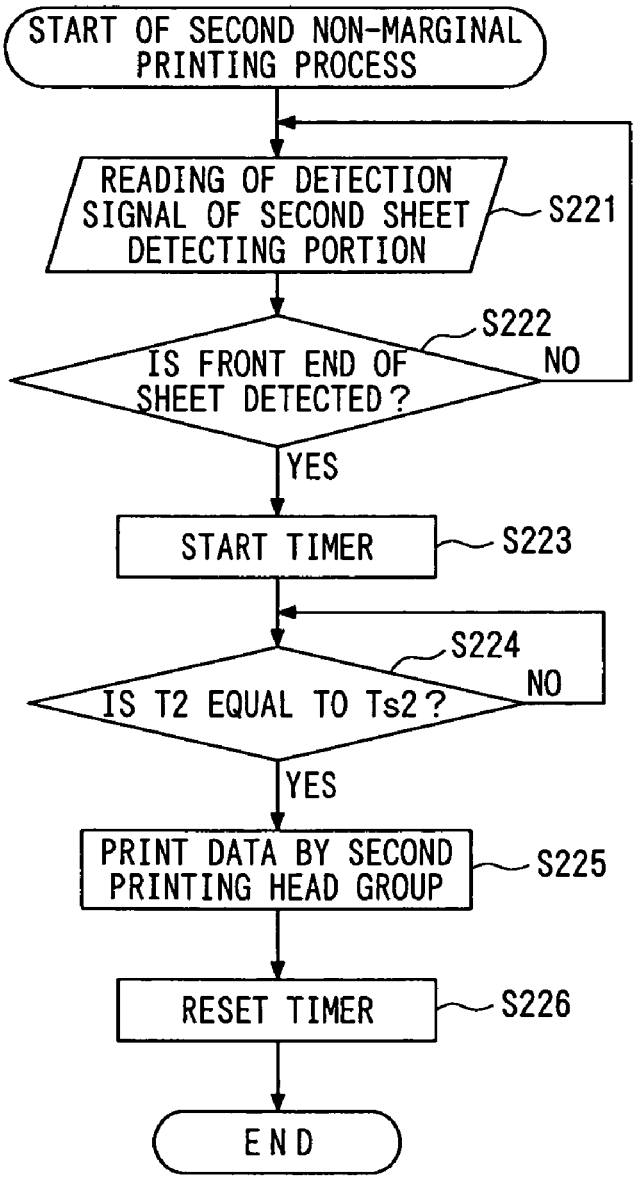
FIG. 18 is an illustration showing second non-marginal printing process of the second embodiment.

As shown in FIG. 18, the second non-marginal printing process by the second printing head group HD2 has a configuration in which steps S201 and S202 are omitted in the first non-marginal printing process by the first printing head group HD1 and description of the content of each process is omitted because the content is the same as the content of the first non-marginal printing process.

When the first and second non-marginal processes are completed, non-marginal printing having no margin which is an unprinted portion of the printing sheet P to the printing face PP is completed.

In the case of this embodiment, the printing sheet P corresponds to a printing medium, the processes by the first printing head group HD1 and in step S207 in FIG. 17 correspond to the first head group, the second printing head group HD2 and the process in step S225 in FIG. 18 correspond to the second head group, the printing heads HD1*a* to HD1*c* correspond to the first head, the printing heads HD2*a* to HD2*c* correspond to the second head, the printing heads HD3*a* and HD3*b* correspond to the third head, and the conveying belts V1*d* and V2*a* correspond to the outermost conveying belt.

According to the above mentioned, when the first and second printing head groups HD1 and HD2 discharge ink drips to the printing sheet P over a distance larger than the width of the printing sheet P, it is possible to perform non-marginal printing over the whole area of the printing face PP without leaving a margin which is an unprinted portion. Moreover, when performing the non-marginal printing, it is possible to securely avoid ink drips discharged to the outside of the printing face PP from attaching onto the conveying belts V1*a* to V1*d* and V2*a* to V2*d*.

Moreover, by constituting the sheet conveying portion CV by the short first and second conveying portions CV1 and CV2, it is possible to prevent a belt from loosening while conveying and to accurately convey a printing medium along a flat face.

In the case of the ink jet printer 100 of the second embodiment, inter-sheet clogging prevention discharge process is described below which prevents clogging by discharging ink drips from the first and second printing heads HD1 and HD2 independently of printing between these different printing sheets P when continuously printing data in different printing sheets P. The inter-sheet clogging prevention discharge process is performed by individually controlling the first and second printing head groups HD1 and HD2 and the flow of each control is the same. Therefore, only the flow of the process by the first printing head group HD1 is described below in detail.

Figure 19:
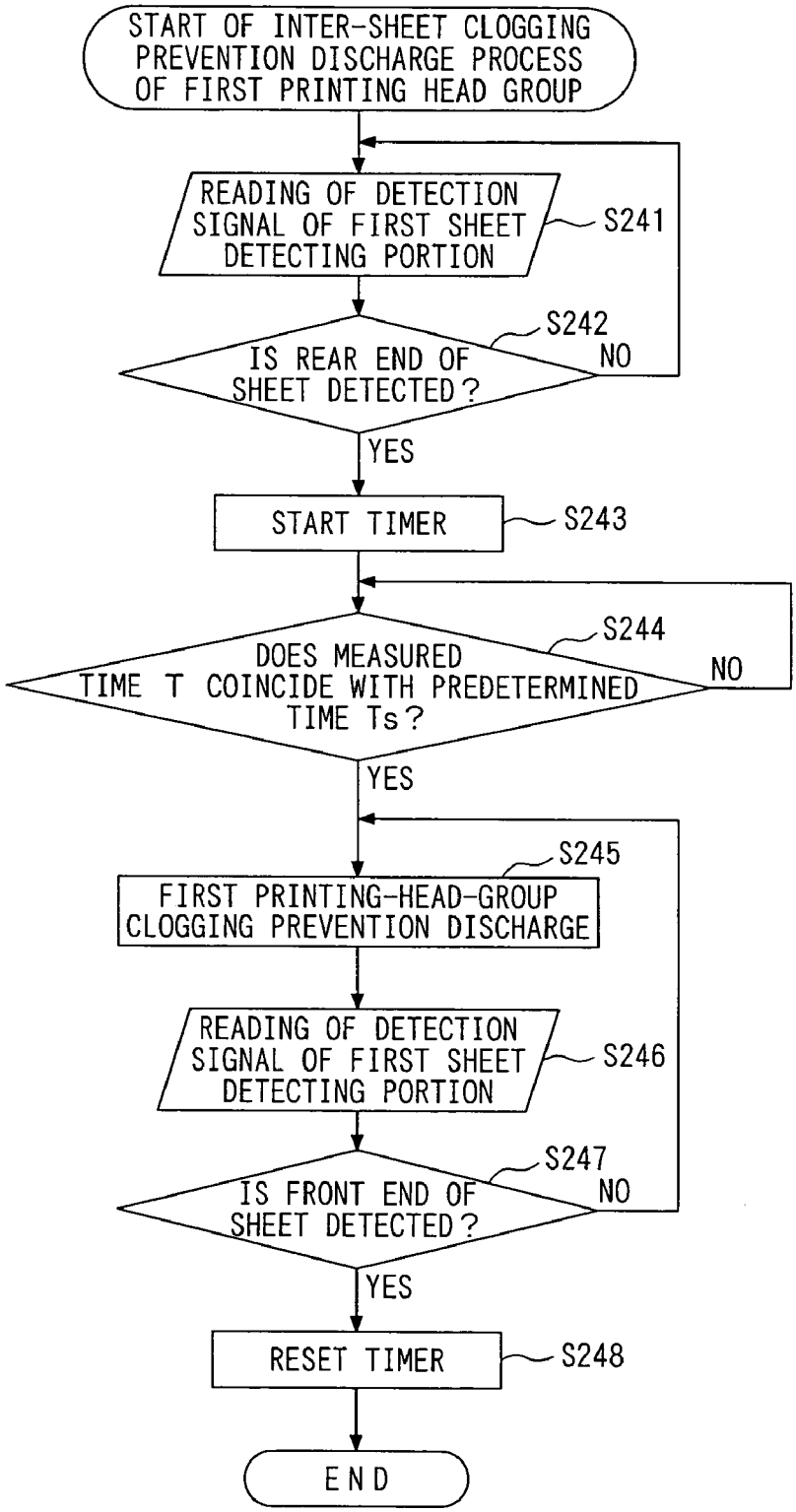
FIG. 19 is an illustration showing a flow of inter-sheet clogging prevention discharge process of the second embodiment.

The ink jet printer 100 of the second embodiment starts the inter-sheet clogging prevention discharge process shown in FIG. 19 when the first printing head group HD1 starts printing.

For this inter-sheet clogging prevention discharge process, first in step S241, a sheet detection signal is read by the first sheet detecting portion PK1 to start step S242.

Then, in step S242, it is determined whether the first sheet detecting portion PK1 detects the rear end of the printing sheet P in accordance with the sheet detection signal supplied from the first sheet detecting portion PK1. When it is determined that the rear end is detected, step S243 is started. When it is determined that the rear end is not detected, step S241 is started to read the sheet detection signal.

Then, in step S243, a timer for measuring the time since detecting the rear end of the printing sheet P is started to start step S244.

Then, in step S244, it is determined whether the time measured by the timer coincides with a predetermined time Ts. When it is determined that the measured time coincides with the time Ts, step S245 is started. When it is determined that the measured time does not coincides with the time Ts, step S244 is repeated until the measured time coincides with the time Ts.

Then, in step S245, ink drips are discharged from the first printing head group HD1 independently of printing to prevent clogging and start step S246.

Then, in step S246, a sheet detection signal is read by the first sheet detecting portion PK1 to start step S247.

Then, in step S247, it is determined whether the first sheet detecting portion PK1 detects the front end of a new printing sheet P in accordance with a sheet detection signal supplied from the first sheet detecting portion PK1. When it is determined that the front end is detected, step S248 is started. When it is determined that the front end is not detected, step S245 is started.

Then, in step S248, the timer is reset to complete the process.

In FIG. 19, the process in step S245 corresponds to the first head.

Moreover, in FIGS. 12 and 15, the belt interval H corresponds to the distance between belts.

According to the above mentioned, when a printing medium is not present on a conveying belt, it is possible to securely avoid discharged ink drips from attaching to the conveying belt even if a printing head performs clogging prevention discharge for discharging ink drips independently of printing. Moreover, it is not necessary to change positions of the printing head when the printing head performs printing and clogging prevention discharge and it is possible to complete the clogging prevention discharge in a short time.

Furthermore, when performing printing and discharge performance recovery process, it is completely unnecessary to move a printing head. Therefore, a mechanical part or complex control which is necessary for moving a printing head is unnecessary and it is possible to solve the problem of reliability.

In the case of the second embodiment, the printing sheet P is described as a printing medium. However, the second embodiment can be also applied to a printing medium other than paper. For example, the second embodiment can be applied to a resin or metal as a material, circle or different shape as a shape, and objects having various properties such as objects having high and low flexibilities.

Moreover, in the case of the second embodiment, the first and second conveying belts V1 and V2 are respectively constituted of four conveying belts V1*a* to V1*d* and V2*a* to V2*d*. However, it is also possible that they are at least respectively constituted of one conveying belt. It is preferable that they are respectively constituted of a plurality of conveying belts in order to convey the printing face PP of the printing sheet P as flatly and stably as possible and to obtain a preferable printing result.

Furthermore, the first and second conveying belts V1 and V2 are constituted so as to directly apply them to the first and second driving shafts DS1 and DS2 and first and second driven shafts FS1 and FS2. It is possible to constitute the first and second conveying belts V1 and V2 so as to use the conveying belts V1 and V2 as timing belts, set a timing belt pulley to the first and second driving shafts DS1 and DS2 and first and second driven shafts FS1 and FS2 respectively, and transfer motive power to the first and second conveying belts V1 and V2 through the timing belt pulleys.

Moreover, it is possible to set the ink absorbing portion PD to the inside of the ring of the conveying belts V1*a* to V1*d* and V2*a* to V2*d* as long as the position is below the conveying route PC and it does not interrupt conveying of the printing sheet P. In this case, it is possible to bring the ink absorbing portion PD closer to the nozzle face NZP of the first and second printing heads HD1 and HD2. Therefore, for example, even if foreign matter such as paper powder attaches to the nozzle face NZP and the flying route of ink drips is bent, it is possible to securely catch ink drips before the ink drips reach the inner periphery of the conveying belts V1*a* to V1*d* and V2*a* to V2*d*.

Moreover, in the case of the second embodiment, the sheet conveying portion CV is constituted of the first and second conveying portions CV1 and CV2 so as to independently drive them by the first and second conveying portion driving motors M1 and M2. However, it is also possible to drive either of the first and second driving shafts DS1 and DS2 by a motor and transfer the torque to the other through a motive power transfer mechanism constituted of a chain, sprocket, timing belt, timing belt pulley, and the like.

Figure 20:
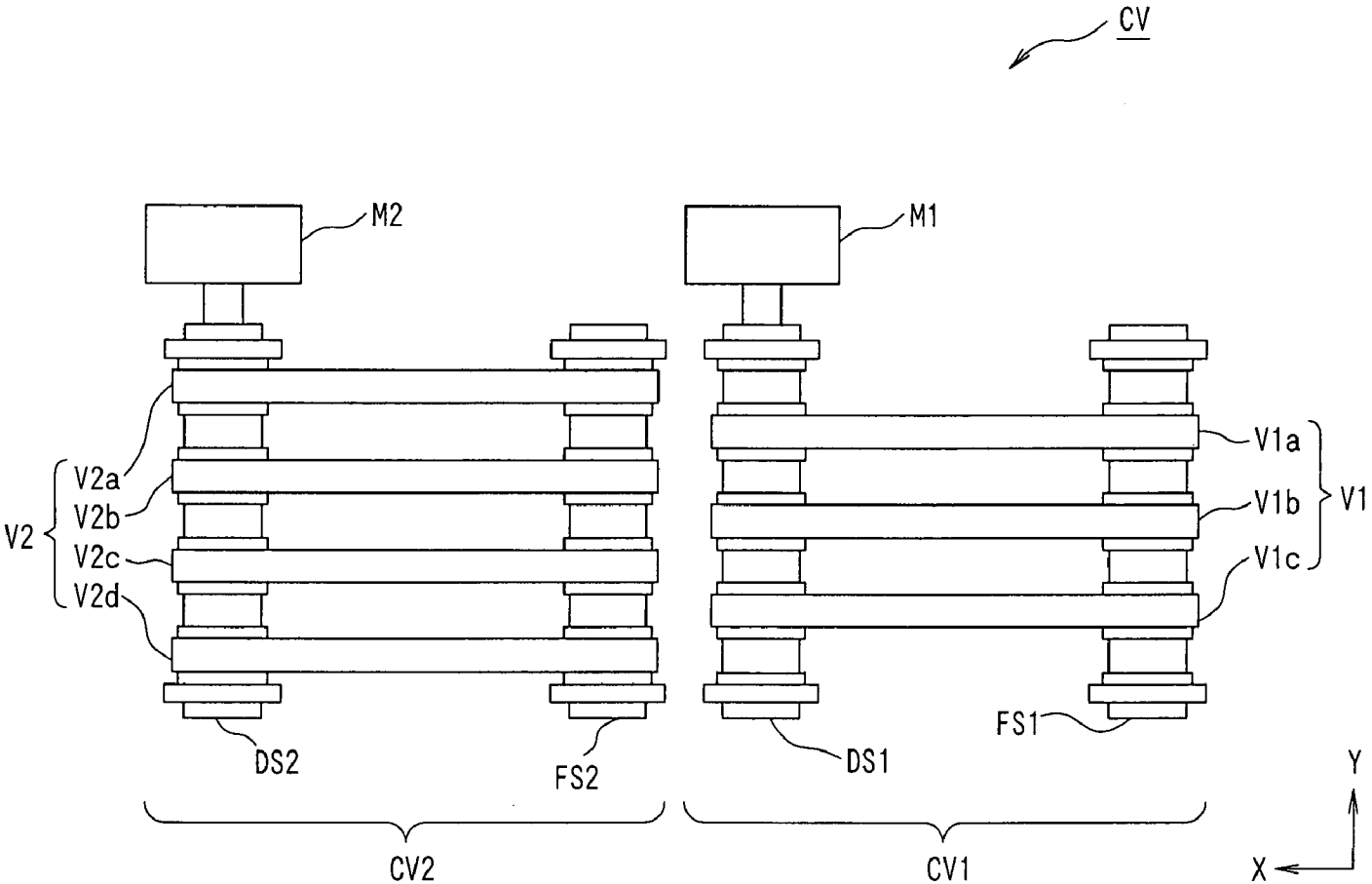
FIG. 20 is a top view showing another sheet conveying portion of the second embodiment.

Furthermore, in the case of the second embodiment, the number of the first conveying belts V1 is equal to the number of the second conveying belts V2. However, it is possible to set the number of conveying belts on one side to a value one less than the number of conveying belts on the other side. That is, as shown in FIG. 20, it is possible to constitute the second conveying portion CV2 by four conveying belts and the first conveying portion CV1 by three conveying belts which is one less than the number of conveying belts of the second conveying portion CV2. In this case, the first conveying belt V1 and the second conveying belt V2 are alternately set in Y direction centering around the central conveying belt of the first conveying belts V1 which is an odd number so that they are not overlapped with each other in X direction.

Figure 21:
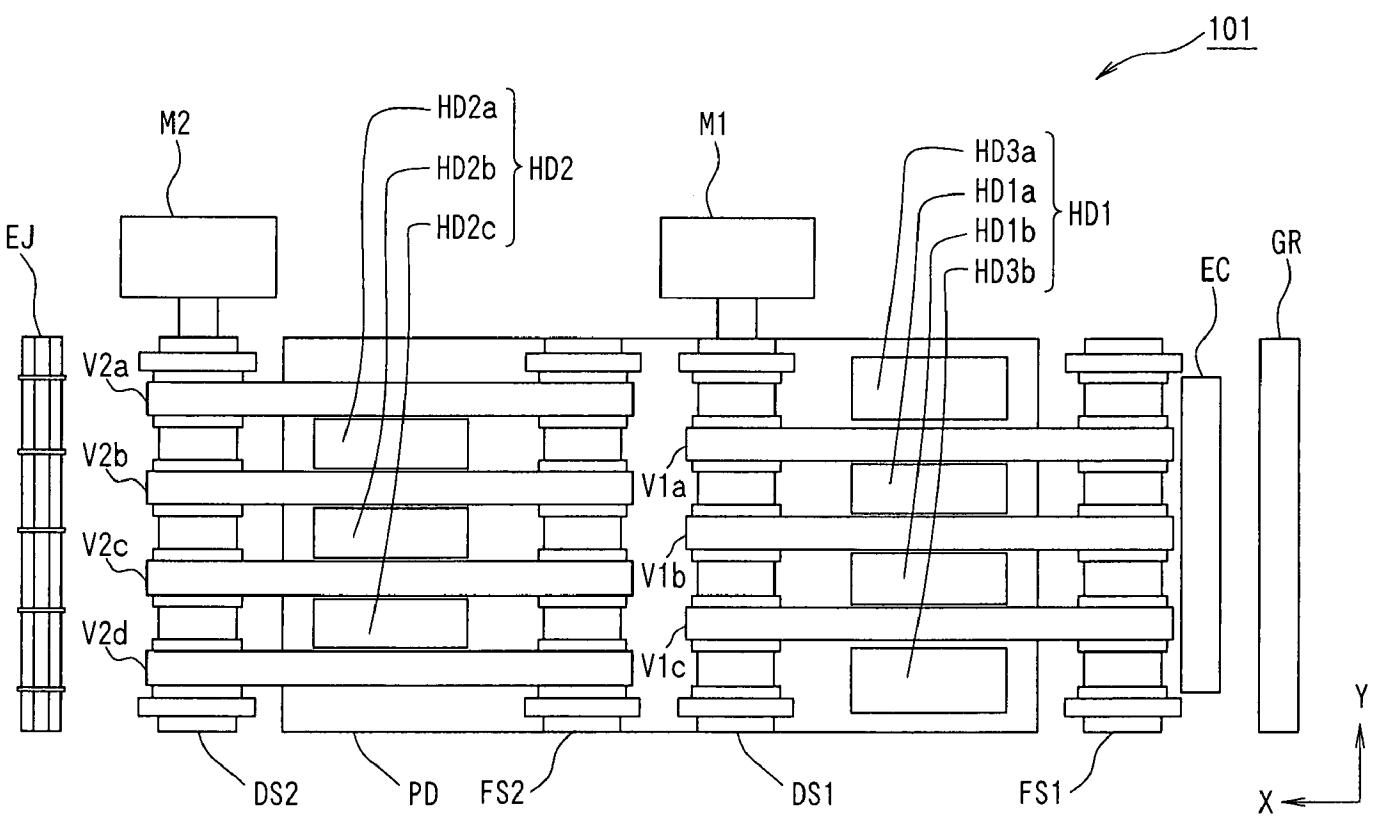
FIG. 21 is a top view showing another ink jet printer of the second embodiment.

As shown in FIG. 21, between the first driven shaft FS1 and the driving shaft DS1, the first printing head group HD1 is constituted of the printing heads HD1*a* and HD1*b* which are set to positions facing the gap between the first conveying belts V1, and the printing heads HD3*a* and HD3*b* which are arranged to the printing heads HD1*a* and HD1*b* at the outside of the gap between conveying belts at both sides of the first conveying belts V1*a* and V1*c* at the outermost side of the first conveying belts V1. Moreover, the second printing head group HD2 has a configuration in which the printing heads HD2*a* to HD2*c* are arranged at a position facing the gap between the second conveying belts V2, between the second driving shaft FS2 and the driving shaft DS2.

In FIGS. 20 and 21, the conveying belts V1*a* and V1*c* correspond to the outermost conveying belt.

Moreover, in FIG. 21, the printing heads HD1*a* and HD1*b* correspond to the first head, the printing heads HD2*a* to HD2*c* correspond to the second head, the printing heads HD3*a* and HD3*b* correspond to the third head, and the first and second printing head groups HD1 and HD2 correspond to the first and second head groups.

According to the above mentioned, it is possible to decrease the number of printing heads and the number of conveying belts constituting a printing head compared to the case of the above-describe ink jet printer 100 shown in FIG. 13.

Moreover, in the case of this embodiment, the sheet conveying portion CV is described which is constituted of the first conveying portion CV1 and the second conveying portion CV2 driven independently of the first conveying portion CV1. However, it is also possible to use the sheet conveying portion CV shown in FIG. 2 of the first embodiment.

Figure 22:
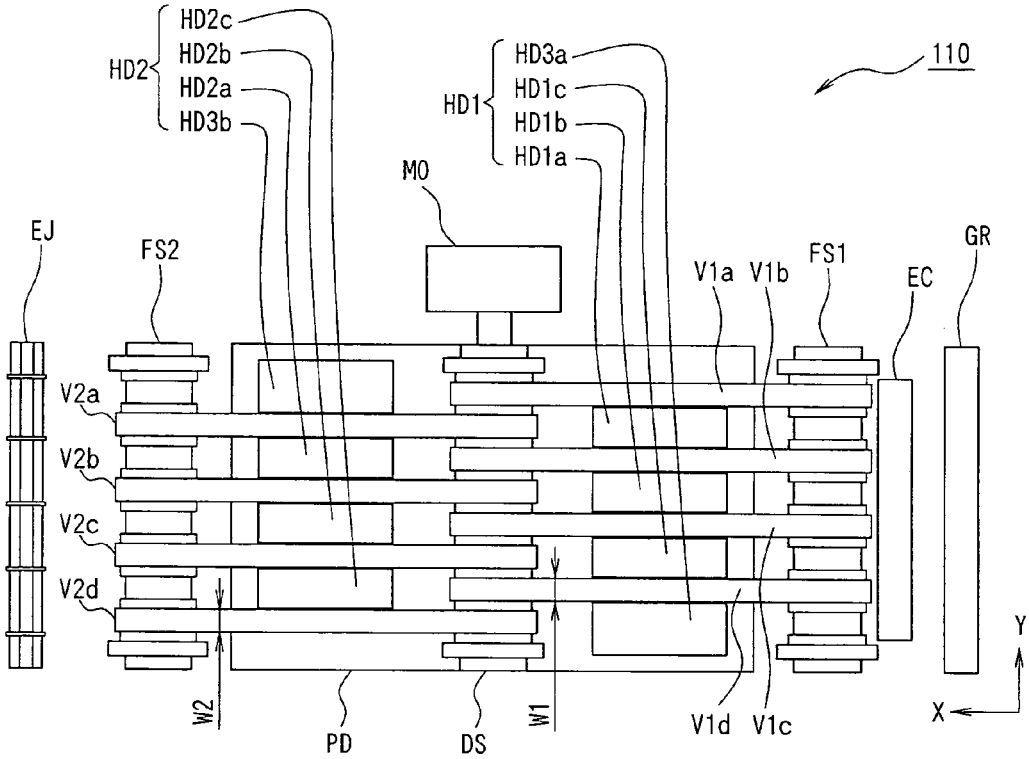
FIG. 22 is a top view showing still another ink jet printer of the second embodiment.

That is, as shown in FIG. 22, in the case of an ink jet printer 110 having the sheet conveying portion CV shown in FIG. 2 of the first embodiment, the first and second conveying belts V1 and V2 are driven by the common conveying portion driving motor M0 and the driving shaft DS.

The ink jet printer 110 has the same advantage as the ink jet printer 100 and moreover, it is possible to simplify the configuration of the sheet conveying portion CV compared to the case of the ink jet printer 100. Moreover, because the first and second conveying belts V1 and V2 are driven by the common conveying portion driving motor M0 and the driving shaft DS, the printing sheet P is conveyed under the first and second printing head groups HD1 and HD2 at the same speed and it is possible to restrain the difference between printing qualities by the first and second printing head groups HD1 and HD2.

Figure 23:
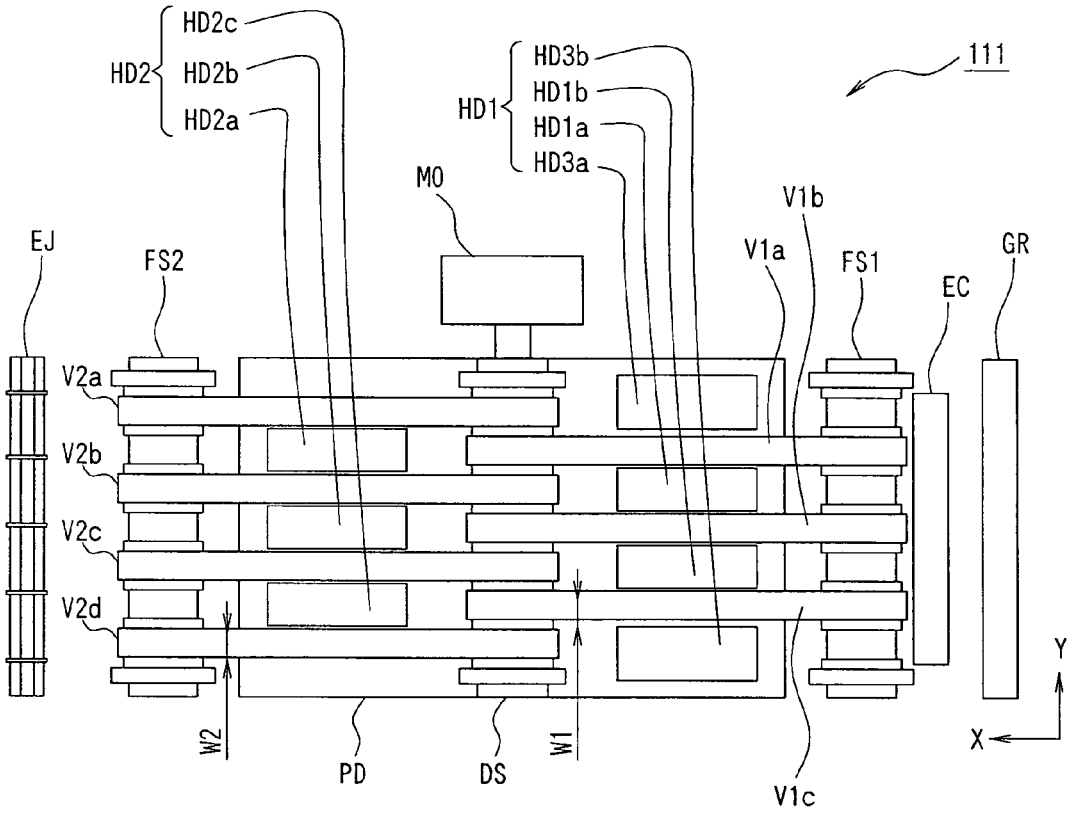
FIG. 23 is a top view showing still another ink jet printer of the second embodiment.

In the case of this ink jet printer 110, the number of first conveying belts V1 is equal to the number of second conveying belts V2. However, it is also possible to set the number of conveying belts V1 or conveying belts V2 to a value one less than the number of the other conveying belts. That is, it is possible to constitute the ink jet printer 110 with the sheet conveying portion CV shown in FIG. 10 of the first embodiment. An ink jet printer 111 having the sheet conveying portion CV shown in FIG. 10 has the same configuration in FIG. 21 except the configuration of the sheet conveying portion CV as shown in FIG. 23 and a portion corresponding to that in FIG. 21 is provided with the same symbol and its description is omitted.

As described above, by applying an equal force in mutually opposite directions at both sides of the first and second driven shafts FS1 and FS2 and applying a tension to the first and second conveying belts V1 and V2, tensions of the first and second conveying belts V1 and V2 cancel the force applied to the driving shaft DS and the direction for connecting the working point of the resultant force of the tension of the first conveying belt V1 with the working point of the resultant force of the second conveying belt V2 coincides with the direction of the resultant forces on the driving shaft DS to restrain a force couple and it is possible to further restrain the deflection of the driving shaft DS. Thus, the printing quality is further improved.

The third embodiment of the present invention is described in accordance with the accompanying drawings.

Figure 24:
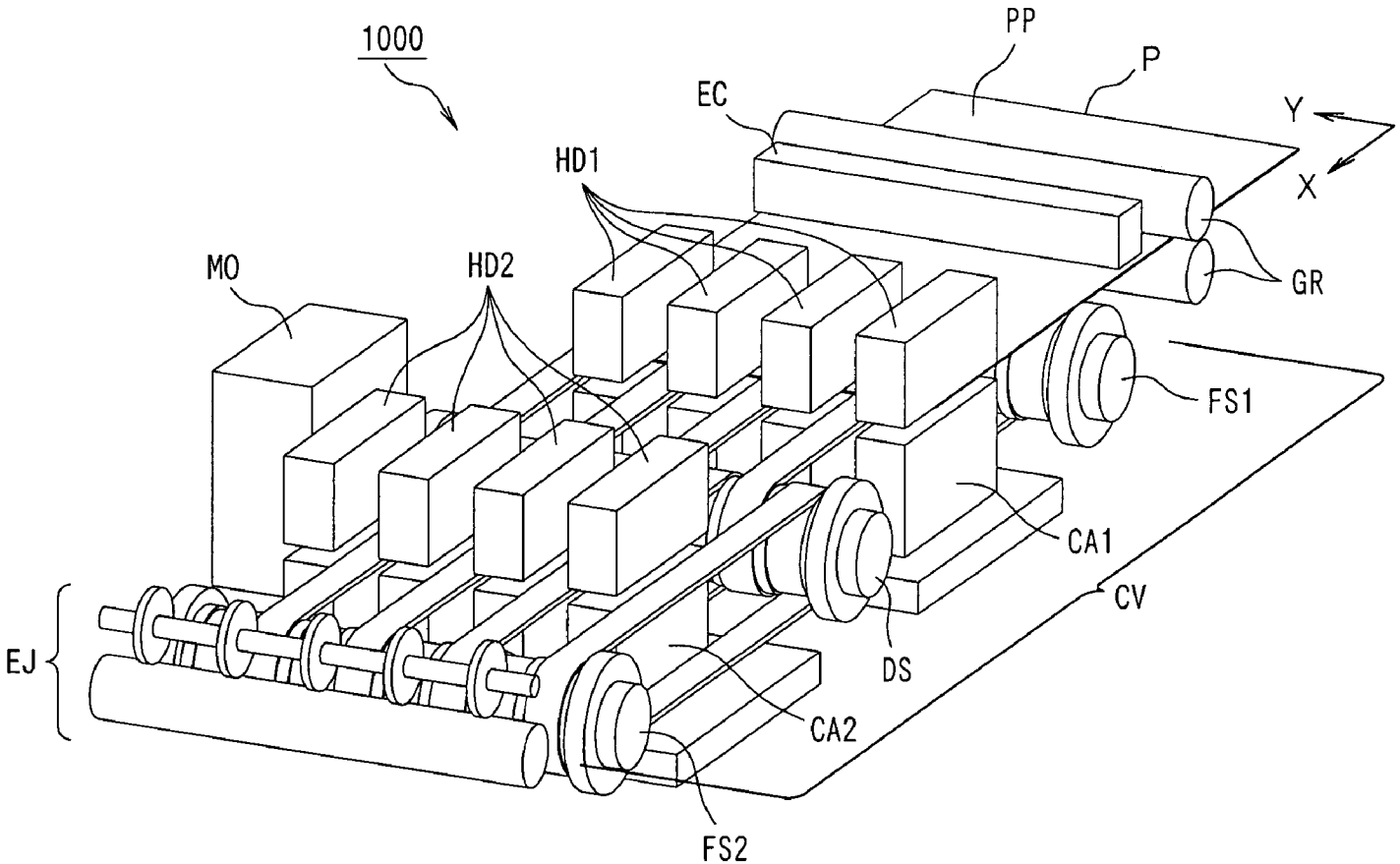
FIG. 24 is an outline view showing a main configuration of an ink jet printer of a third embodiment.

In the case of the ink jet printer 1000 of the third embodiment, widths of the printing heads HD3*a* and HD3*b* of the ink jet printer 110 shown in FIG. 22 of the second embodiment in Y direction are set equally to those of the printing heads HD1*a* to HD1*c* and HD2*a* to HD2*c* and the ink absorbing portion PD is omitted. As shown in FIG. 24, the ink jet printer 1000 has the same configuration of the ink jet printer 110 except that the printer 1000 has first and second discharge performance recovery caps CA1 and CA2.

Therefore, a portion corresponding to that of the ink jet printer 110 is provided with the same symbol and its description is omitted.

Figure 25:
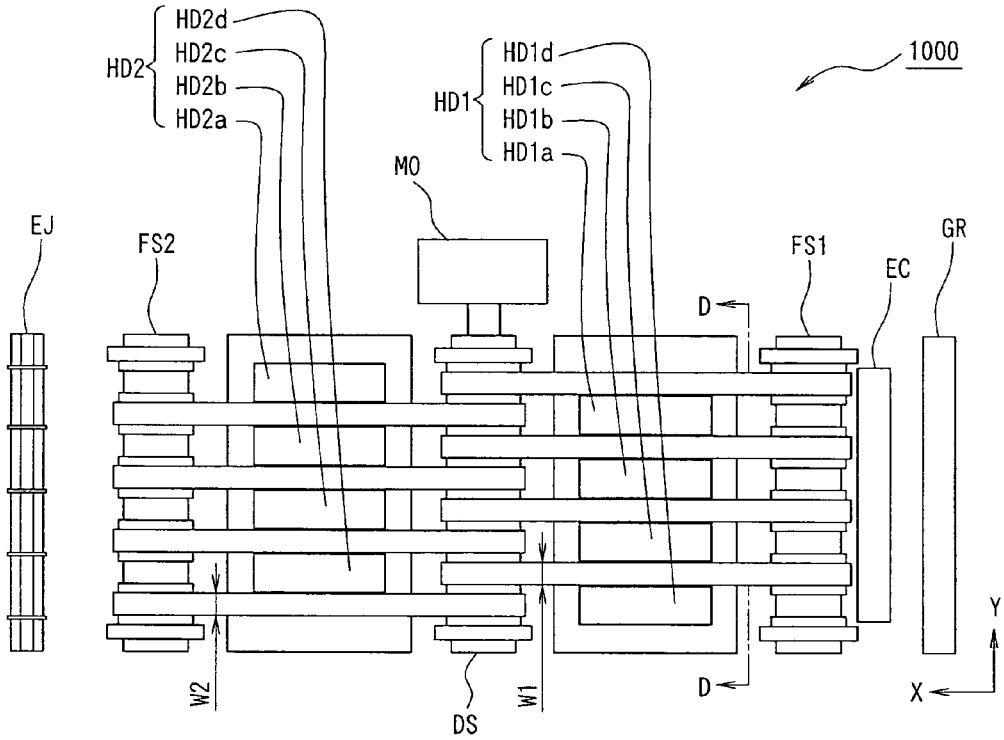
FIG. 25 is a top view showing a main configuration of the ink jet printer of the third embodiment.

As shown in FIG. 25, the first and second printing head groups HD1 and HD2 are respectively constituted of the printing heads HD1*a* to HD1*d* and HD2*a* to HD2*d* on the first and second conveying portions CV1 and CV2. Moreover, the printing heads HD1*a* to HD1*c* among the printing heads HD1*a* to HD1*d* are set to the position facing the gap between the conveying belts V1*a* and the V1*d*, between the first driven shaft FS1 and the driving shaft DS. The printing head HD1*d* is set adjacently to the printing head HD1*c* at both sides of the conveying belt V1*d*. Moreover, the printing heads HD2*b* to HD2*d* among the printing heads HD2*a* to HD2*d* are set to the position facing the gap between the conveying belts V2*a* and V2*d*, between the driving shaft DS and the second driven shaft FS2. The printing head HD2*a* is set adjacently to the printing head HD2*b* at both sides of the conveying belt V2*a*.

Then, the first and second discharge performance recovery caps CA1 and CA2 are described below in detail.

Figure 26A:
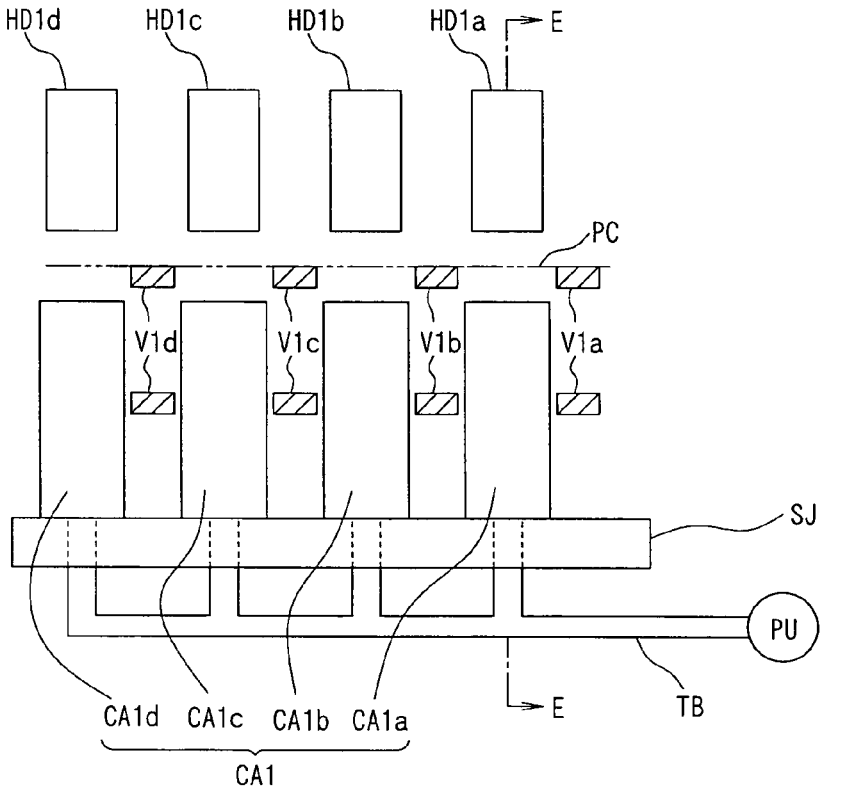
FIGS. 26A and 26B are illustrations schematically showing the D-D cross section in FIG. 25.
Figure 26B:
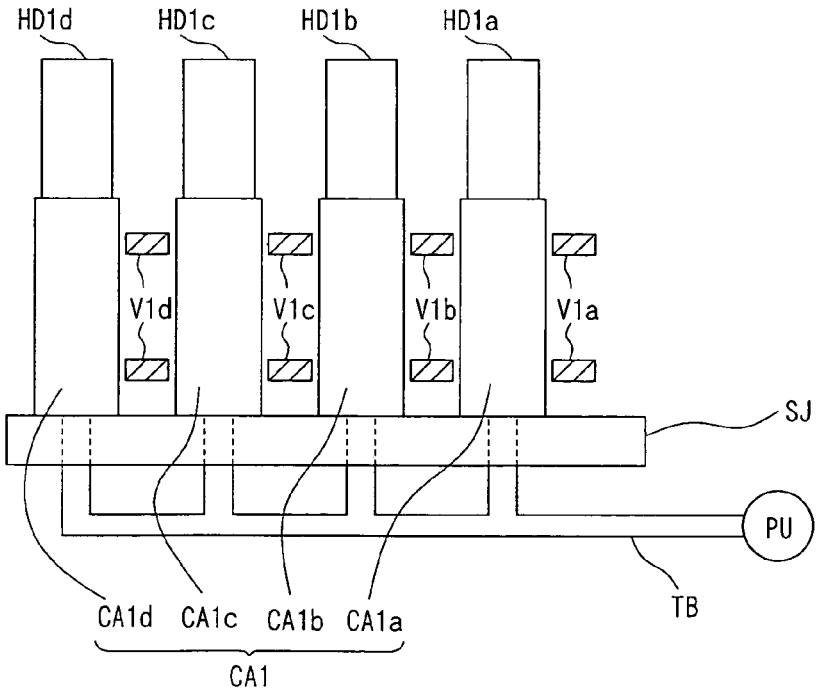

FIGS. 26A and 26B are illustrations schematically showing the D-D cross section in FIG. 25, in which FIG. 26A shows a state in which the first discharge performance recovery cap CA1 is present at the sheltering position and FIG. 26B shows a state in which the first discharge performance recovery cap CA1 rises and contacts with the printing heads HD1*a* to HD1*d*. In FIGS. 26A and 26B, the second conveying portion CV2 is omitted so that the states are easily understood.

As shown in FIG. 26A, the first discharge performance recovery cap CA1 has split caps CA1*a* to CA1*d* facing the printing heads HD1*a* to HD1*d* of the first printing head group HD1 respectively sandwiching the conveying route PC of the printing sheet. Though the drawing of the second discharge performance recovery cap CA2 is omitted because the cap CA2 has the same arrangement configuration as the first discharge performance recovery cap CA1, the cap CA2 has split caps CA2*a* to CA2*d* facing the printing heads HD2*a* to HD2*d* sandwiching the conveying route PC.

That is, the split caps CA1*a* to CA1*c* among the split caps CA1*a* to CA1*d* are arranged at a position between conveying belts V1*a* to V1*d*, between the first driven shaft FS1 and the driving shaft DS by facing the printing heads HD1*a* to HD1*c* sandwiching the conveying route PC. The split cap CA1*d* is set adjacently to the split cap CA1*c* at both sides of the conveying belt V1*d* and set to a position facing the printing head HD1*d* sandwiching the conveying route PC.

Moreover, the split caps CA2*b* to CA2*d* among the split caps CA2*a* to CA2*d* are arranged at a position between conveying belts V2*a* to V2*d*, between the driving shaft DS and the second driven shaft FS2 sandwiching the conveying route PC by facing the printing heads HD2*b* to HD2*d*. The split cap CA2*a* is set adjacently to the split cap CA2*b* at both sides of the conveying belt V2*a* and set to a position facing the printing head HD2*a* sandwiching the conveying route PC.

In this case, as shown in FIG. 26B, the width of the split caps CA1*a* to CA1*d* is set to a value larger than the width of the printing heads HD1*a* to HD1*d*. When the split caps CA1*a* to CA1*d* are raised by a cap elevating portion to be described later, it is possible to cover all the nozzles of the printing heads HD1*a* to HD1*d*.

Moreover, the split caps CA1*a* to CA1*d* and CA2*a* to CA2*d* are supported by a cap support portion SJ and connected to a suction pump PU by a tube TB.

Figure 27:
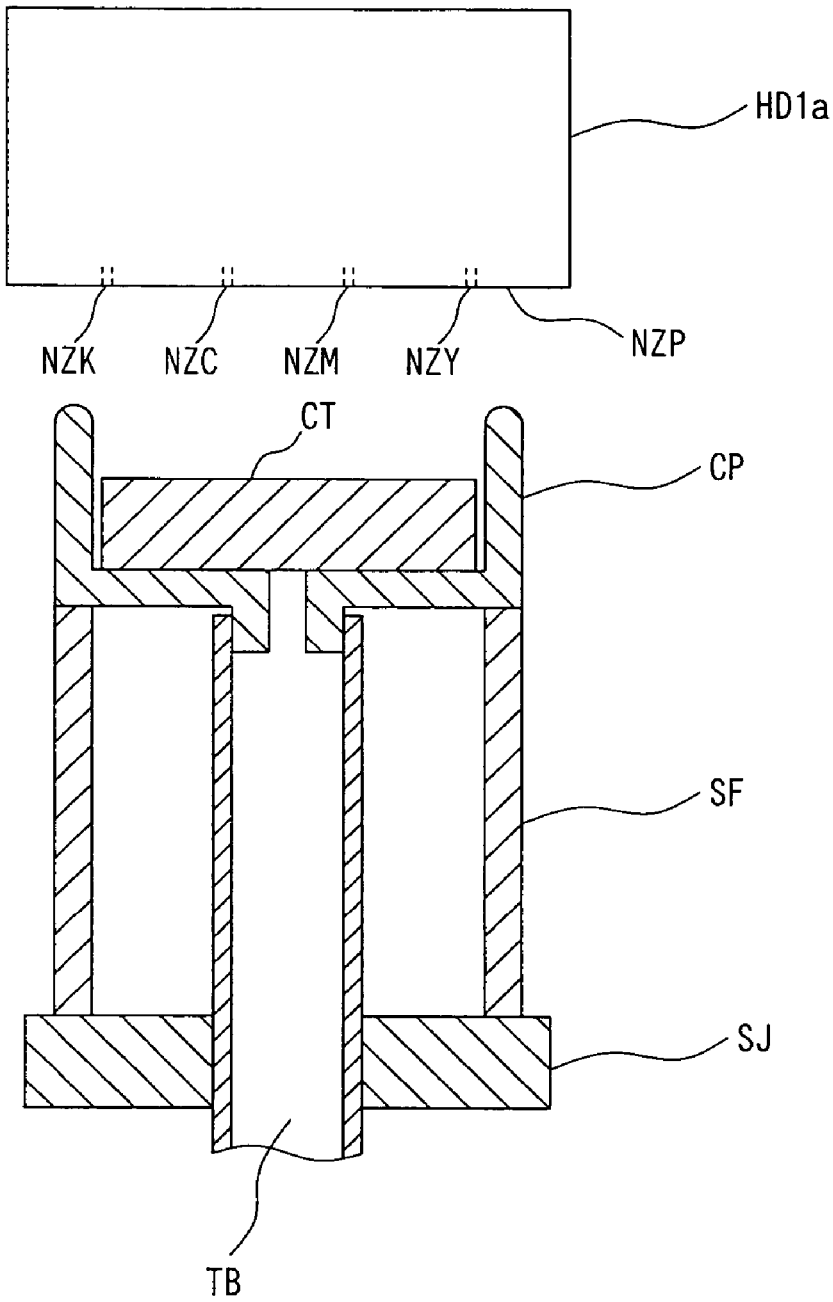
FIG. 27 is an illustration schematically showing the E-E cross section in FIG. 26.

Moreover, as shown in FIG. 27 which is a drawing schematically showing the E-E cross section in FIG. 26A, the split caps CA1*a* to CA1*d* and CA2*a* to CA2*d* have a cap portion CP at least whose upside is formed of an elastic body to cover the nozzles NZY, NZM, NZC, and NZK of the printing head HD1*a* by bringing ends of the caps contact with the nozzle face NZP on which the nozzles NZY, NZM, NZC, and NZK are formed, a support frame SF fixed to a cap support portion SJ to support the cap portion CP, and an ink absorbing body CT set in the cap portion CP to absorb ink. Furthermore, the other end of the tube TB whose one end is connected to the suction pump PU is connected to the cap portion CP through the support frame SF and the cap support portion SJ.

The cap portion CP is raised by a cap elevating portion to be described later, an end of the cap portion CP contacts with the nozzle face NZP to cover the nozzles NZY, NZM, NZC, and NZK. Moreover, the inside of the cap portion CP is decompressed by the suction pump PU through the tube TB. Therefore, solidified ink and entered foreign matter which are causing clogging of a nozzle are sucked into the cap portion CP and clogging disappears.

Next, the cap elevating portion for raising and lowering the first and second discharge performance recovery caps CA1 and CA2 is described below in detail.

Figure 28:
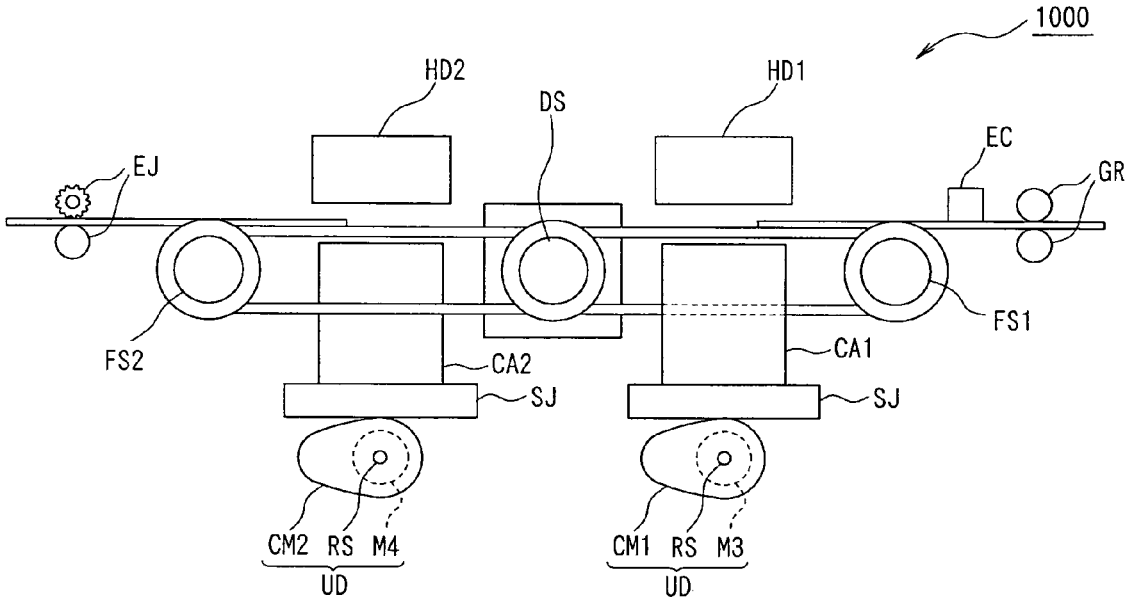
FIG. 28 is a front view of the ink jet printer of the third embodiment.

As shown in FIG. 28 which is a front view of the ink jet printer 1000, a cap elevating portion UD has first and second elevating cams CM1 and CM2 to be rotated about a rotating shaft RS by bringing the outer peripheries of the cams into contact with the bottom of the cap support portion SJ, first and second cam driving motors M3 and M4 for generating motive power to be transferred to the first and second elevating cams CM1 and CM2 through a not-illustrated motive power transfer mechanism, and a not-illustrated elevating guide portion for guiding elevation of the cap support portion SJ. FIG. 28 shows a state in which the first and second discharge performance recovery caps CA1 and CA2 are present at the sheltering position separated from the nozzle faces of the first and second printing head groups HD1 and HD2.

The first and second elevating cams CM1 and CM2 are independently driven by the first and second cam driving motors M3 and M4. Moreover, the first and second cam driving motors M3 and M4 can respectively use a stepping motor which can be open-controlled.

Figure 30:
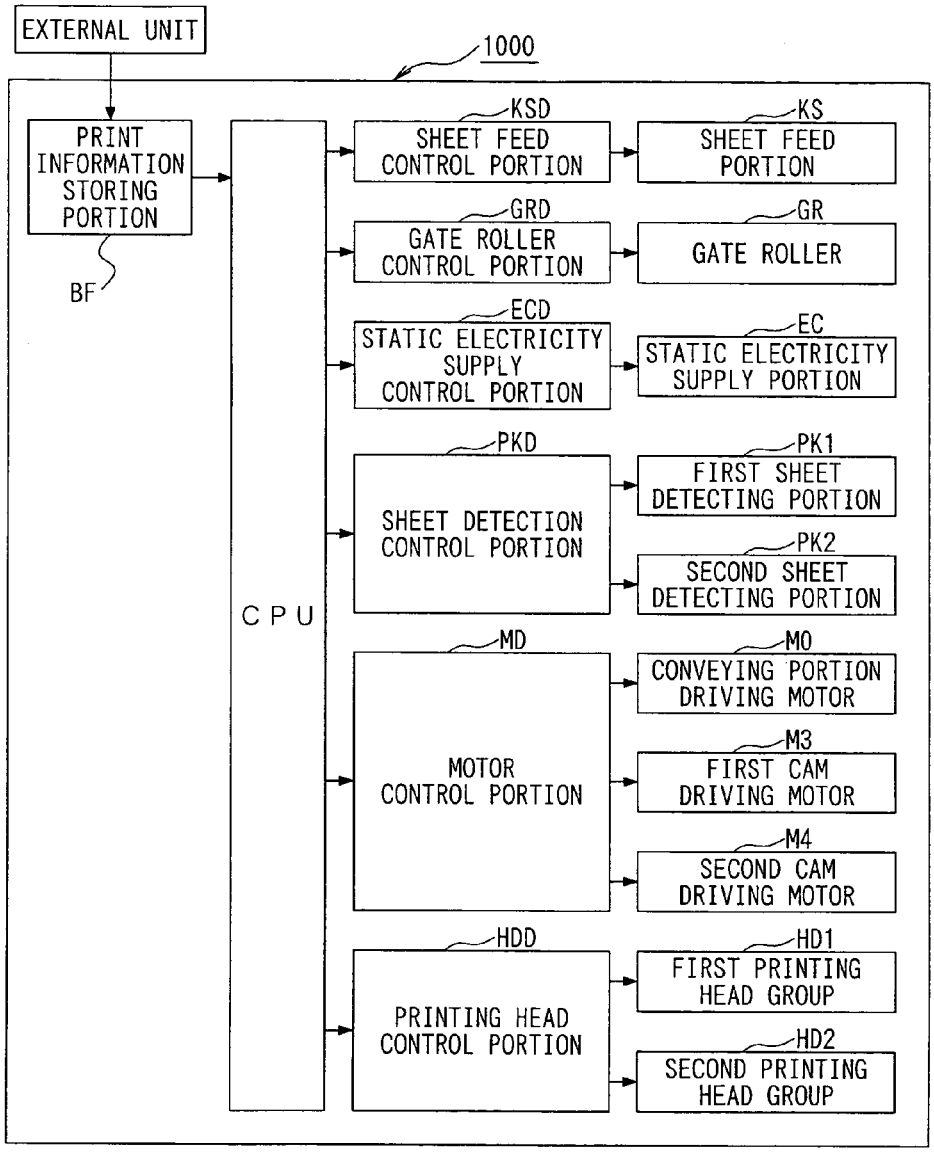
FIG. 30 is a block diagram showing the relation of control of a main portion of the ink jet printer of the third embodiment.

These first and second cam driving motors M3 and M4 are controlled by the motor control portion MD as shown in FIG. 30 which is a block diagram.

Figure 29:
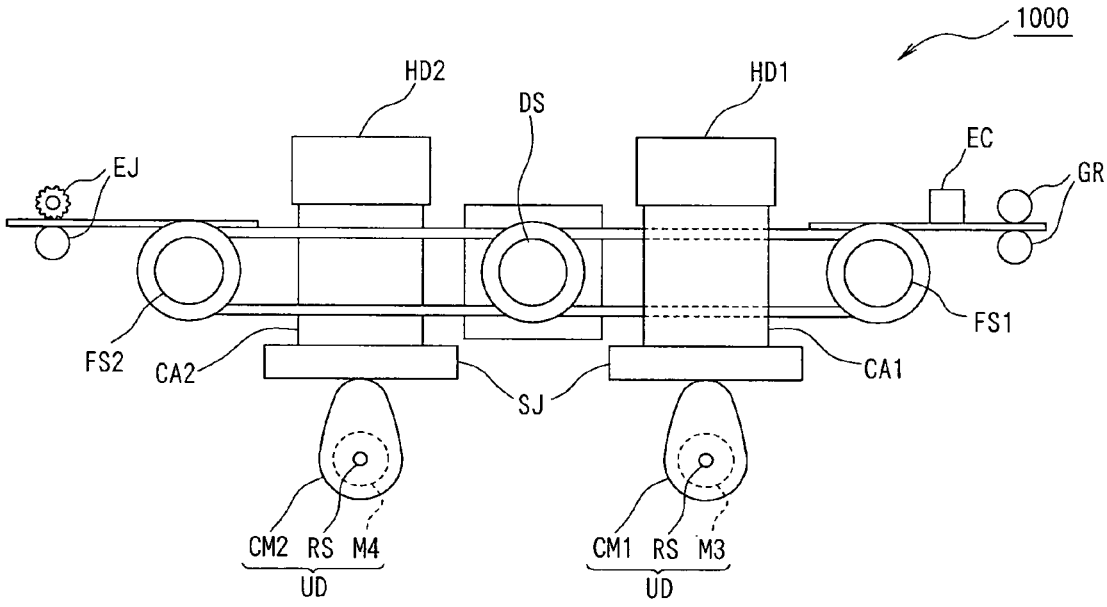
FIG. 29 is an illustration showing a state in which first and second discharge performance recovery caps of the third embodiment contact with nozzle faces.

Moreover, when the first and second cam driving motors M3 and M4 are started, the first and second elevating cams CM1 and CM2 are rotated as shown in FIG. 29, the cap support portion SJ is raised along the outer peripheries of the first and second elevating cams CM1 and CM2, and the first and second discharge performance recovery caps CA1 and CA2 contact with the nozzle face.

When the ink jet printer 1000 having the above configuration receives print information and a printing instruction from an external unit, it starts the printing operation and the first conveying portion CV1 leads the printing sheet P to the portion under the first printing head group HD1 as in the case of the first embodiment.

In this case, the CPU measures the timing for starting to print in accordance with the first sheet detection signal which is output from the first sheet detecting portion PK1 and makes the printing head control portion HDD to control the first printing head group HD1 and discharge ink drips from color nozzles NZY, NZM, NZC, and NZK to execute a first printing in accordance with print information.

Moreover, the printing sheet P to which first printing is applied is led to the portion under the second printing head group HD2 by the second conveying portion CV2 and second printing is executed by the second printing head group HD2 at the timing according to the second sheet detection signal supplied from the second sheet detecting portion PK1 similarly to the case of the first printing.

In the case of the ink jet printer 1000 of the third embodiment, when continuously printing data in different printing sheets P, inter-sheet discharge performance recovery process is described which recovers the performance for discharging ink drips of the first and second printing heads HD1 and HD2, between these different printing sheets P. The inter-sheet discharge performance recovery process by the third embodiment is performed by individually controlling the first and second discharge performance recovery caps CA1 and CA2 and the control flows of them are the same. Therefore, details of the process flow of only the first discharge performance recovery cap CA1 are described.

Figure 31:
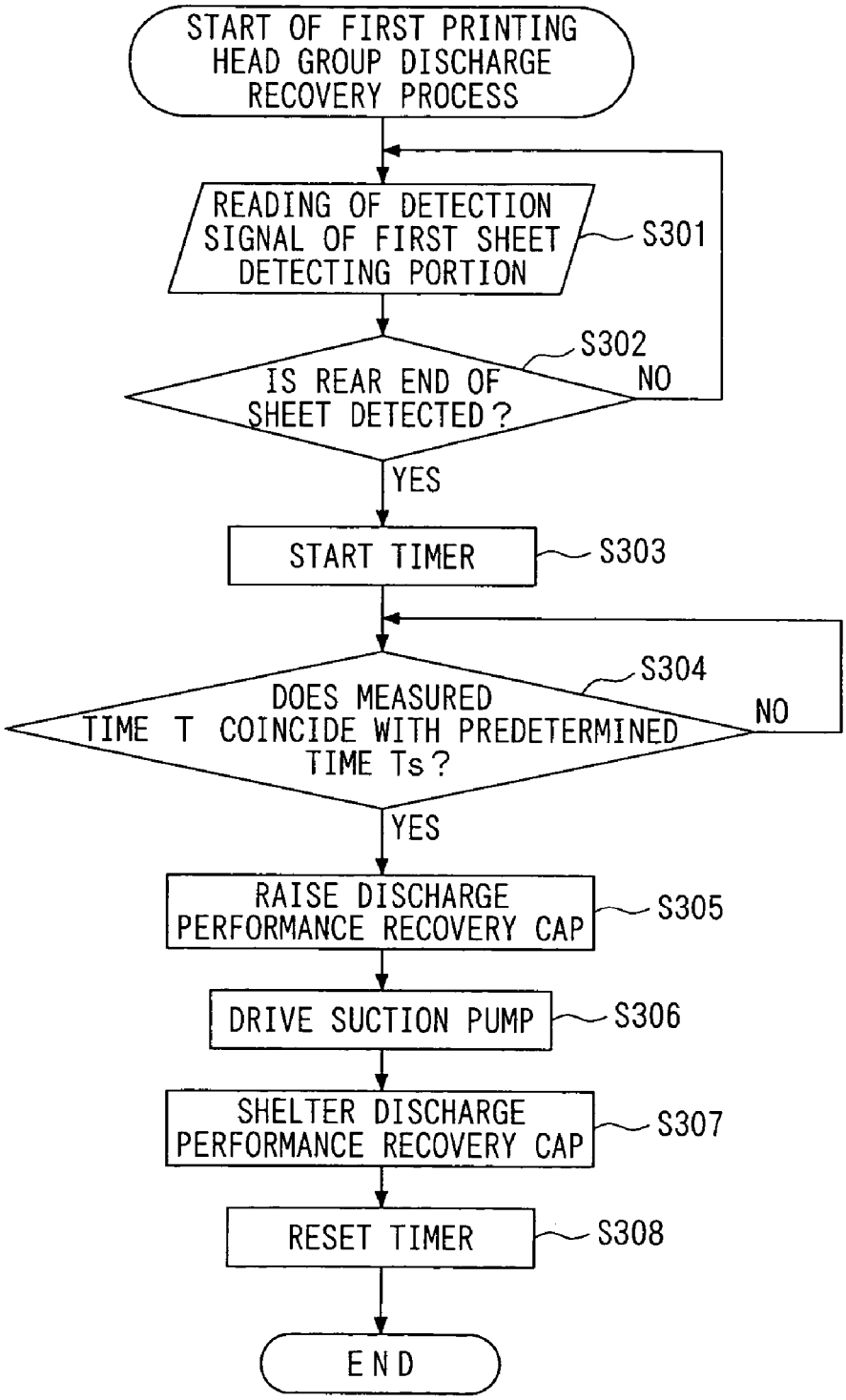
FIG. 31 is an illustration showing a flow of inter-sheet discharge performance recovery process of the third embodiment.

In the case of the ink jet printer 1000 of the third embodiment, when the first printing head group HD1 starts printing, the CPU starts the inter-sheet discharge performance recovery process shown in FIG. 31.

First, in step S301, the first sheet detecting portion PK1 reads a sheet detection signal and step S302 is started.

Then, in step S302, the first sheet detecting portion PK1 determines whether to detect the rear end of the printing sheet P in accordance with the sheet detection signal supplied from the first sheet detecting portion PK1. When it is determined that the rear end is detected, step S303 is started. When it is determined that the rear end is not detected, step S301 is started to read the sheet detection signal.

Then, in step S303, a timer for measuring the time since detecting the rear end of the printing sheet P is started to start step S304.

In step S304, it is determined whether the time T measured by the timer coincides with the predetermined time Ts. When it is determined that the time T coincides with the time Ts, step S305 is started. When it is determined that the time T does not coincide with the time Ts, step S304 is repeated until the time T coincides with the time Ts.

Then, in step S305, the first cam driving motor M3 is driven to bring the cap portion CP of the first discharge performance recovery cap CA1 into contact with the nozzle face NZP of the first printing head group HD1 and step S306 is started.

Then, in step S306, the suction pump PU is driven to attract ink from color nozzles NZY, NZM, NZC, and NZK to recover the ink discharge performance and step S307 is started.

Then, in step S307, the first cam driving motor M3 is driven to shelter the first discharge performance recovery cap CA1 to the sheltering position and step S308 is started.

Then, in step S308, the timer is reset to complete the process.

In the case of this embodiment, the printing sheet P corresponds to a printing medium, the first and second printing head groups HD1 and HD2 correspond to the first and second heads, and the first and second discharge performance recovery caps CA1 and CA2 and the processes in steps S305 to S307 in FIG. 31 correspond to a discharge performance recovery section.

According to the above mentioned, it is possible to keep the discharge performance recovery section below the conveying face of the printing sheet P and the ink jet printer is possible to be downsized. When data is printed in the printing sheet P, conveying of the printing sheet P is not interrupted. Moreover, because the discharge performance section faces the first and second heads, it is possible to quickly recover the discharge performance of the heads by slightly raising the discharge performance recovery section when printing is not performed.

Moreover, when performing printing and discharge performance recovery process, it is not necessary to move a head. Therefore, a mechanical component required to move a head or complicated control is unnecessary and therefore, it is possible to solve the problem of reliability. Moreover, it is solved that a shift from a printing position of a head due to an occurrence of movement and it is possible to keep a preferable printing quality.

Furthermore, when continuously printing data in different printing sheets P, it is possible to recover the discharge performance without interrupting printing by using the interval from the time when printing of data in one printing sheet P is completed till the time when the next printing sheet P arrives and preferably keep the printing quality in all of continuous printing.

In the case of the third embodiment, the printing sheet P is described as a printing medium. However, it is also possible to apply the third embodiment to a printing medium other than paper. The third embodiment can be applied to resin or metal as a material, circle or different shape as a shape, and other objects having various properties such as objects having high and low flexibilities.

In the case of this embodiment, the first and second conveying belts V1 and V2 are respectively constituted of four conveying belts V1*a* to V1*d* and V2*a* to V2*d*. However, it is also possible that the conveying belts V1 and V2 are constituted of at least one conveying belt each. It is preferable that the conveying belts V1 and V2 are respectively constituted of a plurality of conveying belts in order to convey the printing face PP of the printing sheet P as flatly and stably as possible.

Moreover, it is not necessary that the number of conveying belts constituting the first conveying belt V1 is equal to the number of conveying belts constituting the second conveying belt V2. For example, it is possible to use a configuration in which the conveying belts V1 or V2 are constituted of one conveying belt and the other are constituted of two conveying belts. To restrain the fluctuation of the conveying speed of the printing sheet P and obtain a preferable printing quality, it is preferable to cancel the reaction force produced in the driving shaft DS and equalize tensions of all conveying belts by equalizing the numbers of conveying belts constituting the first and second conveying belts V1 and V2 and by equalizing magnitudes of forces applied to the first and second driven shafts FS1 and FS2.

Furthermore, the configuration is used in which the first and second conveying belts V1 and V2 are directly applied to the driving shaft DS and first and second driven shafts FS1 and FS2. However, it is also possible to use a configuration in which the first and second conveying belts V1 and V2 are used as timing belts, a timing-belt pulleys are set to the driving shaft DS and first and second driven shafts FS1 and FS2, and motive power is transferred to the first and second conveying belts V1 and V2 through the timing belt pulleys.

Furthermore, in the case of the inter-sheet discharge performance recovery process by the third embodiment, the discharge performance is recovered whenever the first and second printing head groups HD1 and HD2 complete printing of data in one printing sheet P. However, it is also possible to recover the discharge performance whenever printing of data in a plurality of printing sheets P is completed.

Furthermore, the first and second discharge performance recovery caps CA1 and CA2 are respectively constituted as a discharge performance recovery section for recovering the ink discharge performance of each of the printing heads HD1*a* to HD1*d* and HD2*a* to HD2*d*. However, it is also possible to respectively constitute the caps CA1 and CA2 as a head protective section for protecting the nozzle face NZP of the printing heads HD1*a* to HD1*d* and HD2*a* to HD2*d*.

Figure 32A:
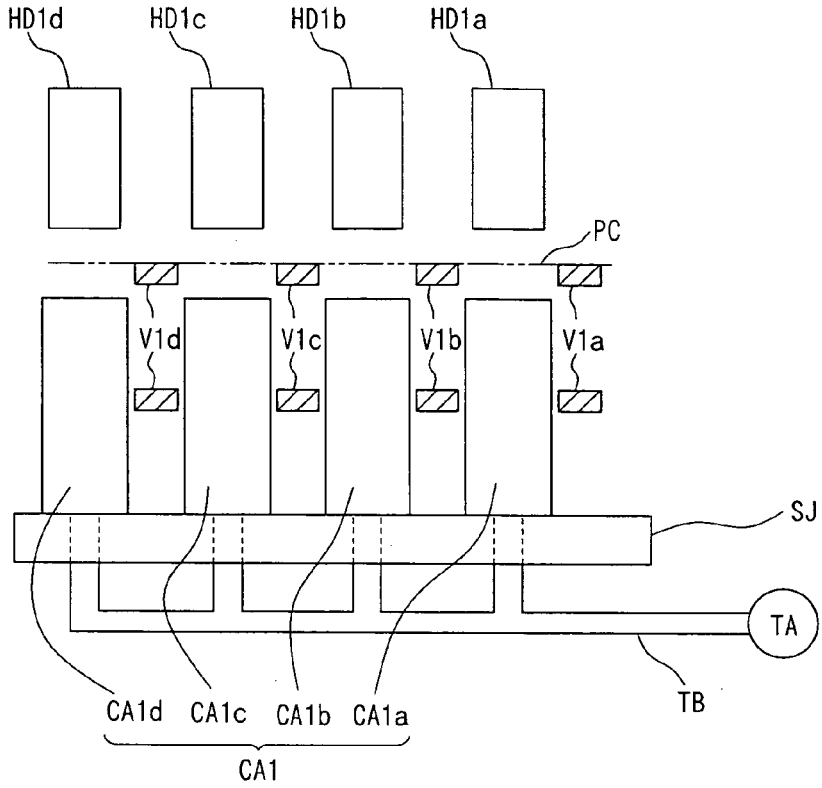
FIGS. 32A and 32B are illustrations for explaining configurations of first and second head protection caps.
Figure 32B:
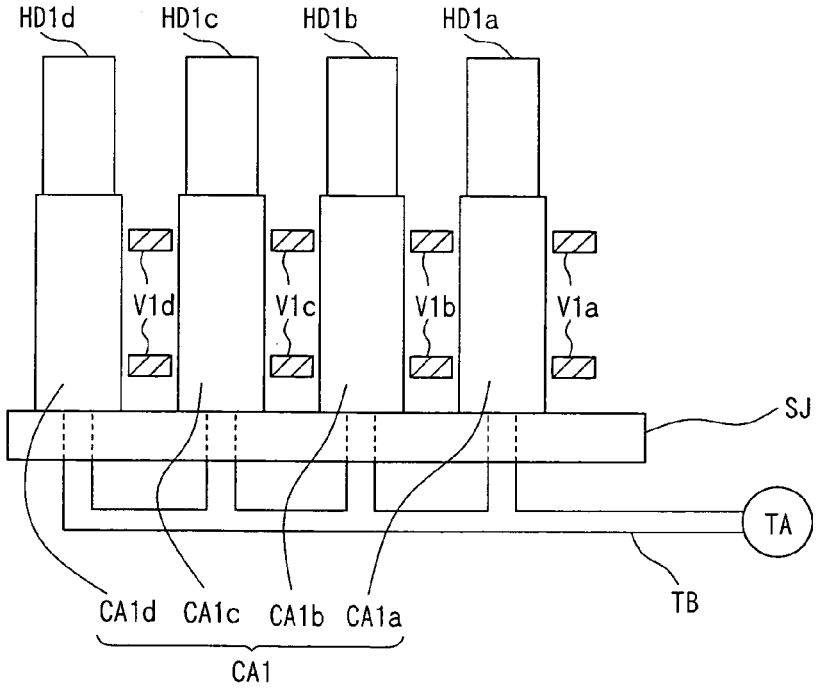

In this case, as shown in FIG. 32, the split caps CA1*a* to CA1*d* and CA2*a* to CA2*d* are connected to a wetting agent tank TA filled with a wetting agent for preventing from drying by the tube TB. Moreover, a wetting-agent absorbing body CT for absorbing a wetting agent is set in the cap portion CP instead of the ink absorbing body CT.

When an end of the cap portion CP contacts with the nozzle face NZP, a wetting environment is kept in the cap portion CP because the wetting agent absorbing body CT absorbs a wetting agent from the wetting agent tank TA through the tube TB. Therefore, it is possible to delay the ink from solidifying in the worst case by evaporating the solvent of ink from the nozzles NZY, NZM, NZC and NZK, and rising of the viscosity of the ink. Moreover, not only delaying an ink viscosity rise but also preventing the paper powder which is produced when paper fiber constituting the printing sheet P is removed from attaching to the nozzle face NZP or entering a nozzle.

In the case of the ink jet printer 1000 having the first and second head protective caps CA1 and CA2 as head protective sections, when continuously recoding data in different printing sheets P, inter-sheet head protective process is described which keeps the performance for discharging ink drips from the first and second printing head groups HD1 and HD2 between these different printing sheets P. The inter-sheet head protective process is performed by individually controlling the first and second head protective caps CA1 and CA2 and flows of controls of them are the same. Therefore, details of only the flow of the process by the first head protective cap CA1 are described.

Figure 33:
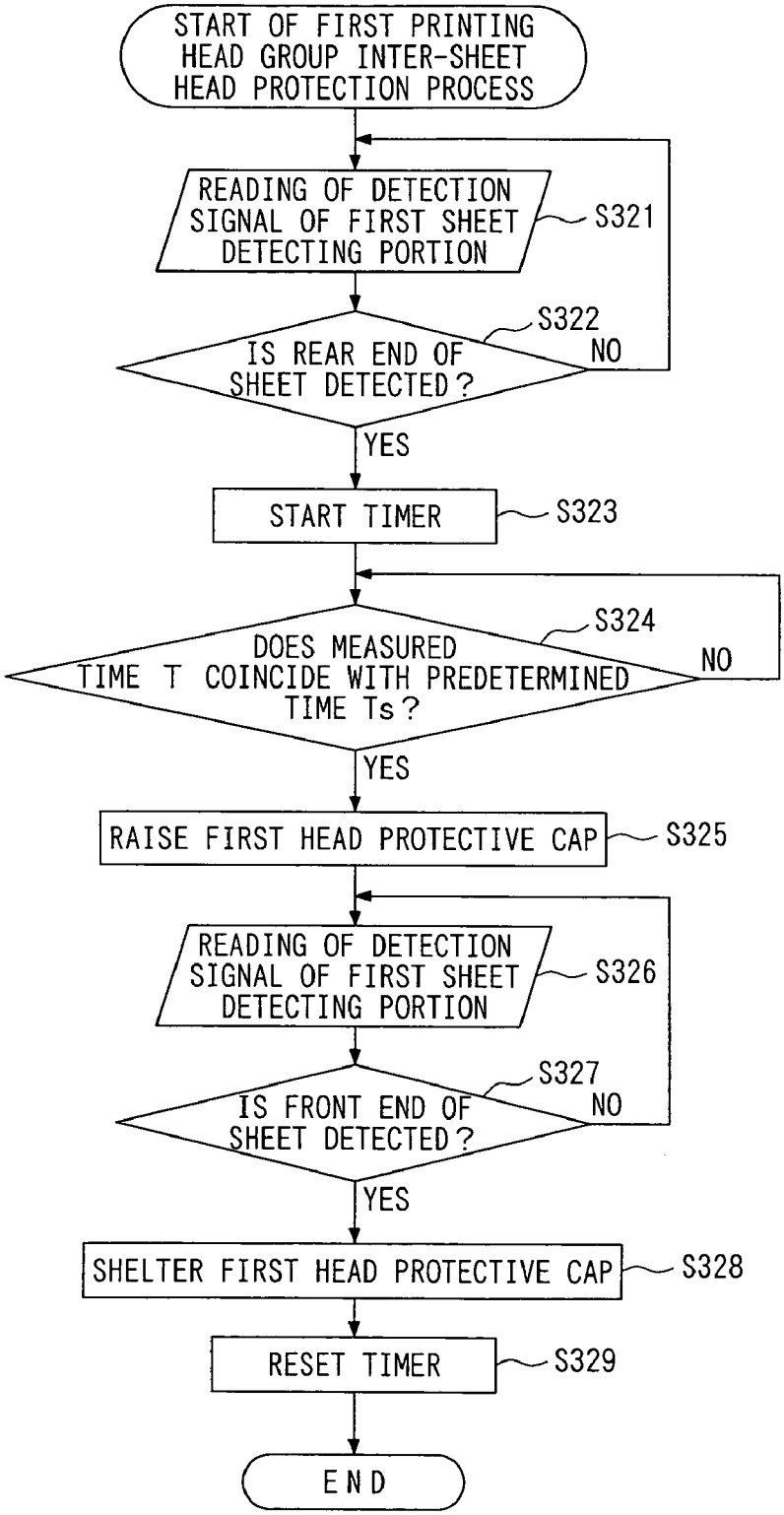
FIG. 33 is an illustration showing a flow of inter-sheet head protection process of the third embodiment.

In the case of the ink jet printer 1000 having the first and second head protective caps CA1 and CA2, the CPU starts head protective process to the gap between sheets shown in FIG. 33 when the first recoding head group HD1 starts printing.

In the case of this inter-sheet head protective process, first in step S321, a sheet detection signal is read by the first sheet detecting portion PK1 and step S322 is started.

In step S322, the first sheet detecting portion PK1 determines whether the rear end of the printing sheet P is detected in accordance with a sheet detection signal supplied form the first sheet detecting portion PK1. When it is determined that the rear end is detected, step S323 is started. When it is determined that the rear end is not detected, step S321 is started to read the sheet detection signal.

Then, in step S323, a timer for measuring the time T since detecting the rear end of the printing sheet P is started and step S324 is started.

Then, in step S324, it is determined whether the time T measured by the timer coincides with the predetermined time Ts. When it is determined that the time T coincides with the time Ts, step S325 is started. When it is determined that the time T does not coincide with the time Ts, step S324 is repeated until the time T coincides with the time Ts.

Then, in step S325, the first cam driving motor M3 is driven to bring the cap portion CP of the first head protective cap CA1 into contact with the nozzle face NZP of the first printing head group HD1 and start step S326.

Then, in step S326, a sheet detection signal is read by the first sheet detecting portion PK1 to start step S327.

Then, in step S327, it is determined whether the first sheet detecting portion PK1 detects the front end of a new printing sheet P. When it is determined that the front end is detected, step S328 is started. When it is determined that the front end is not detected, step S326 is started to read the sheet detection signal.

Then, in step S328, the first cam driving motor M3 is driven to shelter the first head protective cap CA1 to a sheltering position and step S329 is started.

Then, in step S329, the timer is reset to complete the process.

In FIG. 33, processes in steps S325 and S328 correspond to the head protective section.

According to the above mentioned, it is possible to keep the head protective section below the conveying face of the printing sheet P, the ink jet printer is possible to be downsized, and conveying of the printing sheet P is not interrupted when data is printed in the printing sheet P. Moreover, because the head protective section faces to the first and second heads, it is possible to quickly set or remove the head protective section to or from a printing head by slightly raising or lowering the head protective section when printing is not performed.

Moreover, by minimizing the facing interval between the printing heads HD1*a* to HD1*d* and HD2*a* to HD2*d* and the head protective section so as not to interrupt conveying of a printing medium, it is possible to protect the printing heads even for a short time. That is, when printing is started because print information is sent from an external unit, it is possible to protect these printing heads until the time just before the fed printing sheet P reaches the portion under the recoding heads HD1*a* to HD1*d* and HD2*a* to HD2*d* and ink drips are discharged from the these printing heads HD1*a* to HD1*d* and HD2*a* to HD2*d*. Therefore, it is possible to greatly restrain the probability that foreign matter such as floating paper powder attaches to the nozzle face NZP or enters a nozzle.

Furthermore, when printing is performed or head protective process is performed, it is not necessary to move the printing heads HD1*a* to HD1*d* and HD2*a* to HD2*d*. Therefore, a mechanical component and complicated control necessary for moving the printing heads HD1*a* to HD1*d* and HD2*a* to HD2*d* are unnecessary and it is possible to solve the problem of reliability. Moreover, it is possible to solve the problem of shifting from each of the printing positions of the printing heads HD1*a* to HD1*d* and HD2*a* to HD2*d* due to an occurrence of movement and to keep a preferable printing quality.

Furthermore, when continuously printing data in different printing sheets P, it is possible to protect the printing heads HD1*a* to HD1*d* and HD2*a* to HD2*d* until a new printing sheet P arrives after printing of data in one printing sheet P is completed. Therefore, it is possible to raise the frequency of protection of printing heads without delaying the time until continuous printing is completed and restrain deterioration of the printing quality due to ink viscosity rise until printing is completed.

Furthermore, in the case of the inter-sheet head protection process shown in FIG. 33, the printing heads HD1*a* to HD1*d* and HD2*a* to HD2*d* are protected whenever the first and second printing head groups HD1 and HD2 complete printing of data in one printing sheet P. However, it is also possible to protect the printing heads whenever printing of data in a plurality of printing sheets P is completed.

The fourth embodiment of the present invention is described below by referring to the accompanying drawings.

Figure 34A:
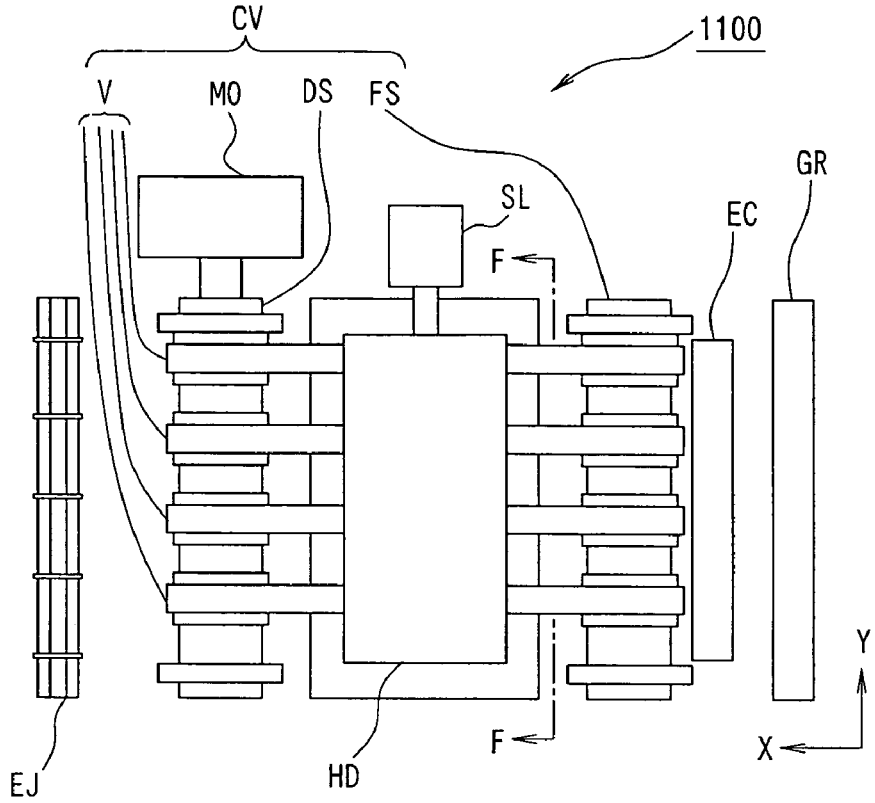
FIGS. 34A and 34B are outline views showing a main configuration of an ink jet printer of a fourth embodiment.
Figure 34B:
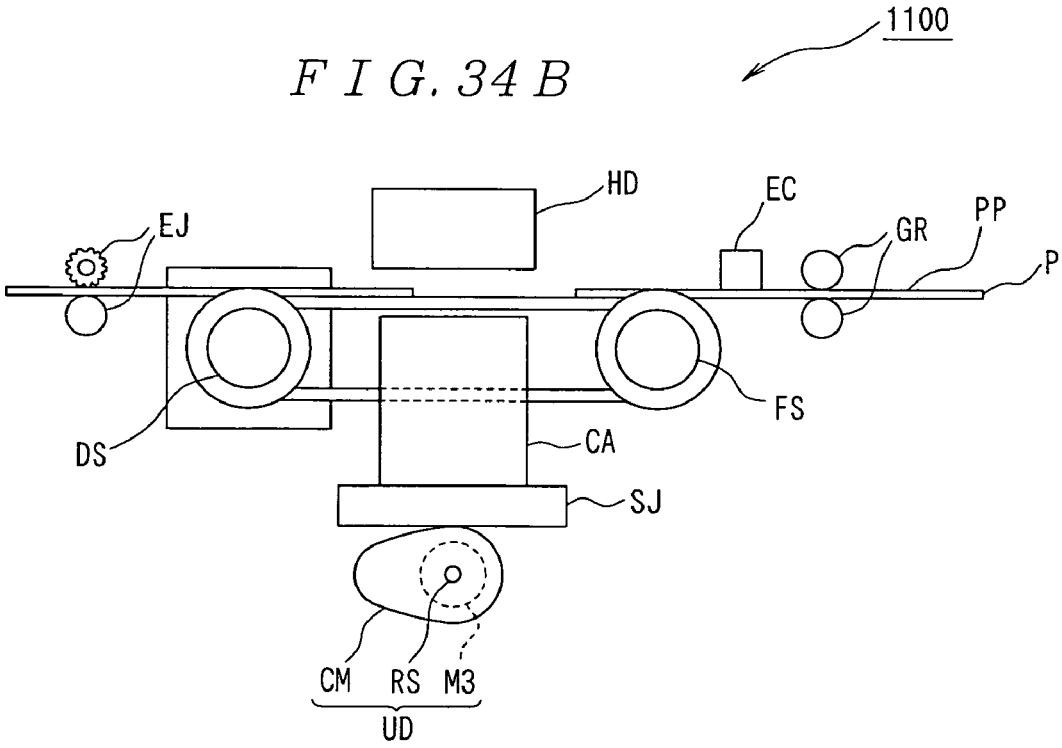
Figure 35:
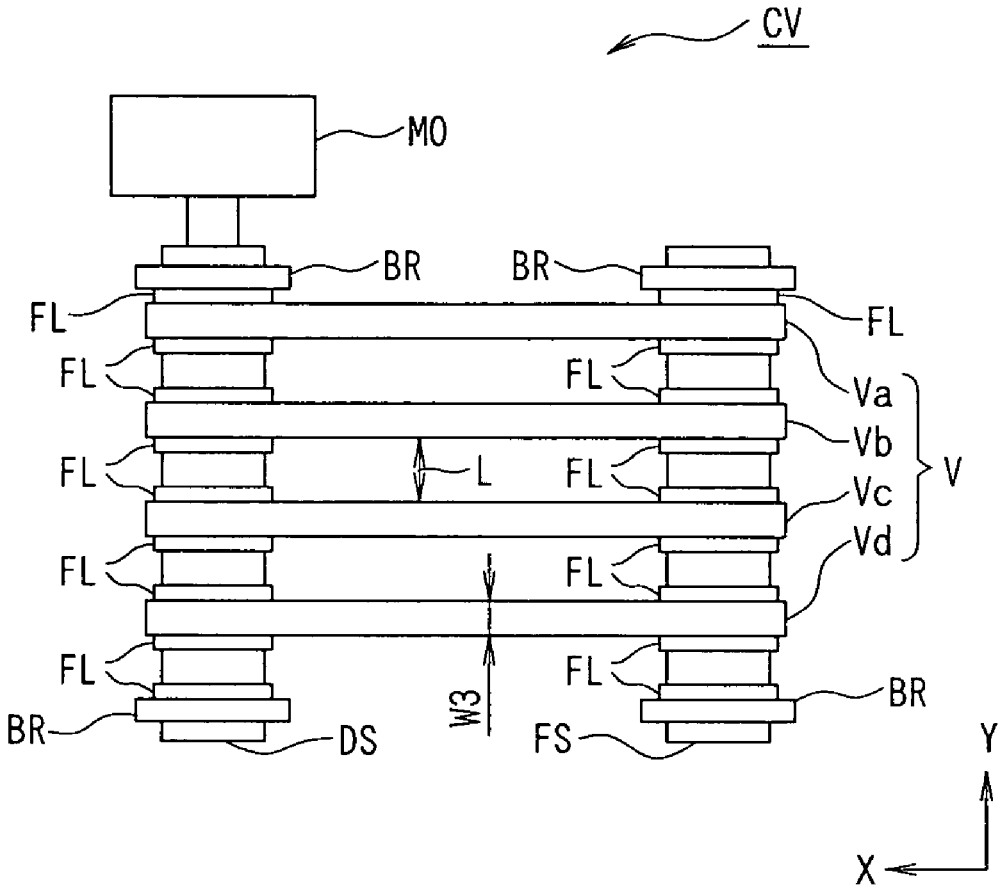
FIG. 35 is a top view of a sheet conveying portion of the fourth embodiment.

As shown in FIGS. 34A and 34B, in the case of the ink jet printer 1100 of the fourth embodiment, the sheet conveying portion CV has the same configuration as the first conveying portion CV1 except that the second conveying portion CV2 of the above described third embodiment is omitted and the conveying belt width W3 and the belt interval L shown in FIG. 35 are set so as to meet the relation of L>W3, and a portion corresponding to that in FIG. 24 is provided with the same symbol and its description is omitted.

Figure 36:
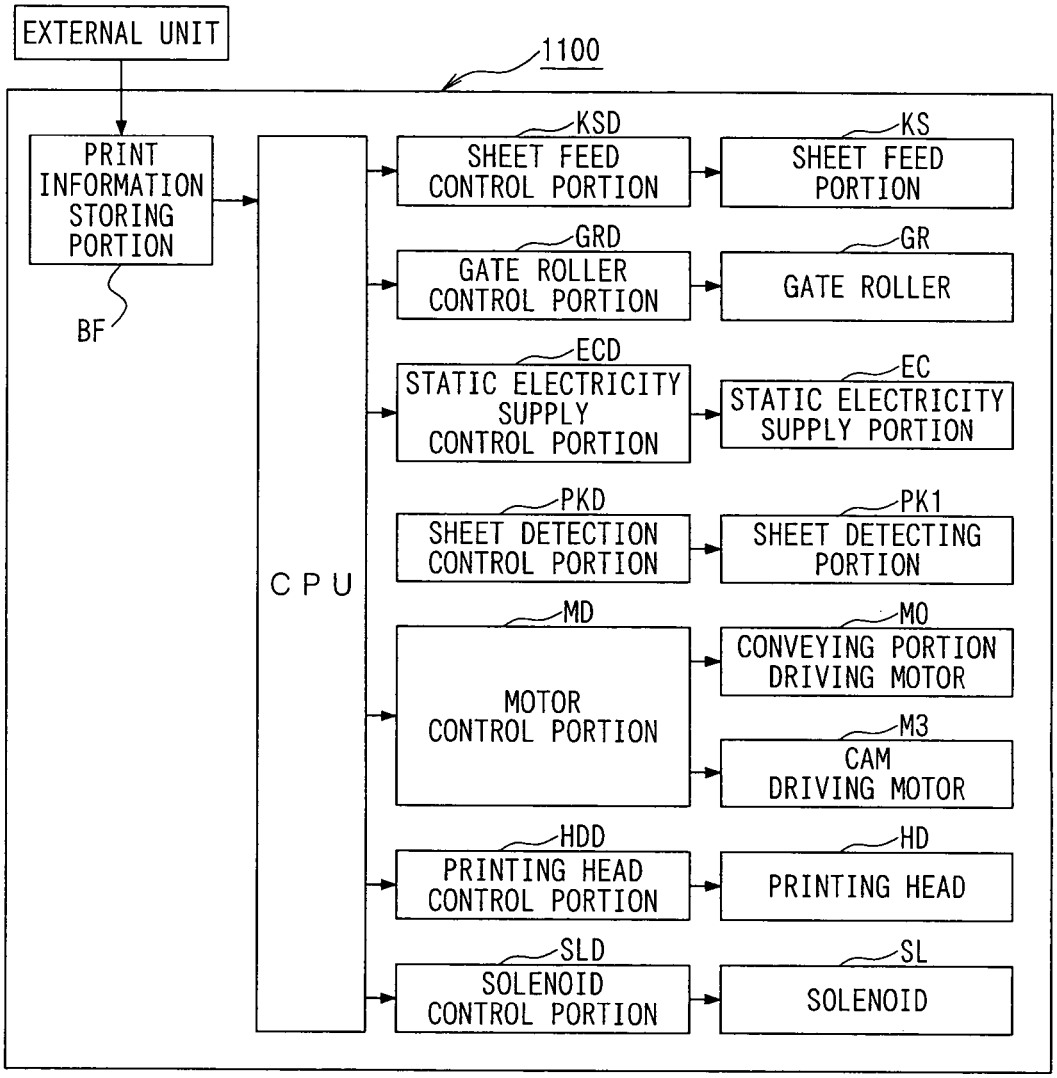
FIG. 36 is a block diagram showing the relation of control of a main portion of the ink jet printer of the fourth embodiment.

Moreover, as shown in FIG. 34A and FIG. 36, the ink jet printer 1100 is further provided with a solenoid SL and a solenoid control portion SLD for controlling the solenoid SL.

Figure 37A:
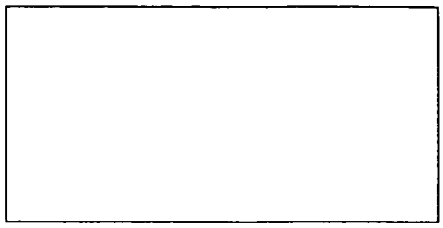
FIGS. 37A and 37B are illustrations showing the appearance of a printing head of the fourth embodiment.
Figure 37B:
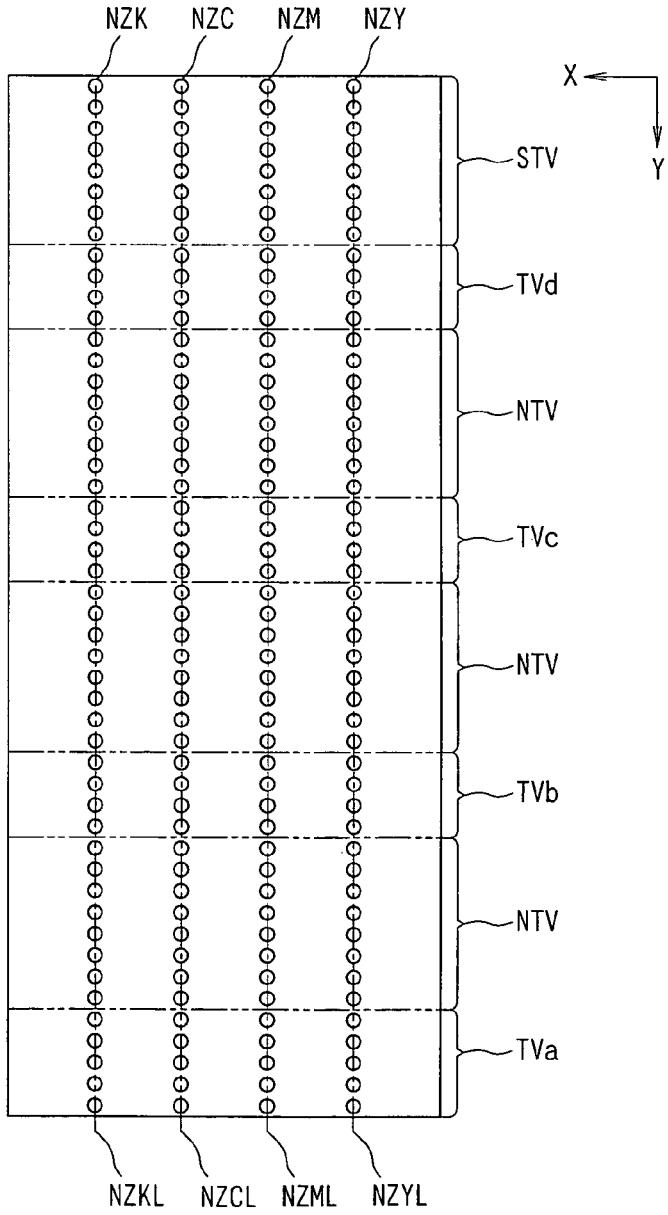

Furthermore, a line head HD having a printing area equal to a sheet width is used as a printing head. As shown in FIG. 37B, in the case of the printing head HD, color nozzles NZY, NZM, NZC, and NZK of yellow, magenta, cyan, and black colors are arranged in X direction and arranged on the Y-directional same line to constitute nozzle strings NZYL, NZML, NZCL, and NZKL respectively having one color nozzle.

Furthermore, as shown in FIG. 34A, in the case of the printing head HD, the color nozzle strings NZYL, NZML, NZCL, and NZKL cross conveying belts Va, Vb, Vc, and Vd at the central portion between the driven shaft FS and driving shaft DS and arranged so as to cover the width-directional whole area of the printing area on the printing face PP. That is, as shown in FIG. 37B, the color nozzle strings NZYL, NZML, NZCL, and NZKL have a belt non-facing nozzle NTV facing the gap between the conveying belts Va to Vd, belt facing nozzle TVa to TVd individually facing the conveying belts Va to Vd, and outer facing nozzle STV facing the outermost of the gap between conveying belts sandwiching the conveying belt Vd with a belt non-facing nozzle NTV.

Figure 38A:
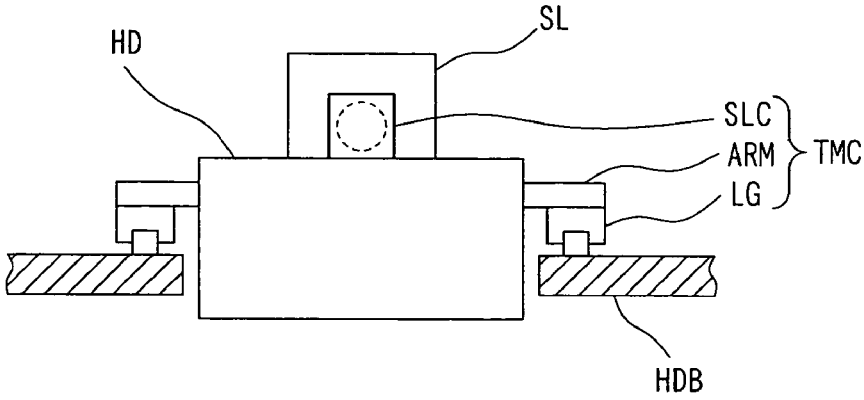
FIGS. 38A and 38B are illustrations for explaining a configuration of a head movement mechanism.
Figure 38B:
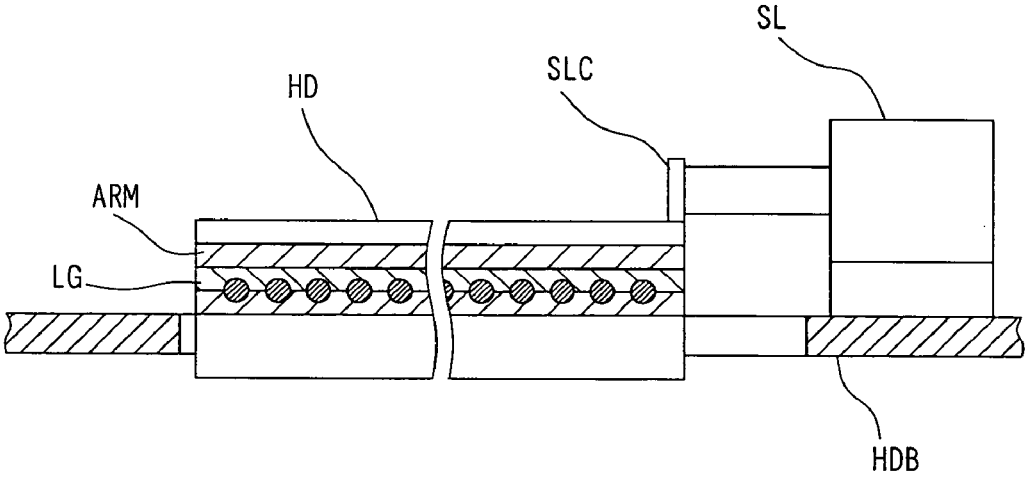

The printing head HD is moved between a printing-position-cum-first discharge performance recovery position where the belt facing nozzles TVa to TVd face the conveying belts Va to Vd and a second discharge performance recovery position where belt non-facing nozzle NTV faces the conveying belts Va to Vd by moving in the width direction from the former position in accordance with the motive power supplied from the solenoid SL transferred through a head moving mechanism TMC shown in FIG. 38.

The head moving mechanism TMC has a configuration of a linear guide LG is fixed to be the printing head supporting section HDB to support the arm portion ARM of the printing head HD. The linear guide LG smoothly guides the printing head HD when the motive power of the solenoid SL is transferred to the printing head HD through a solenoid connecting portion SLC. As shown in FIG. 36, driving of the solenoid SL is controlled by the solenoid control portion SLD.

An arrangement configuration of the discharge performance recovery cap CA and the printing head HD is described below.

Figure 39A:
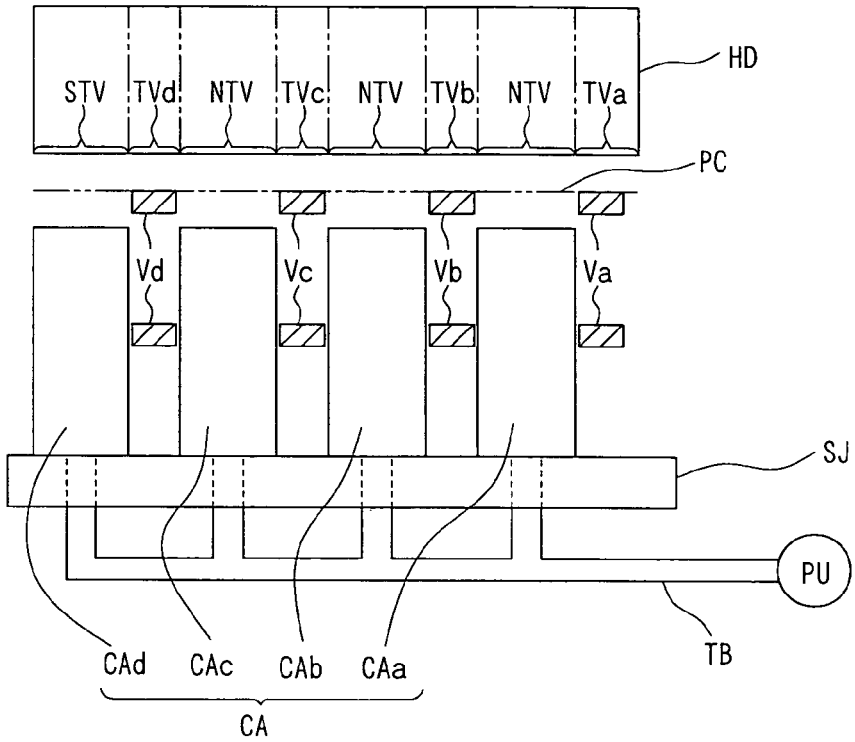
FIGS. 39A and 39B are illustrations schematically showing the F-F cross section in FIG. 34.
Figure 39B:
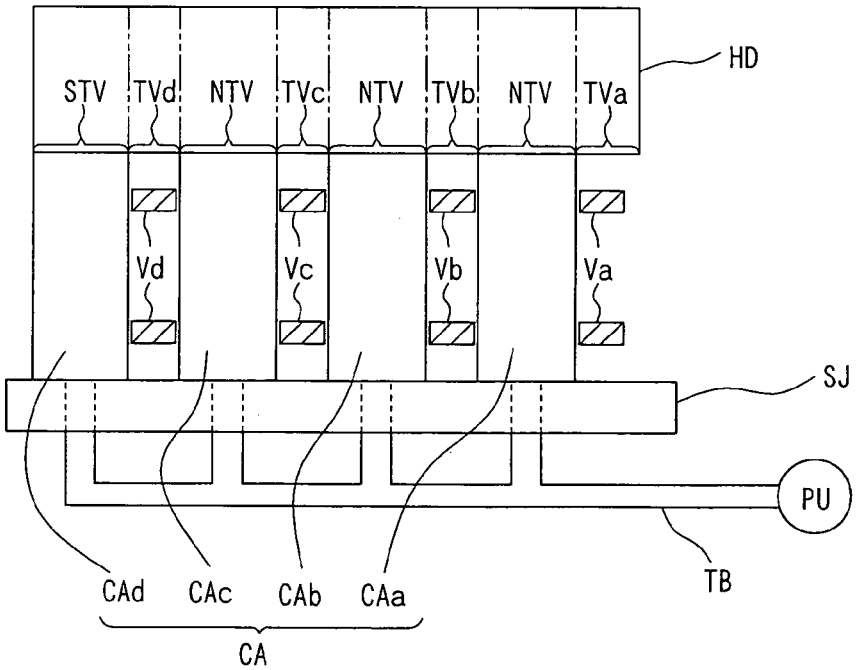

FIGS. 39A and 39B are illustrations schematically showing the F-F cross section in FIG. 34A to explain the arrangement configuration of the printing head HD and the discharge performance recovery cap CA.

As shown in FIG. 39A, the discharge performance recovery cap CA has four split caps CAa to CAd. The split caps CAa to CAc among the split caps CAa to CAd are arranged at the position between the conveying belts Va to Vd so as to face the belt non-facing nozzle NTV of the printing head HD by sandwiching the conveying route PC of the printing sheet P. Moreover, the split cap CAd is set adjacently to the split cap CAc by sandwiching the conveying belt Vd and set to a position facing the outer facing nozzle STV of the printing head HD by sandwiching the conveying route PC.

Furthermore, the widths of the split caps CAa to CAd are set to a value larger than the width of the belt facing nozzles TVa to TVd.

In the case of the ink jet printer 1100 having the above configuration, when the printing operation is started, the printing sheet P is led to a position under the printing head HD, the printing head HD is controlled by the printing head control portion HDD, and data is printed on the printing face PP as in the first embodiment, as shown in FIG. 34B.

Moreover, as shown in FIG. 39A, when data is printed on the printing sheet P, the belt facing nozzles TVa to TVd of the printing head HD are present at the printing position-cum-first discharge performance recovery position facing the conveying belts Va to Vd and the front end of the cap portion CP is present at the sheltering position below the conveying route PC in the case of the split caps CAa to CAd.

Because configurations of the discharge performance recovery cap CA and the cap elevating portion UD are the same as the case of the first embodiment, their descriptions are omitted and the discharge performance recovery operation is described.

The discharge performance recovery operation of the fourth embodiment is roughly divided into first discharge performance recovery operation for attracting ink from the belt non-facing nozzle NTV and outer facing nozzle STV and second discharge performance recovery operation for attracting ink from the belt facing nozzles TVa to TVd.

In the case of the first discharge performance recovery operation, the discharge performance recovery cap CA is raised by the cap elevating portion UD illustrated in FIG. 34B from the state in which the cap CA is present at the sheltering position as shown in FIG. 39A and contacts with the printing head HD as shown in FIG. 39B. Then, the cap portion CP of the split caps CAa to CAc and the cap portion of the split cap CAd cover the non-facing nozzle NTV and outer facing nozzle STV and ink is attracted by the suction pump PU similarly to the case of the first embodiment. After the ink is attracted, the discharge performance recovery cap CA returns to the sheltering position shown in FIG. 39A. Then, the first discharge performance recovery operation is completed.

Then, the second discharge performance recovery operation is described.

Figure 40A:
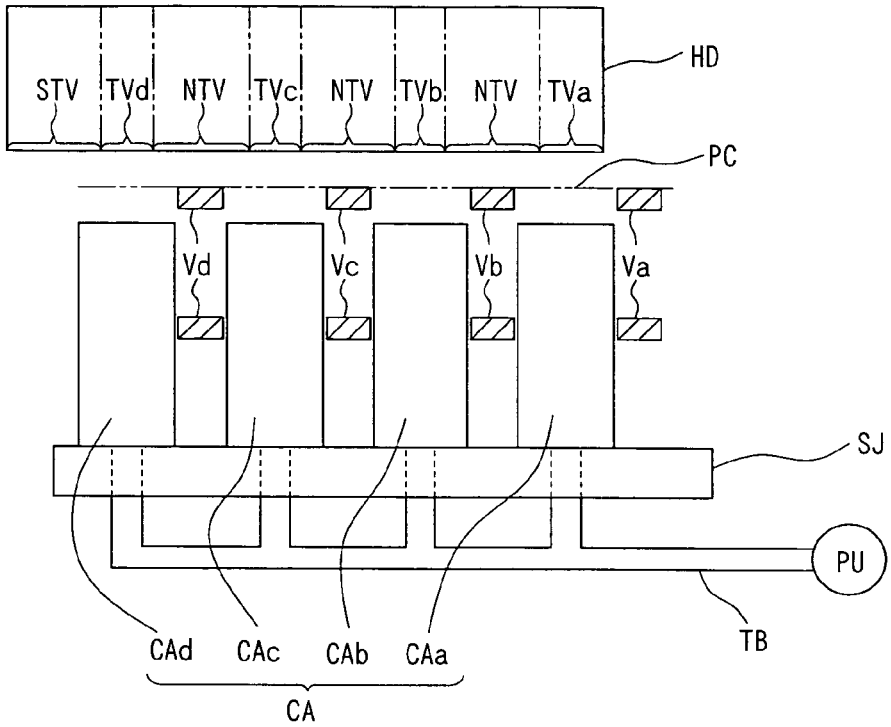
FIGS. 40A and 40B are illustrations for explaining the discharge performance recovery operation of a belt facing nozzle of the fourth embodiment.
Figure 40B:
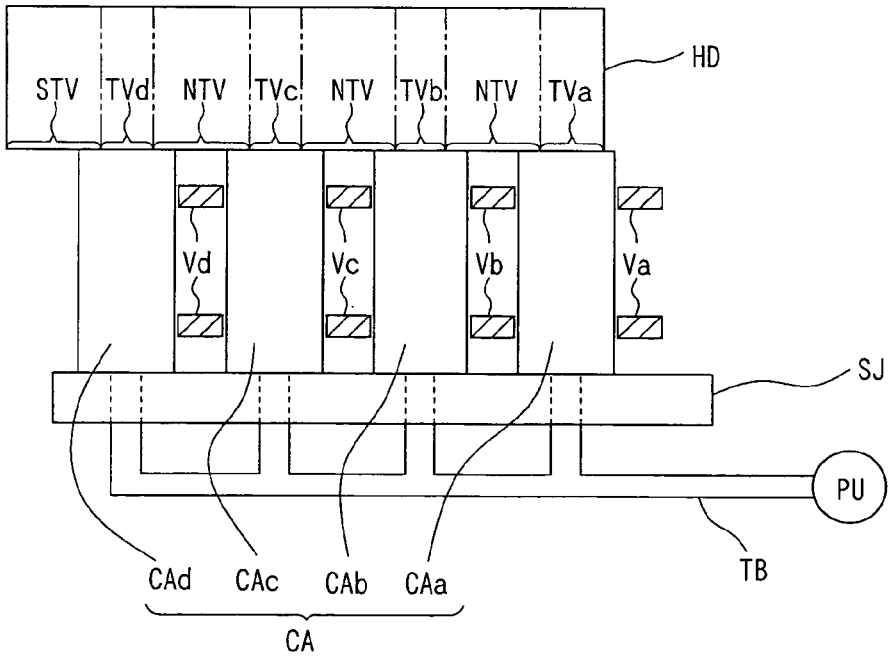

FIGS. 40A and 40B are illustrations for explaining discharge performance recovery operations of the belt facing nozzles TVa to TVd, in which FIG. 40A shows a state in which the discharge performance recovery cap CA is present at the sheltering position and FIG. 40B shows a state in which the discharge performance recovery cap CA rises.

When the first discharge performance recovery operation is completed and the discharge performance recovery cap CA returns to the sheltering position shown in FIG. 39A, the belt facing nozzles TVa to TVd of the printing head HD are moved up to a position facing the split caps CAa to CAd by the solenoid SL through the head moving mechanism TMC as shown in FIG. 40A.

Moreover, when the discharge performance recovery cap CP is raised, cap portions CP of the split caps CAa to CAd cover the belt facing nozzles TVa to TVd, belt non-facing nozzle NTV, and a part of the outer facing nozzle STV and ink is attracted by the suction pump PU. That is, ink is redundantly attracted from nozzles at the boundary between the belt non-facing nozzle NTV and the belt facing nozzles TVa to TVd of the outer facing nozzle STV.

Furthermore, when attraction of ink from the belt facing nozzles TVa to TVd, belt non-facing nozzle NTV, and a part of the outer facing nozzle STV is completed, the discharge performance recovery cap CA is moved to the sheltering position and the printing head HD is moved to the printing position as shown in FIG. 39A. This completes the second discharge performance recovery operation. When the second discharge performance recovery operation is completed, attraction of ink from all nozzles of the printing head HD is completed and the discharge performance recovery operation is completed.

In the case of the ink jet printer 1100 of the fourth embodiment, inter-sheet discharge performance recovery process is described which recovers the performance for discharging ink drips from the printing head HD between different printing sheets P when continuously printing data in the different printing sheets P.

Figure 41:
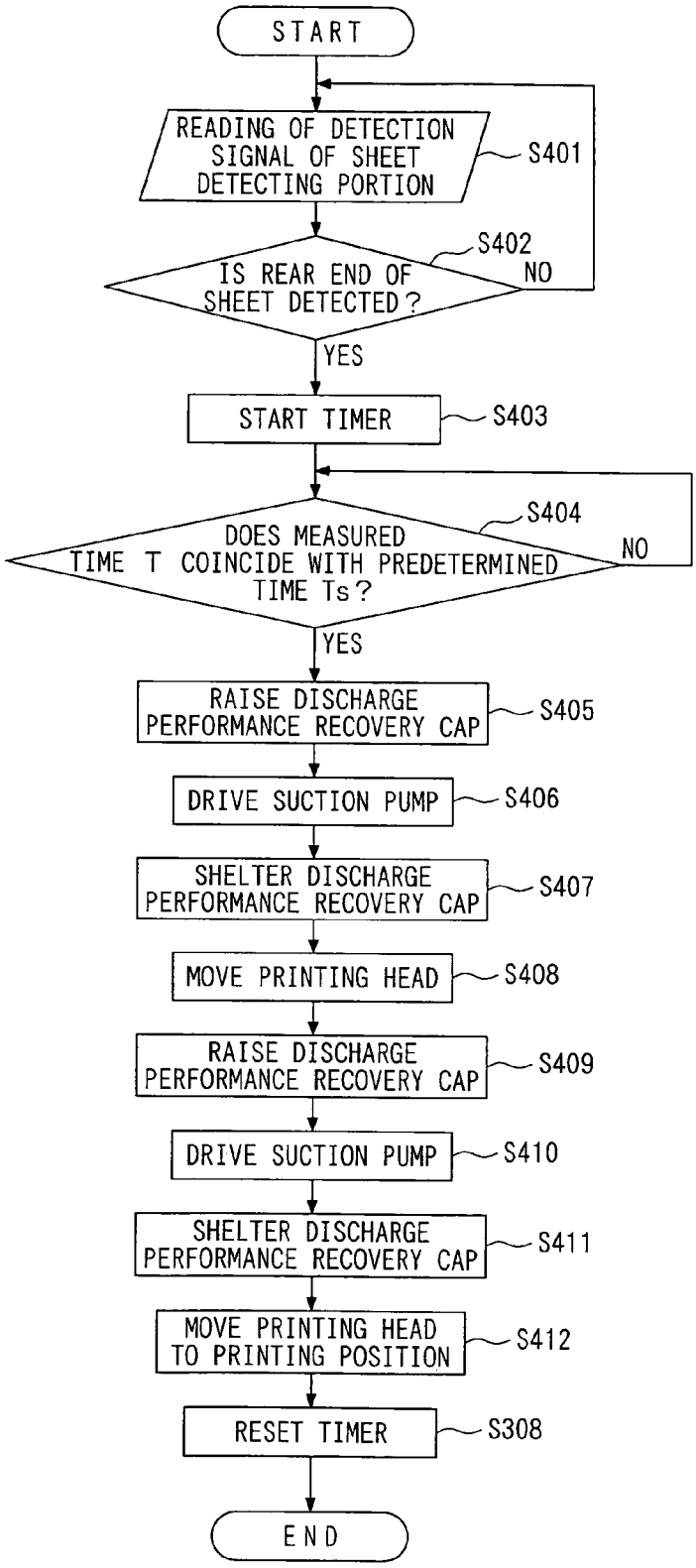
FIG. 41 is an illustration showing a flow of the inter-sheet discharge performance recovery process of the fourth embodiment.

In the case of the ink jet printer 1100, when the printing head HD starts printing, the CPU starts the inter-sheet discharge performance recovery process shown in FIG. 41.

First, in step S401, a sheet detection signal is read by the sheet detecting portion PK1 and step S402 is started.

Then, in step S402, the sheet detecting portion PK1 determines whether the rear end of the printing sheet P is detected in accordance with the sheet detection signal from the sheet detecting portion PK1. When it is determined that the rear end is detected, step S403 is started. When it is determined that the rear end is not detected, step S401 is started to read the sheet detection signal.

Then, in step S403, a timer for measuring the time since detecting the rear end of the printing sheet P is started and step S404 is started.

Then, in step S404, it is determined whether the time T measured by the timer coincides with the predetermined time Ts. When it is determined that the time T coincides with the time Ts, step S405 is started. When it is determined that the time T does not coincide with the time Ts, step S404 is repeated until the time T coincides with the time Ts.

Then, in step S405, the cam driving motor M3 is driven to bring the cap portion CP of the discharge performance recovery cap CA into contact with the nozzle face NZP of the printing head HD to start step S406.

Then, in step S406, the suction pump PU is driven to attract ink from the belt non-facing nozzle NTV and outer facing nozzle STV to recover the ink discharge performance and step S407 is started.

Then, in step S407, the cam driving motor M3 is driven to shelter the discharge performance recovery cap CA to the sheltering position and step S408 is started.

Then, in step S408, the printing head HD is moved up to the second discharge performance recovery position and step S409 is started.

In step S409, the cam driving motor M3 is driven to bring the cap portion CP of the discharge performance recovery cap CA into contact with the nozzle face NZP of the printing head HD and step S410 is started.

Then, in step S410, the suction pump PU is driven to attract ink from the belt facing nozzle TVa to TVd, belt non-facing nozzle NTV, and a part of the outer facing nozzle STV to recover the ink discharge performance and step S411 is started.

Then, in step S411, the cam driving motor M3 is driven to shelter the discharge performance recovery cap CA to the sheltering position and step S412 is started.

Then, in step S412, the printing head HD is moved up to the printing position and step S413 is started.

Then, in step S413, the timer is reset to complete the process.

In the case of this fourth embodiment, processes in steps S405 to S407 and steps S409 to S411 in FIG. 41 correspond to a discharge performance recovery section and processes in steps S408 and S412 correspond to a head moving section.

Moreover, the discharge performance recovery cap CA corresponds to the discharge performance recovery section, the solenoid SL and head moving mechanism TMC correspond to the head moving section, the belt non-facing nozzle NTV corresponds to the facing nozzle, and belt facing nozzles TVa to TVd correspond to the non-facing nozzle.

According to the above mentioned, it is possible to simplify the configurations of the sheet conveying portion CV and discharge performance recovery cap CA compared to the case of the third embodiment and recover the ink discharge performance with the number of discharge performance recovery caps less than the number of printing heads and moreover, keep the discharge performance recovery section below the conveying face of the printing sheet P. Therefore, it is possible to further downsize an ink jet printer capable of recovering the discharge performance of a head.

In the case of the printing head HD of the fourth embodiment, it is possible to constitute a necessary size by one body or by arranging the divided heads so that they become a necessary size. When the head HD is constituted of a plurality of divided heads and some nozzles of the printing head HD are damaged, it is possible to decrease the cost for replacement by replacing only a head having the damaged nozzles.

Moreover, it is possible to constitute the head moving mechanism TMC for moving the printing head HD by connecting a ball screw to the rotating shaft of a motor instead of the solenoid SL so as to transfer motive power to the printing head HD through a ball nut fixed to the printing head HD.

Furthermore, in the case of the inter-sheet discharge performance recovery process of the fourth embodiment, the discharge performance is recovered whenever the recoding head HD complete sprinting of data in one printing sheet P. However, it is also possible to recover the discharge performance whenever completing printing of data in a plurality of printing sheets P.

Furthermore, in the case of the fourth embodiment, the relative position of the printing head HD to the discharge performance recovery cap CA is changed when the head moving section moves the printing head HD. However, it is also possible to move the discharge performance recovery cap CA in the width direction by the cap moving mechanism TCA and cylinder CL shown in FIG. 42A.

In the case of the cap moving mechanism TCA, the linear guide LG fixed to the proximal end of a housing supports a conveying support portion CVB. Moreover, the conveying support portion CVB supports the sheet conveying portion CV, discharge performance recovery cap CA, and cap elevating portion UD and is connected with the driving shaft of the cylinder CL. The cylinder CL generates motive power by applying a pressure to a fluid and reciprocating a piston.

Figure 42A:
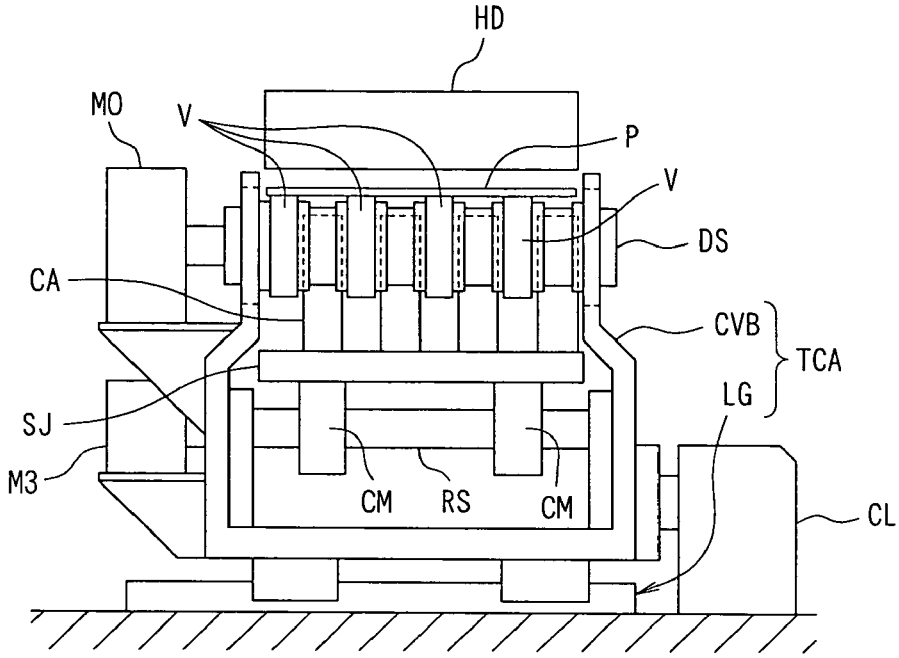
FIGS. 42A and 42B are illustrations for explaining a configuration of a cap movement mechanism.
Figure 42B:
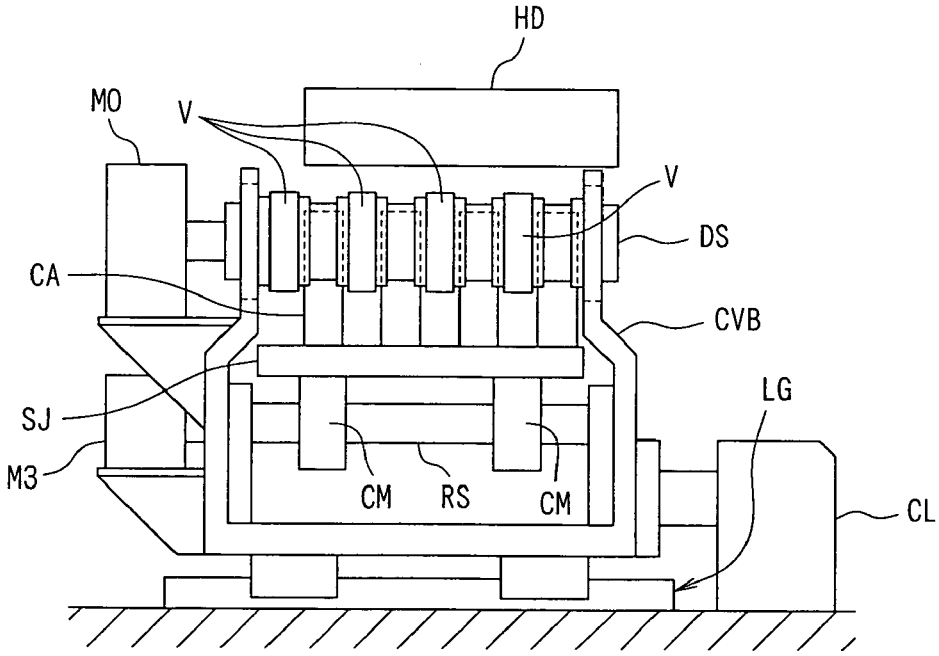

Then, as shown in FIG. 42B, the discharge performance recovery cap CA is moved with the sheet conveying portion CV and the cap elevating portion UD between the first discharge performance recovery position and the second discharge performance recovery position by the motive power supplied from the cylinder CL trough the cap moving mechanism TCA. In FIGS. 42A and 42B, the cylinder CL and cap moving mechanism TCA correspond to a discharge performance recovery moving section.

In the case of the configuration shown in FIGS. 42A and 42B, the cap moving mechanism TCA is moved by the motive power of the cylinder CL. However, it is also possible to move the cap moving mechanism TCA by the motive power of a motor through a mechanism for converting the rotational motion of a ball screw or nut into a linear motion.

The fifth embodiment of the present invention is described below by referring to the accompanying drawings.

Figure 43:
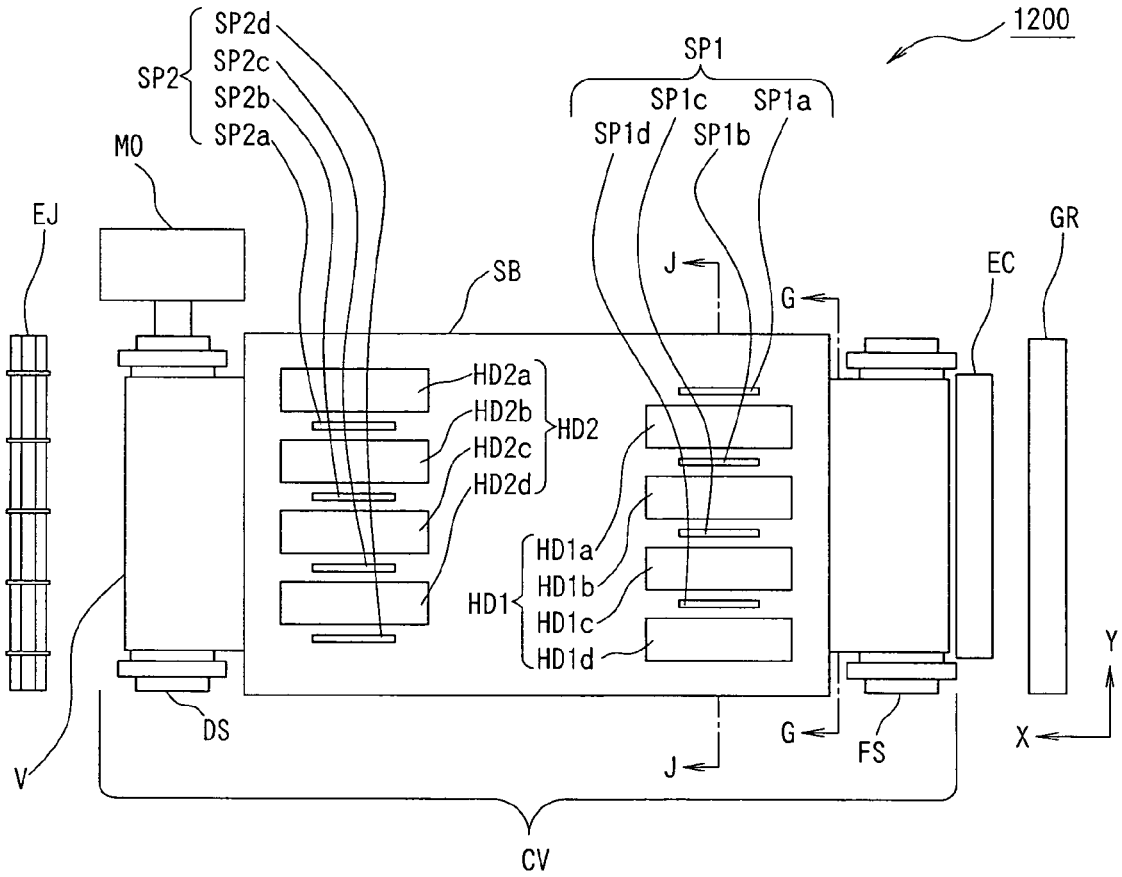
FIG. 43 is a top view showing a main configuration of an ink jet printer of fifth embodiment.

As shown in FIG. 43 which is a top view, the ink jet printer 1200 of the fifth embodiment has a configuration in which a first spur group SP1 is set between the printing heads HD1*a* to HD1*d* constituting the first printing head group HD1 and a second spur group SP2 is set between the printing heads HD2*a* to HD2*d* constituting the second printing head group HD2.

Figure 45:
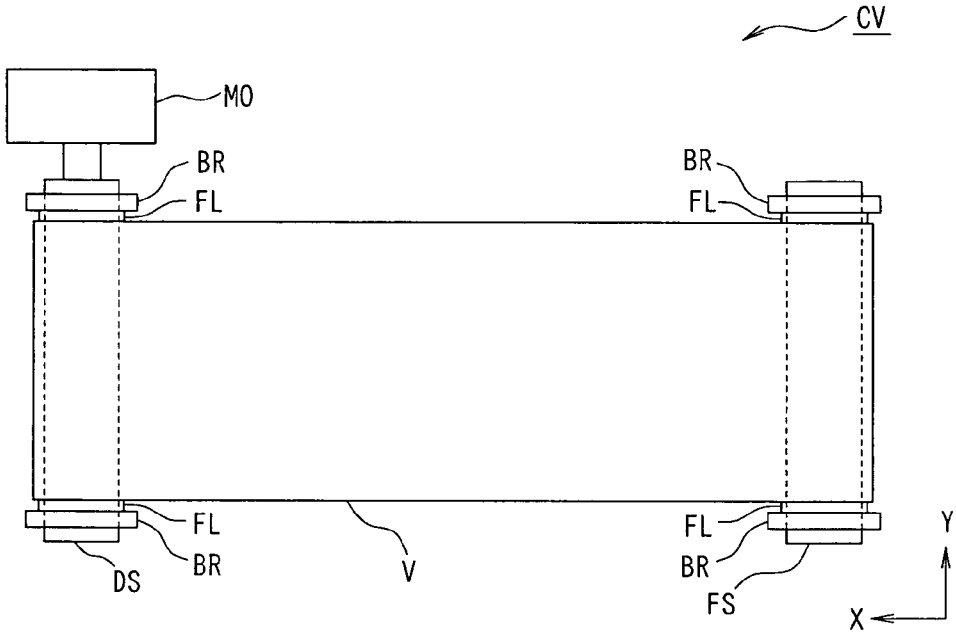
FIG. 45 is a top view showing a sheet conveying portion of the ink jet printer of the fifth embodiment.

Moreover, as shown in FIG. 45, the sheet conveying portion CV has a configuration in which the conveying interval between the first and second driven shafts FS1 and FS2 shown in FIG. 2 is constituted of a driven shaft FS and driving shaft DS and one conveying belt V is applied between the driven shaft FS and the driving shaft DS.

That is, the ink jet printer 1200 has the same configuration as the ink jet printer 1000 except that the first and second discharge performance recovery caps CA1 and CA2 are omitted from the ink jet printer 1000 of the third embodiment and the configuration of the sheet conveying portion CV is different.

Therefore, a portion corresponding to that of the ink jet printer 1000 is provided with the same symbol and its description is omitted.

Figure 44:
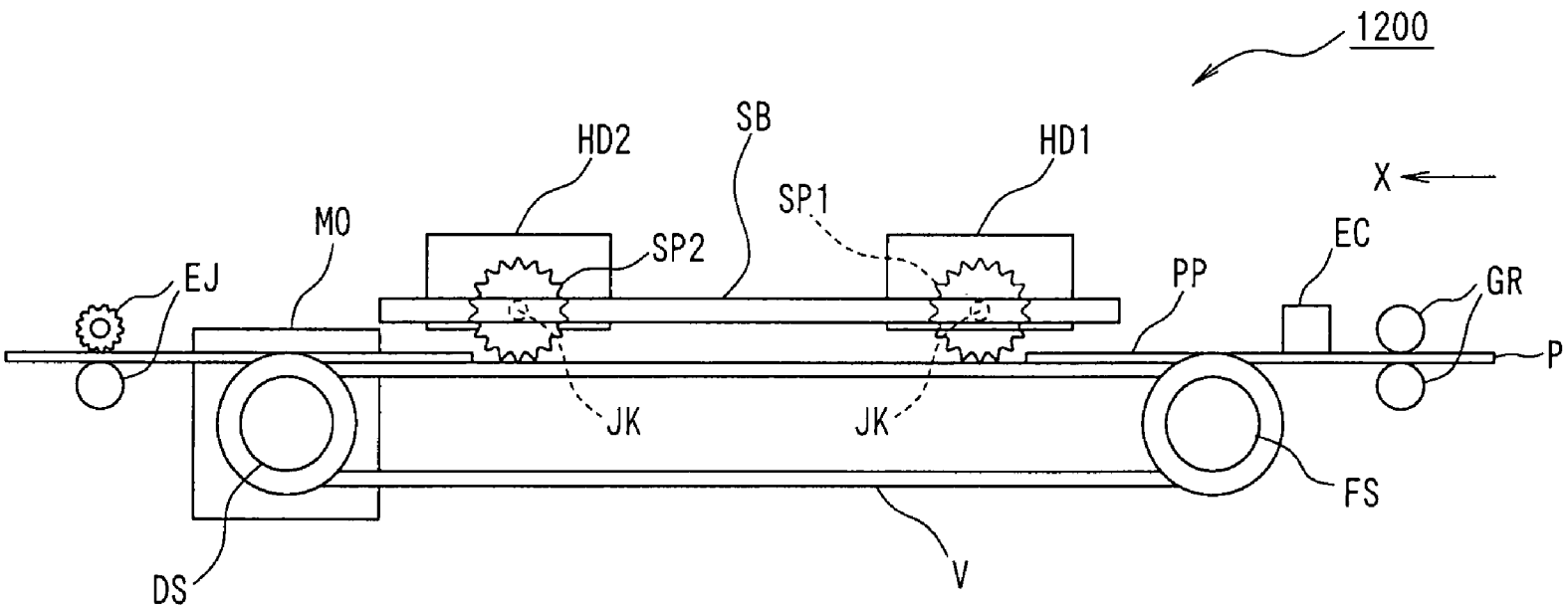
FIG. 44 is a front view showing a main configuration of the ink jet printer of the fifth embodiment.
Figure 46:
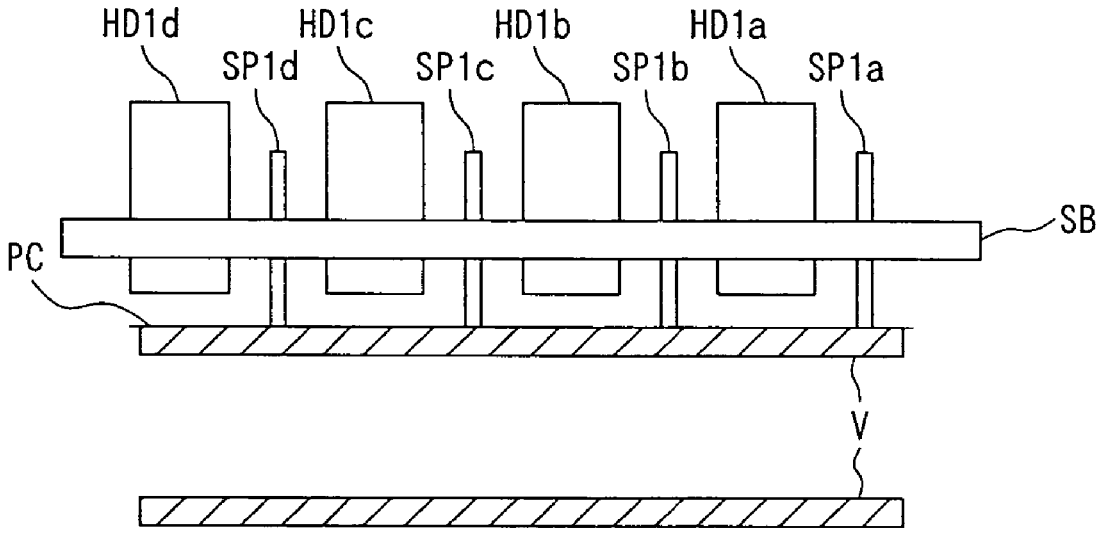
FIG. 46 is an illustration schematically showing the G-G cross section in FIG. 43.

As shown in FIG. 43, first and second spur groups SP1 and SP2 are respectively constituted of spurs SP1*a* to SP1*d* and SP2*a* to SP2*d*. Moreover, as shown in FIG. 46 which is an illustration schematically showing the G-G cross section in FIG. 43, in the case of the spurs SP1*a* to SP1*d* and SP2*a* to SP2*d*, outer peripheries are formed so as to contact with the surface of a conveying belt V sandwiching the conveying route PC of a printing sheet P. In FIG. 46, the downstream side of the driving shaft DS is omitted so as to make the configuration easily understood. As shown in FIG. 44, in the spur groups SP1*a* to SP1*d* and SP2*a* to SP2*d*, respectively, protrusions are radially formed on the outer periphery of a roller rotatable about a spur rotating shaft JK and the top of the protrusions and the conveying belt V control the lift of the printing sheet P by sandwiching the printing sheet P.

As shown in FIG. 43, spurs SP1*b* to SP1*d* of the first spur group SP1 are set to almost the central portion in Y direction between the printing heads HD1*a* to HD1*d* of the first printing head group HD1 and the rotating center is set so as to be located at almost the central portion of the X-directional length of the printing heads HD1*a* to HD1*d*. The spur SP1*a* is set in line to the spur SP1*b* sandwiching the printing head HD1*a*. The spurs SP2*a* to SP2*c* of the second spur group SP2 are set between the printing heads HD2*a* to HD2*d* similarly to the case of the first spur group SP1 and the spur SP2*d* is set in line to the spur SP2*c* sandwiching the printing head HD2*d*.

Figure 47A:
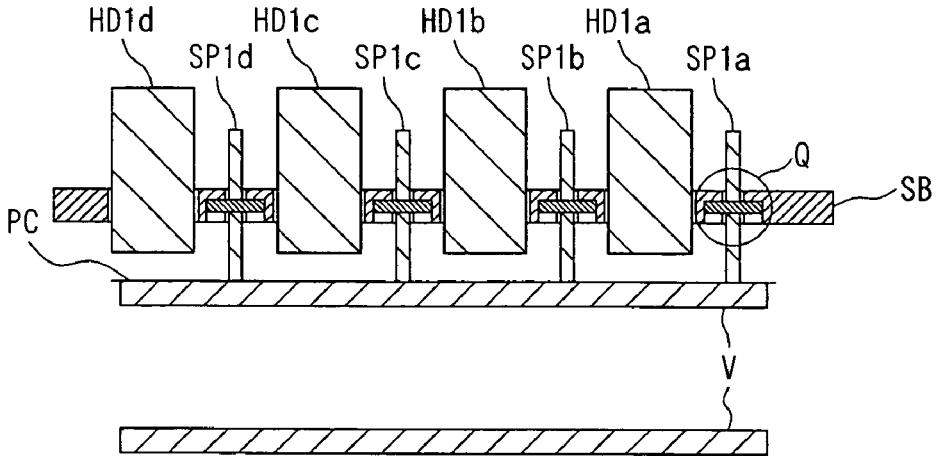
FIGS. 47A and 47B are illustrations showing the J-J cross section in FIG. 43.

In this case, the first and second printing head groups HD1 and HD2 and first and second spur groups SP1 and SP2 are supported by a support plate SB fixed to a not-illustrated housing as shown in FIG. 47A which is the J-J cross section in FIG. 43.

The printing heads HD1*a* to HD1*d* and HD2*a* to HD2*d* are fixed to the support plate SB so that the nozzle face NZP serving as a face on which nozzles are formed by penetrating the support plate SB faces the conveying route PC.

Figure 47B:
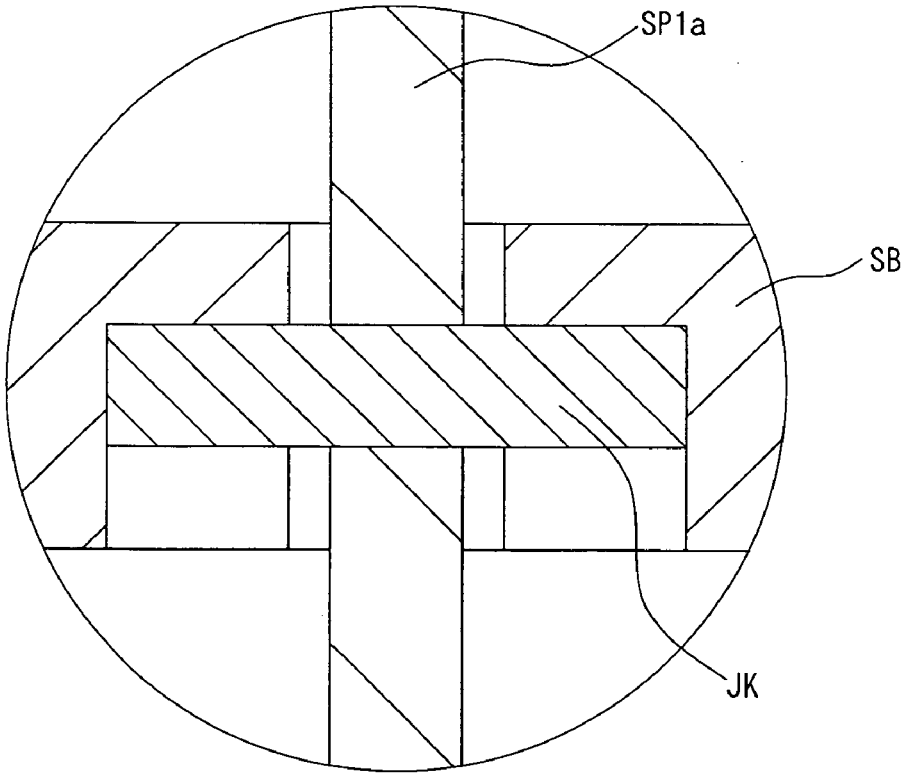

As shown in FIG. 47B which is an illustration showing details of the Q portion in FIG. 47A, the spurs SP1*a* to SP1*d* and SP2*a* to SP2*d* penetrate the support plate SB and outer peripheries of them contact with the conveying route PC and are rotatably supported by the spur rotating shaft JK inserted into the support plate SB.

When the ink jet printer 1200 having the above configuration receives print information and a printing instruction from an external unit, it starts the printing operation.

Figure 48:
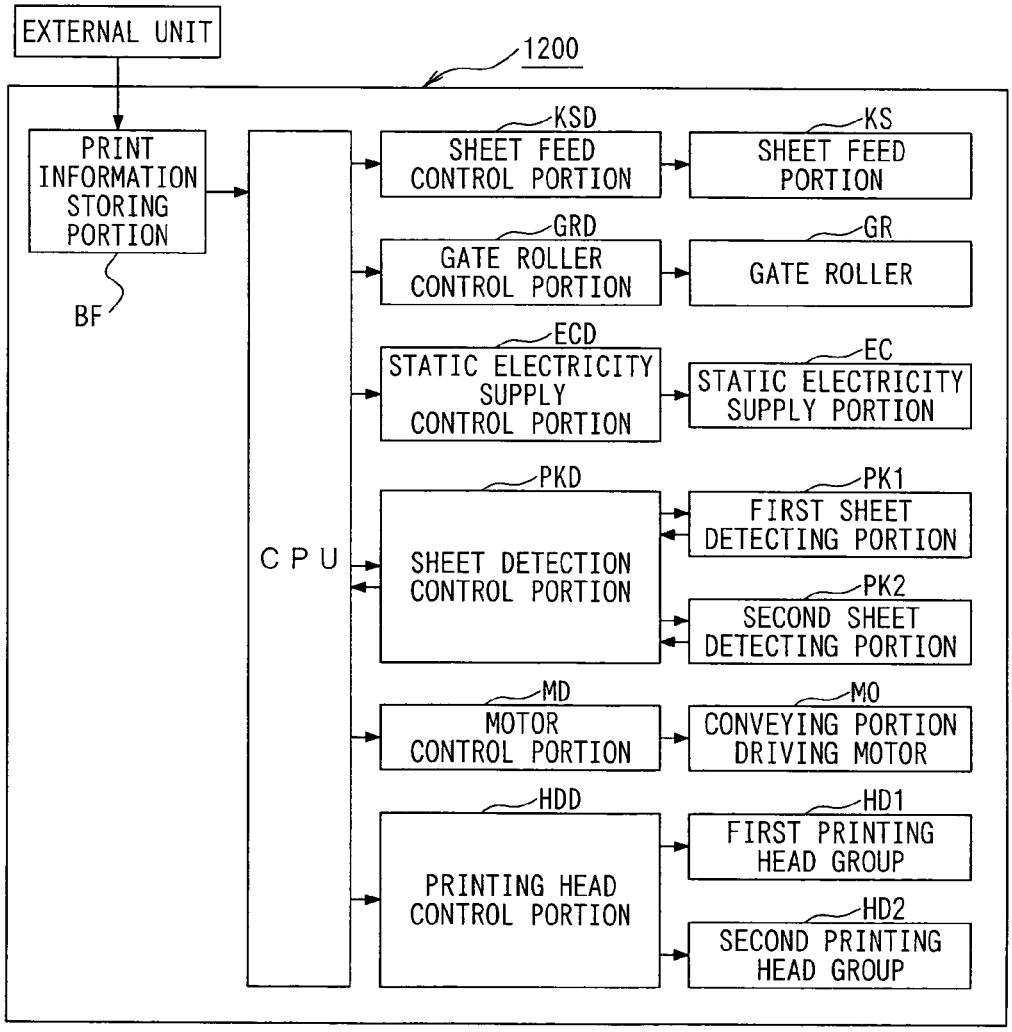
FIG. 48 is a block diagram showing the relation of control of a main portion of the ink jet printer of the fifth embodiment.

When the printing operation is started, the printing sheet P is supplied one by one to a gate roller GR from a not-illustrated sheet cassette which holds the printing sheets P by the sheet feed portion KS shown in FIG. 48.

The printing sheet P which is fed to the gate roller GR is corrected in tilt in X direction and displacement in Y direction by the gate roller GR and fed to the sheet conveying portion CV.

The printing sheet P is electrified by static electricity supply portion EC while the printing sheet P is fed to the sheet conveying portion CV from the gate roller GR.

In the case of the printing sheet P electrified and having an attraction force to the conveying belt V, the driving shaft DS is rotated by a conveying portion driving motor M0 and attracted to the outer periphery of the conveying belt V in which the conveying belt V is rotated counter clockwise in FIG. 2, conveyed by motive power from the conveying portion driving motor M0, and led to the portion under the first printing head group HD1.

Before the printing sheet P reaches the portion under the first printing head group HD1, the first sheet detecting portion PK1 shown in FIG. 48 detects the printing sheet P and sends a first sheet detection signal showing that the printing sheet P is detected to a CPU.

The CPU measures the timing for starting to print in accordance with the first sheet detection signal supplied from the first sheet detecting portion PK1 and sends a first printing instruction to the printing head control portion HDD shown in FIG. 48.

The printing head control portion HDD controls the first printing head group HD1 in accordance with a first printing instruction to perform first printing by selectively discharging ink drips from color nozzles NZY, NZM, NZC, and NZK in accordance with print information to the printing face PP of the printing sheet P which continuously moving under the nozzle face NZP by the conveying belt.

The printing sheet P to which first printing is applied is further conveyed by the conveying belt V and led to the portion under the second printing head group HD2.

Before the printing sheet P reaches the portion under the second printing head group HD2, the second sheet detecting portion PK2 shown in FIG. 48 detects the printing sheet P and sends a second sheet detection signal showing that the printing sheet P is detected to the CPU.

The CPU measures the timing for starting printing in accordance with a second sheet detection signal supplied from the second sheet detecting portion PK2 and sends a second printing instruction to the printing head control portion HDD shown in FIG. 48.

The printing head control portion HDD controls the second printing head group HD2 in accordance with the second printing instruction and performs second printing by selectively discharging ink drips from color nozzles NZY, NZM, NZC, and NZK in accordance with print information to the printing face PP of the printing sheet P continuously moving under the nozzle face NZP by the conveying belt V.

When the second printing is completed, printing of data in one printing sheet P is completed and the printing sheet P is ejected to the outside of the ink jet printer 1 by a sheet ejecting portion EJ.

At this point, when printing of all print informations is completed, the printing operation is completed. When unprinted print information is left, a new printing sheet P is fed to the gate roller GR to continue the printing operation until printing of all print informations is completed.

In the case of this ink jet printer 1200, the first and second printing head groups HD1 and HD2 correspond to first and second head groups, the printing sheet P corresponds to a printing medium, and the spurs SP1*a* to SP1*d* and SP2*a* to SP2*d* correspond to a roller serving as a printing-medium tilt control section.

According to the above described, printing is performed and an elongation occurs on the printing face PP in which ink IK is infiltrated and a warp occurs on the printing sheet P, and the warp of the printing sheet P under the printing heads HD1*a* to HD1*d* and HD2*a* to HD2*d* is corrected by the spurs SP1*a* to SP1*d* and SP2*a* to SP2*d* even if warp occurs in the printing sheet P. Therefore, the interval between the printing face PP and the printing heads HD1*a* to HD1*d* and HD2*a* to HD2*d* is properly maintained and it is possible to obtain a preferable printing quality.

In the case of the fifth embodiment, the printing sheet P is described as a printing medium. However, it is also possible to apply the fifth embodiment to a printing medium other than paper. For example, the fifth embodiment can be applied to films respectively made of a material such as resin and having various shapes such as circle and different shapes and various dimensions.

Moreover, a configuration is used in which the conveying belt V is directly applied to the driving shaft DS and driven shaft FS. However, it is also possible to use a configuration in which the conveying belt V is used as a timing belt and a timing belt pulley is set to the driving shaft DS and driven shaft FS so as to transfer motive power to the conveying belt V through the timing belt pulley.

Moreover, the fifth embodiment uses a configuration in which one spur is set between printing heads. However, it is also possible to use a configuration in which two or more spurs are set. This case is preferable because the lift of a printing medium is controlled in a wider range over the X-directional length of a printing head.

Furthermore, the height to the spurs SP1*a* to SP1*d* and SP2*a* to SP2*d* from the conveying belt V is set so that tops of protrusions of the spurs SP1*a* to SP1*d* and SP2*a* to SP2*d* contact with the conveying belt V when the printing sheet P is not present between the spurs SP1*a* to SP1*d* and SP2*a* to SP2*d* and the conveying belt V. However, it is also possible to set the height so as to have a predetermined gap. In this case, the predetermined gap is set to the distance for the top to contact with the printing face PP when the printing sheet P is lifted from the conveying belt V by a predetermined value, that is, the distance for the top to contact with the printing face PP when exceeding a limit for the printing quality not to be deteriorated. Therefore, when the lift of the printing sheet P from the conveying belt V is less than the predetermined value, spurs SP1*a* to SP1*d* and SP2*a* to SP2*d* do not contact with the printing face PP. Therefore, it is possible to restrain the deterioration in the printing quality due to contact of the spurs SP1*a* to SP1*d* and SP2*a* to SP2*d*.

Figure 49:
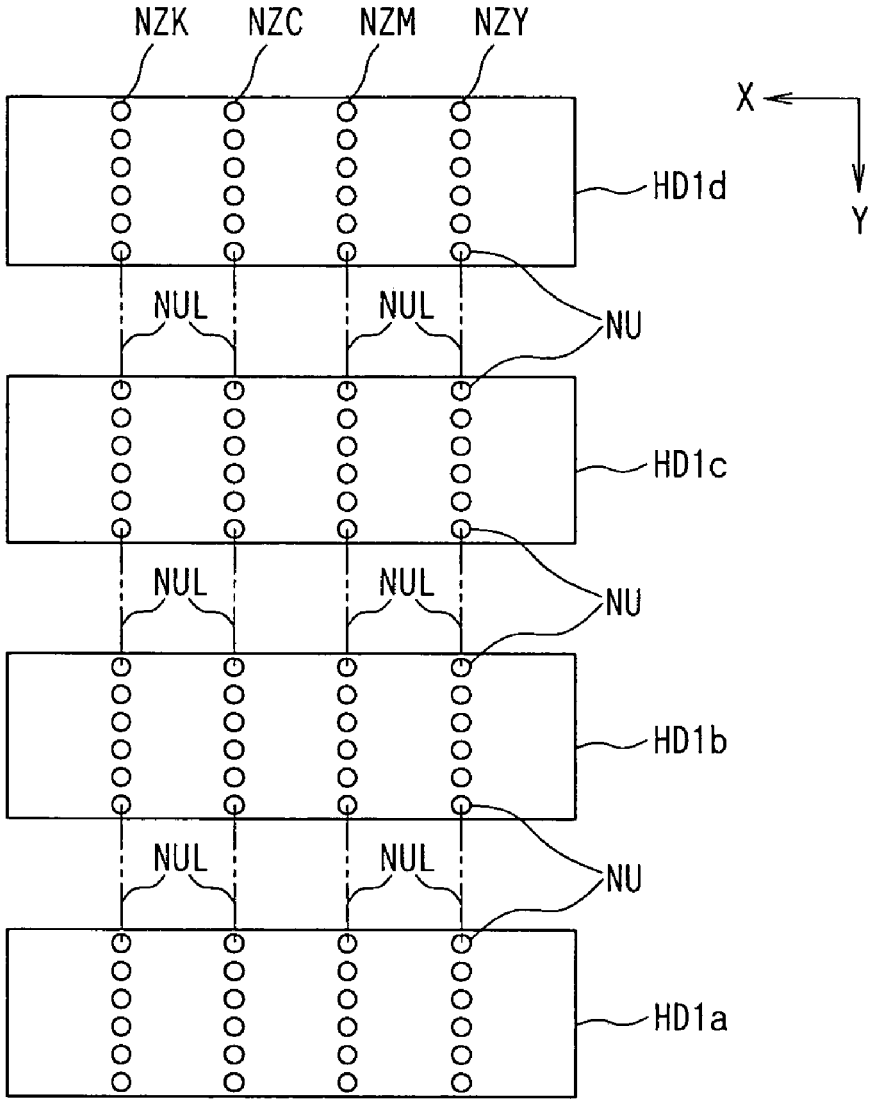
FIG. 49 is a bottom view of a first printing-head group.

Moreover, positions of the spurs SP1*a* to SP1*d* and SP2*a* to SP2*d* to the printing heads HD1*a* to HD1*d* and HD2*a* to HD2*d* are set so that contact portions between the spurs SP1*a* to SP1*d* and SP2*a* to SP2*d* are located at almost the central portion of the X-directional length of the printing heads HD1*a* to HD1*d* and HD2*a* to HD2*d*. However, as shown in FIG. 49, it is also possible to set the positions so that the contact portions are located on a line NUL connecting innermost nozzles NU between printing heads. This case is preferable because it is possible to more effectively control the lift of the printing sheet P under the nozzles NZY, NZM, NZC, and NZK.

In the case of the fifth embodiment, the sheet conveying portion CV is constituted so that one conveying belt V is applied between the driven shaft FS and driving shaft DS. However, it is also possible to use the sheet conveying portion CV shown in FIG. 2 of the first embodiment.

Figure 50:
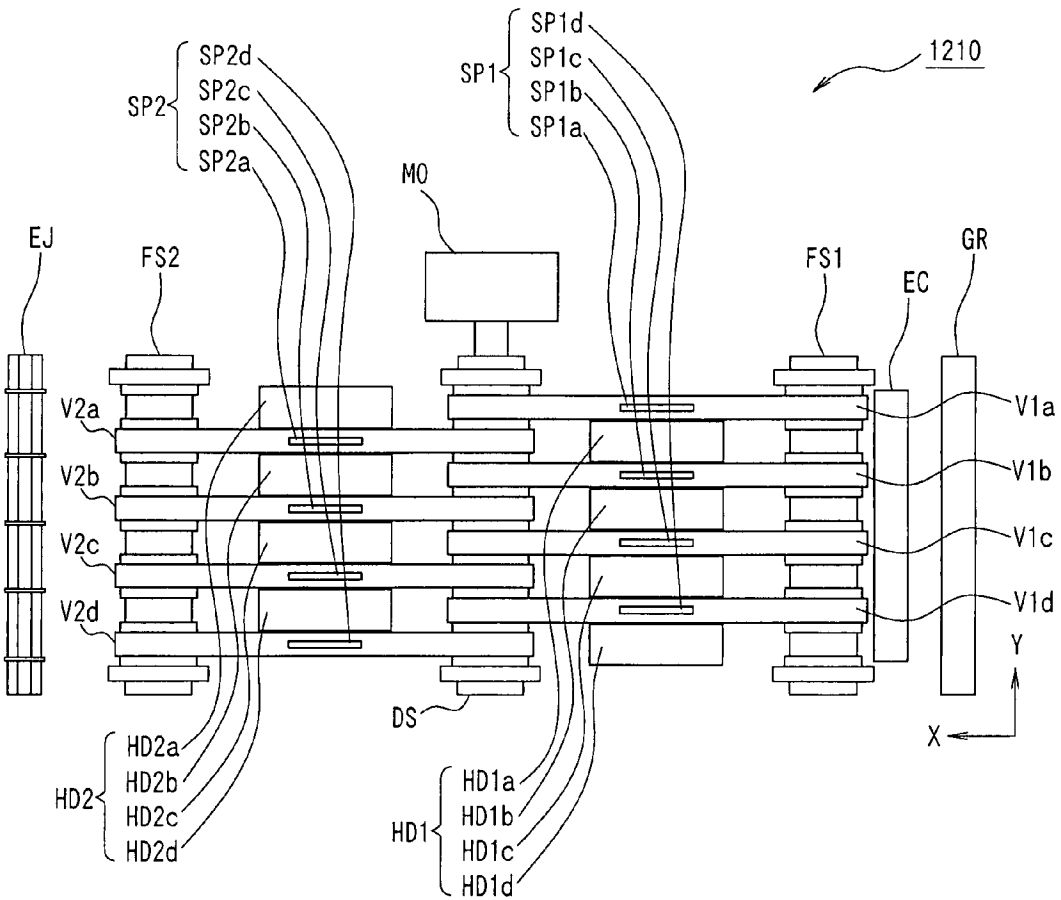
FIG. 50 is a top view showing another configuration of the ink jet printer of the fifth embodiment.
Figure 51:
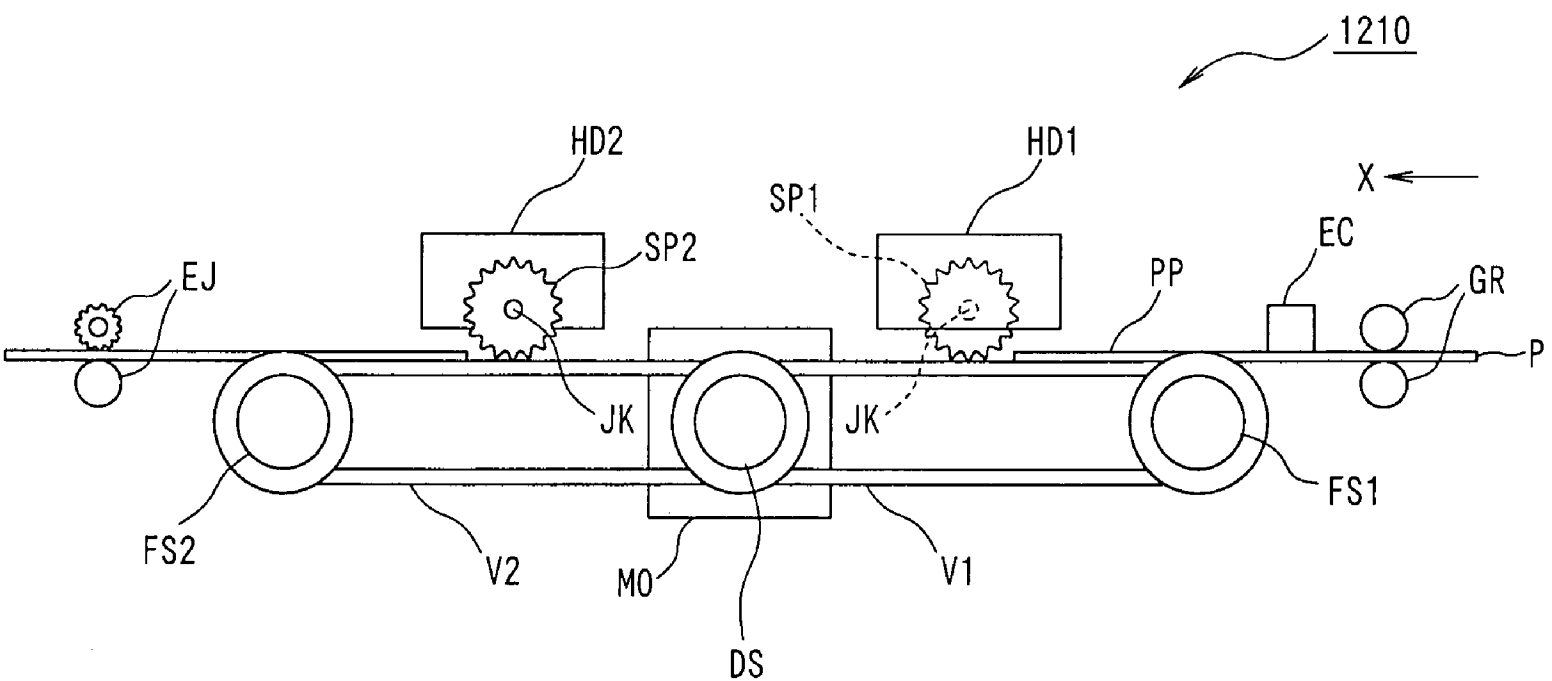
FIG. 51 is a front view showing still another configuration of the ink jet printer of the fifth embodiment.
Figure 52A:
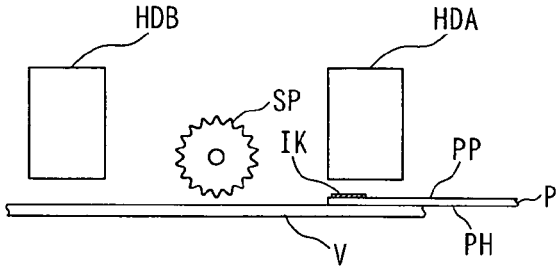
FIGS. 52A to 52D are illustrations for explaining problems of the prior art.
Figure 52B:
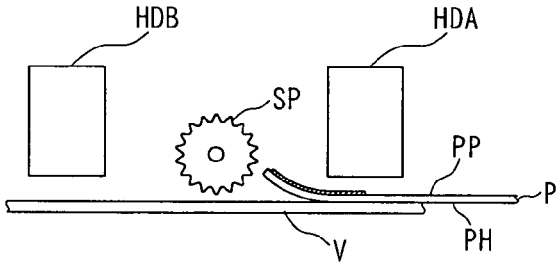
Figure 52C:
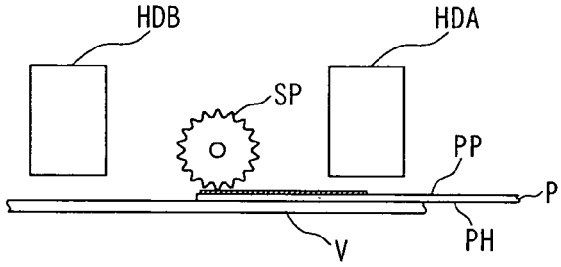
Figure 52D:
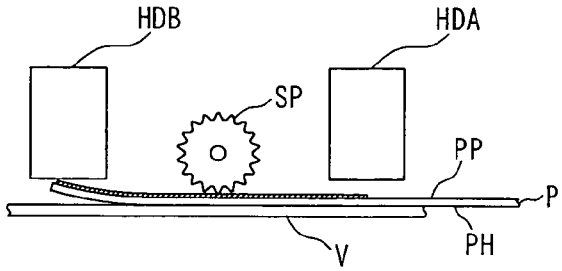

That is, in the case of the ink jet printer 1210 having the sheet conveying portion CV shown in FIG. 2 of the first embodiment, the first and second conveying belts V1 and V2 are driven by the common conveying portion driving motor M0 and driving shaft DS as shown in FIG. 50 which is a top view and FIG. 51 which is a front view.

In FIGS. 50 and 51, the support plate SB for supporting the printing heads HD1*a* to HD1*d* and HD2*a* to HD2*d* and the spurs SP1*a* to SP1*d* and SP2*a* to SP2*d* is omitted in order to made the configuration easily understood.

The ink jet printer 1210 has the same advantage as the ink jet printer 1200. Moreover, because the first and second conveying belts V1 and V2 are driven by the common conveying portion driving motor M0 and driving shaft DS, the printing sheet P is conveyed under the first and second printing heads HD1 and HD2 at the same speed and it is possible to restrain the difference between printing qualities by the first and second printing heads HD1 and HD2.

Moreover, it is possible to decrease the peripheral lengths of the conveying belts V1*a* to V1*d* and V2*a* to V2*d* constituting the first and second conveying portions CV1 and CV2 compared to the case of constituting the conveying interval equal to the case of the sheet conveying portion CV of the ink jet printer 1210 by one conveying belt and decrease the amplitude of vibrations of a conveying belt due to telescopic motion. Therefore, it is possible to further restrain the fluctuation of the interval between a printing head and the printing face of a printing medium.

Furthermore, by constituting the sheet conveying portion CV by the short first and second conveying portions CV1 and CV2, it is possible to prevent the looseness of a belt currently conveyed and accurately convey a printing medium along a plane.

In the case of the ink jet printer 1210, the first and second conveying belts V1 and V2 are respectively constituted of four conveying belts V1*a* to V1*d* and V2*a* to V2*d*. However, it is also possible that the belts V1 and V2 are constituted of one conveying belt each. It is preferable that the belts V1 and V2 are respectively constituted of a plurality of conveying belts in order to flatly and stably convey the printing face PP of the printing sheet P as flatly and stably as possible and obtain a preferable printing result.

Moreover, in the case of the ink jet printer 1210, the number of conveying belts V1 is equal to the number of conveying belts V2. However, it is also possible to use one conveying belt for either of the conveying belts V1 and V2 and two conveying belts for the other of them. Equalizing the numbers of conveying belts constituting the first and second conveying belts V1 and V2 and equalizing magnitudes of forces to be provided for the first and second driven shafts FS1 and FS2 in order to restrain the fluctuation of the conveying speed of the printing sheet P and obtaining a preferable printing quality is preferable in that it is possible to cancel the reaction force generated in the driving shaft DS and equalize tensions of all conveying belts.

Moreover, in the case of the fifth embodiment, the first and second printing head groups HD1 and HD2 respectively have a configuration in which the individual printing heads HD1*a* to HD1*d* and HD2*a* to HD2*d* are arranged. However, it is also possible that the head groups HD1 and HD2 are integrally constituted as long as a space in which the spurs SP1*a* to SP1*d* and SP2*a* to SP2*d* are arranged is secured.

What is claimed is:

1. An ink jet printer, comprising:

a printing medium conveying section for conveying a printing medium, the printing medium conveying section including first and second conveying portions positioned relative to one another in the conveying direction of the printing medium, each of the first and second conveying portions being separated by a predetermined distance, conveying belts in the same conveying portion being separated by a predetermined distance, the conveying belts in the first and second conveying portions being alternately and partially overlappingly positioned relative to a direction orthogonal to the conveying direction:

a plurality of first printing heads positioned in respective gaps between the conveying belts of the first conveying portion;

a plurality of second printing heads positioned in respective gaps between the conveying belts of the second conveying portion; and a plurality of nozzles arranged to discharge ink on the printing medium;

wherein one or the other of the first or second conveying portion has one more conveying belt than the other conveying portion, the middle conveying belt of the conveying portion having an odd number of conveying belts defining a center about which the other conveying belts in the conveying portion having an odd number of belts are alternately arranged and about which the conveying belts in the other conveying portion are alternately arranged.

2. The ink jet printer according to claim 1, wherein each of the plurality of conveying belts of either the first or second conveying portion extends between a driving shaft and a driven shaft set in parallel to the driving shaft.

3. The ink jet printer according to claim 1, further comprising a common driving shaft and first and second driven shafts, each set in parallel to the common driving shaft, each of the plurality of conveying belts of the first conveying portion extending between the common driving shaft and the first driven shaft, and each of the plurality of conveying belts of the second conveying portion extending between the common driving shaft and the second driven shaft.

4. The ink jet printer according to claim 1, further comprising a printing medium lift control section for controlling lift of the printing medium from the conveying belts.

5. The ink jet printer according to claim 4, wherein the printibg medium lift control section comprises at least one roller.

6. The ink jet printer according to claim 5, wherein the at least one roller has a plurality of radially extending protrusions.

7. The ink jet printer according to claim 5, wherein contact between the at least one roller and the printing medium is set to be located along a line that is substantially aligned with a line of nozzles.

8. The ink jet printer according to claim 5, wherein the at least one roller is positioned relative to at least one of the conveying belts to press the printing medium against the at least one conveying belt when the printing medium is present therebetween.

9. The ink jet printer according to claim 5, wherein the at least one roller is positioned a distance from at least one conveying belt such that the at least one roller contacts a printing face of the printing medium when the printing medium is present therebetween and the printing medium is lifted from the conveying belt a predetermined distance.

10. The ink jet printer according to claim 1, further comprising a head protective section for covering and protecting at least some of the nozzles.

11. The ink jet printer according to claim 10, wherein the head protective section is of a width for covering and protecting all of the nozzles.

12. The ink jet printer according to claim 10, wherein the head protective section is moveable between a sheltering position and a head protective position in which the head protective section is raised from the sheltering position to contact the printing heads.

13. The ink jet printer according to claim 1, further comprising a discharge performance recovery section for attracting ink from the nozzles.

14. The ink jet printer according to claim 13, wherein the discharge performance recovery section is of a width for covering and protecting all of the nozzles.

15. The ink jet printer according to claim 13, wherein the discharge performance recovery section has a head protective function for covering and protecting the nozzles.

16. The ink jet printer according to claim 13, wherein the discharge performance recovery section is movable between a sheltering position and a discharge performance recovery position in which the discharge performance recovery section is raised from the sheltering position to contact the printing heads.

17. An ink jet printer, comprising:

a printing medium conveying section for conveying a printing medium, the printing medium conveying section including first and second conveying portions positioned relative to one another in the conveying direction of the printing medium, each of the first and second conveying portions having a plurality of conveying belts, adjacent conveying belts in the same conveying portion being separated by a predetermined distance, the conveying belts in the first and second conveying portions being alternately and partially overlappingly positioned relative to a direction orthogonal to the conveying direction;

a plurality of first printing heads positioned in respective gaps between the conveying belts of the first conveying portion;

a plurality of second printing heads positioned in respective gaps between the conveying belts of the second conveying portion;

a plurality of nozzles arranged to discharge ink on the printing medium;

a first printing area, a width of which is less than a distance between outside edges of the outermost conveying belts in the second conveying portion and is less than a width of the printing medium; and a third print head positioned outside of one or the other outermost conveying belt of either the first or second conveying portion to form an additional printing area extending width-wise from a side margin of the first or second printing area.

18. The ink jet printer according to claim 17, wherein one or the other of the first or second conveying portion has one more conveying belt than the other conveying portion, wherein the third print head comprises two units, one positioned outside of one outermost conveying belt of the conveying portion having the lesser number of conveying belts and the other unit positioned outside the other outermost conveying belt of the conveying portion having the lesser number of conveying belts.

* * * * *